US011703306B2

(12) United States Patent
Morgan et al.

(10) Patent No.: US 11,703,306 B2
(45) Date of Patent: Jul. 18, 2023

(54) SYSTEMS AND METHODS FOR SIGHTING FIREARMS

(71) Applicant: Range Tactics LLC, Genesee Depot, WI (US)

(72) Inventors: Wayne B. Morgan, Lincoln, NE (US); Richard D. Lindlau, Waukesha, WI (US); Daniel R. A. Harder, Hartland, WI (US); Myron O. Sleeper, Marshfield, MA (US)

(73) Assignee: Range Tactics LLC, Oconomowoc, WI (US)

( * ) Notice: Subject to any disclaimer, the term of this patent is extended or adjusted under 35 U.S.C. 154(b) by 15 days.

(21) Appl. No.: 17/465,616

(22) Filed: Sep. 2, 2021

(65) Prior Publication Data

US 2022/0065585 A1 Mar. 3, 2022

Related U.S. Application Data

(60) Provisional application No. 63/087,525, filed on Oct. 5, 2020, provisional application No. 63/073,710, filed on Sep. 2, 2020.

(51) Int. Cl.
*F41G 1/54* (2006.01)

(52) U.S. Cl.
CPC ..... *F41G 1/545* (2013.01)

(58) Field of Classification Search
CPC ..... F41G 1/545
USPC ..... 42/116
See application file for complete search history.

(56) References Cited

U.S. PATENT DOCUMENTS

| | | | | |
|---|---|---|---|---|
| 8,661,725 | B1 * | 3/2014 | Ganther | F41G 1/545 42/121 |
| 2002/0026740 | A1 * | 3/2002 | Greenfield | F41G 3/326 42/116 |
| 2022/0065585 | A1 * | 3/2022 | Morgan | F41G 1/545 |

* cited by examiner

*Primary Examiner* — Samir Abdosh
(74) *Attorney, Agent, or Firm* — Suiter Swantz pc llo

(57) ABSTRACT

A boresighting system may include a laser boresight device and a parallax mitigation device. The laser boresight device may include a casing for loading into a chamber of a firearm in place of a bolt carrier group, where the casing accepts a laser device for generating a laser beam within an interior cavity of the casing. The parallax mitigation device may include a housing for securing to an optical sight and a central position indicator providing a visual indication of a central position of the optical sight. Boresighting may be provided by adjusting an eye position to view a laser spot on a target associated with the laser beam at the central position of the optical sight based on the central position indicator and adjusting the optical sight to overlap an alignment reference provided by the optical sight with the laser spot at the central position of the optical sight.

13 Claims, 44 Drawing Sheets

SYSTEMS AND METHODS FOR SIGHTING FIREARMS

CROSS-REFERENCE TO RELATED APPLICATIONS

The present application claims the benefit under 35 U.S.C. § 119(e) of U.S. Provisional Application Ser. No. 63/073,710 filed on Sep. 2, 2020 and 63/087,525 filed on Oct. 5, 2020, both of which are incorporated herein by reference in the entirety.

TECHNICAL FIELD

The present disclosure is related generally to the field of firearm sighting and, more particularly, to a method and system for laser boresighting.

BACKGROUND

Reflex sights are optical or computing sights that reflect a reticle image (or images) onto a combining glass for superimposition on the target. The M68 sight is a reflex sight. It uses a red aiming reference (collimated dot) and is designed for the "two eyes open" method of sighting. The dot follows the horizontal and vertical movement of the gunner's eye while remaining fixed on the target. The sight is parallax free beyond 50 meters and thus the shooter can place the dot of a properly zeroed weapon on a target regardless of its positioning the sight tube and hit the target at distances of 50 meters and greater. However, when zeroing the weapon or engaging targets at distances of 50 meters or closer the dot must be precisely centered to ensure accurate zeroing of weapon or accurate fire on targets. Failure to precisely center the red dot in the tube while zeroing the weapon will either cause difficulty in achieving a zero or if the red dot is maintained in the same non-centered position the soldier will have a false zero on his or her weapon and will be unsuccessful when engaging targets be they on a range or on the battlefield.

Parallax is an apparent displacement or difference in the apparent position of an object viewed along two different lines of sight, and is measured by the angle or semi-angle of inclination between those two lines. In the M68 series scopes this is caused by the fact that there are multiple lenses in the scope. Because of this the soldier may be required to make a visual estimation of center when zeroing this scope. This estimation may be difficult to accurately repeat and may be the most common and serious problem encountered by soldiers when zeroing.

Boresight devices facilitate the alignment of a barrel of a firearm to a sighting device, or "boresighting" the firearm. Boresighting is typically used to provide efficient zeroing (or sighting in) of a firearm, which consists of aligning the point of impact of a bullet with a point of aim of a sighting device.

The trajectory of a bullet from a firearm may generally depend on a variety of factors such as, but not limited to, firearm type, bullet caliber, bullet speed, target distance, wind direction, and wind speed. Zeroing may typically include firing one or more rounds of ammunition at a target and aligning the sighting device to the point of impact. If the sighting device is far from alignment, multiple zeroing iterations may be required. However, this process may be time-consuming and waste costly ammunition.

Boresight devices may provide efficient zeroing by providing an initial alignment of the sighting device to the barrel. For example, a boresight device may typically be used to align the barrel to a sighting device for a target at a selected distance (e.g., 25 meters) at which a bullet trajectory may approximate a straight line from the barrel to the target. A user may then further refine the sighting alignment to zero the firearm at any distance to account for deviations of the bullet trajectory.

However, typical boresight devices may be cumbersome, inaccurate, difficult to align, and/or may suffer from limited battery life. It is therefore desirable to provide systems and methods for improved boresighting.

SUMMARY

A boresighting system is disclosed in accordance with one or more illustrative embodiments of the present disclosure. In one illustrative embodiment, the system includes a laser boresight device with a casing for loading into a chamber of a firearm in place of a bolt carrier group, where the casing is configured to accept a laser device for generating a laser beam within an interior cavity of the casing. In another illustrative embodiment, the casing includes at least one keyed feature to engage with boundaries of the chamber to align an exit port in the casing to a barrel of the firearm when the casing is loaded into the chamber such that the laser beam propagates through the exit port and along the barrel. In another illustrative embodiment, the system includes a parallax mitigation device with a housing for securing to at least one of a front or a rear portion of an optical sight on the firearm and a central position indicator connected to the housing providing a visual indication of a central position of the optical sight when viewed through the optical sight. The optical sight may include any type of optical sight including, but not limited to, a red dot sight or a magnified optical sight. In another illustrative embodiment, boresighting of the firearm may be provided by adjusting an eye position of a user to view a laser spot on a target associated with the laser beam from the laser boresight device at a selected boresighting distance at the central position of the optical sight based on the central position indicator and adjusting the optical sight to overlap an alignment reference provided by the optical sight with the laser spot at the central position of the optical sight.

In another illustrative embodiment, the system includes at least one of a laser visibility enhancing material, a shadowbox, or a spectral filter to enhance the visibility of the laser spot from the laser boresight device to a user.

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the disclosure may be better understood by those skilled in the art by reference to the accompanying figures in which.

DETAILED DESCRIPTION

Figure 1:
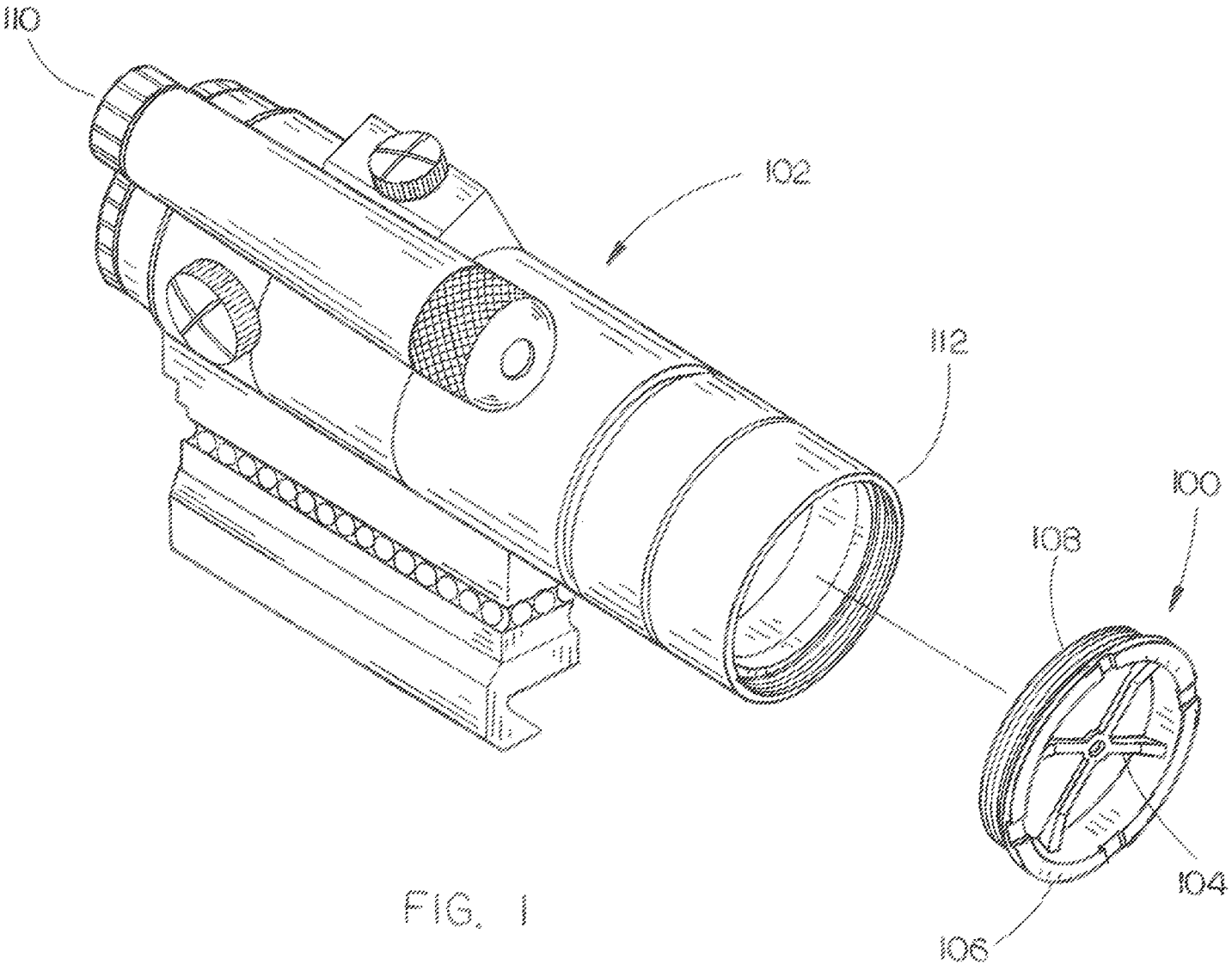
FIG. 1 is a perspective view of a parallax mitigation device and a red dot type scope.

Reference will now be made in detail to the subject matter disclosed, which is illustrated in the accompanying drawings. The present disclosure has been particularly shown and described with respect to certain embodiments and specific features thereof. The embodiments set forth herein are taken to be illustrative rather than limiting. It should be readily apparent to those of ordinary skill in the art that various changes and modifications in form and detail may be made without departing from the spirit and scope of the disclosure.

Parallax in gun sights may cause a shooter difficulty in achieving a good zero. This in effect causes an enormous amount of wasted training time and excessive expenditure of ammunition. The lack of a good zero also reduces the soldier's confidence in their weapon and their ability to use it effectively. This in turn can compromise the safety of the individual soldier as well as the safety of their fellow soldiers. Red dot reflex sights, such as the M68, may be effectively parallax-free outside of a certain distance (e.g., 50 meters), meaning that while the red dot moves around the inside of sight based on eye position, it always represents the point of aim. However, parallax may still occur if the target is at a distance of 50 meters or closer.

The method and system for parallax mitigation of the present disclosure may save up to one third of the time now spent by the soldier while zeroing and qualifying which frees this time up for other training. This also means saving up to one third the ammunition resulting in the possible saving of millions of dollars of ammunition. This reduction of ammunition also benefits the environment as less lead ends up being used and expended. Furthermore, another important benefit is an accurately zeroed weapon increasing soldier effectiveness and survivability on the battlefield.

It is recognized herein that the parallax mitigation device and/or the boresight device described herein may be utilized to facilitate zeroing or grouping procedures by any standard. For example, a successful grouping may correspond to placing 4 of 5 rounds in two consecutive 5-round shot groups within a 6 minute of angle (MOA) circle (threshold) or 4 MOA (objective) at 25-meters. By way of another example, a successful zeroing may correspond to placing 4 of 5 rounds in two consecutive shot groups within the 6 MOA circle (threshold) or 4 MOA (objective) surrounding the appropriate point of impact on an A8 zero target at 25-meters. A successful confirmation at a distance may correspond to, but is not required to correspond to, hitting a properly presented E-type target with a minimum of 4 of 5 (80-percent) shots after completion of the 25 meter zero. Application of hold-offs may correspond to, but are not required to correspond to, successfully hitting a properly presented 100-meter E-type target with a minimum of 4 of 5 (80-percent) shots and then successfully hitting a properly presented 200-meter E-type target with a minimum of 4 of 5 (80-percent) shots.

Several kinds of problems may arise during the grouping exercise. First, the soldier may not be able to maintain precise placement of the red dot for multiple shots in a row. The result of this is one of the largest contributing factors towards the soldier's inability to meet established grouping standards. The second error would be that the soldier may be able to visually place the red dot in the same place in relation to the center of the sight tube, but not in the same spot for consecutive shot groups. This may result in acceptable three shot groups but the locations of these shot groups are scattered on the target and again the standards are not met. Furthermore, a third error may occur occasionally. This is when the soldier is able to maintain the dot in the same position consistently for multiple shot groups. This soldier is unfortunate as they will be able to zero their weapon quickly. The reason that this is unfortunate is that the zero achieved is a false zero. It simply shows consistent inconsistency and when the soldier moves to a qualification range or the battlefield they will not be successful. While failure on the range can be corrected, it may destroy the soldiers' confidence in their equipment. Failure on the battlefield is another thing entirely and can result in an easily preventable loss of life.

The errors previously described are common as many soldiers are only firing for qualification on an annual basis and the amount of ammunition in many instances is limited. No matter the reason, the result is an inordinate amount of time, ammunition and frustration spent on what should be a simple task. The solution is the parallax mitigation/elimination device of the present disclosure. While the intent of the parallax mitigation device of the present disclosure is to alleviate the problems experienced by individuals attempting to zero and qualify with the aim point designed and produced for the M68 series of scopes, it is understood that the M68 series of scopes are merely exemplary, and that the parallax mitigation device of the present disclosure is applicable to any red dot type scope of similar designs.

Referring generally to FIGS. 1 through 7, a parallax mitigation device 100 for a reflex type gun sight/scope 102 (e.g., a red dot sight such as the M68) is shown. The scope 102 includes a front portion 112 for receiving light and a rear portion 110 for providing a visual of a target to the shooter. The parallax mitigation device 100 provides a reticle 104 (e.g., crosshairs) to enable the shooter to get consistent, precise placement of the red dot in the exact center of the visual on every shot. In one embodiment, the reticle 104 is enclosed in a generally cylindrical housing 106. The generally cylindrical housing 106 may have a threaded portion 108 for mounting to the front portion 112 of the scope 102. It is contemplated that other fastening mechanisms such as snap fit mechanisms, friction fit mechanisms, or the like may be utilized for securing the parallax mitigation device 100 to the scope 102. However, it is to be understood that the parallax mitigation device 100 may generally have any shape suitable for operation with an optical sight. In some embodiments, the housing 106 of the parallax mitigation device 100 may have substantially the same shape as a portion of the optical sight 102 to which it is mounted which may be, but is not required to be, circular or cylindrical. In some embodiments, the housing 106 of the parallax mitigation device 100 may have a substantially different shape as the portion of the optical sight 102 to which it is mounted.

Figure 2:
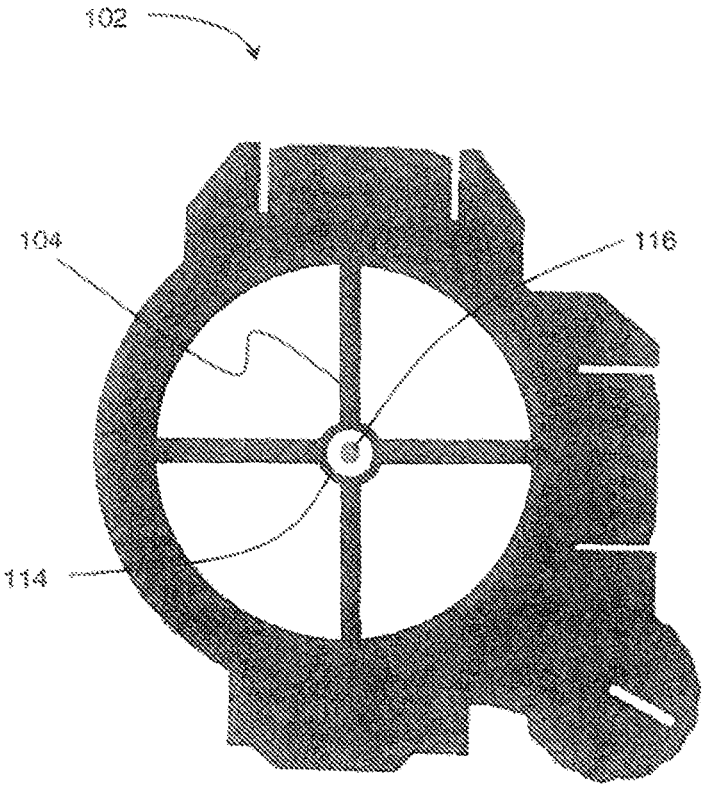
FIG. 2 is an illustration depicting the shooter's view through the red dot type scope with the parallax mitigation device installed.
Figure 3:
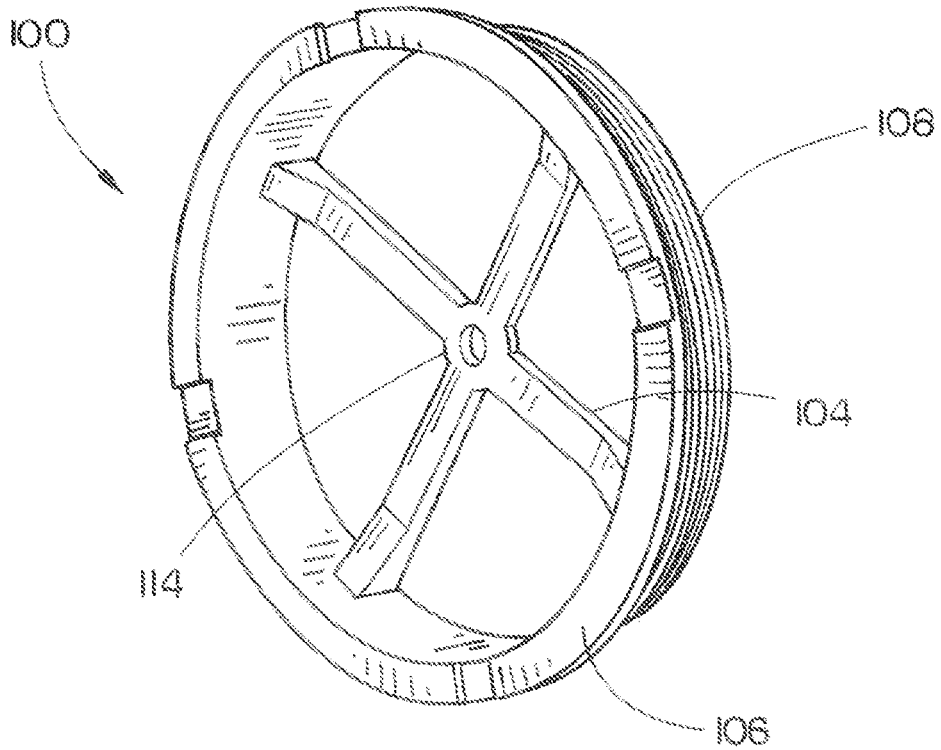
FIG. 3 is an isometric view of the parallax mitigation device illustrated in FIG. 1.
Figure 4:
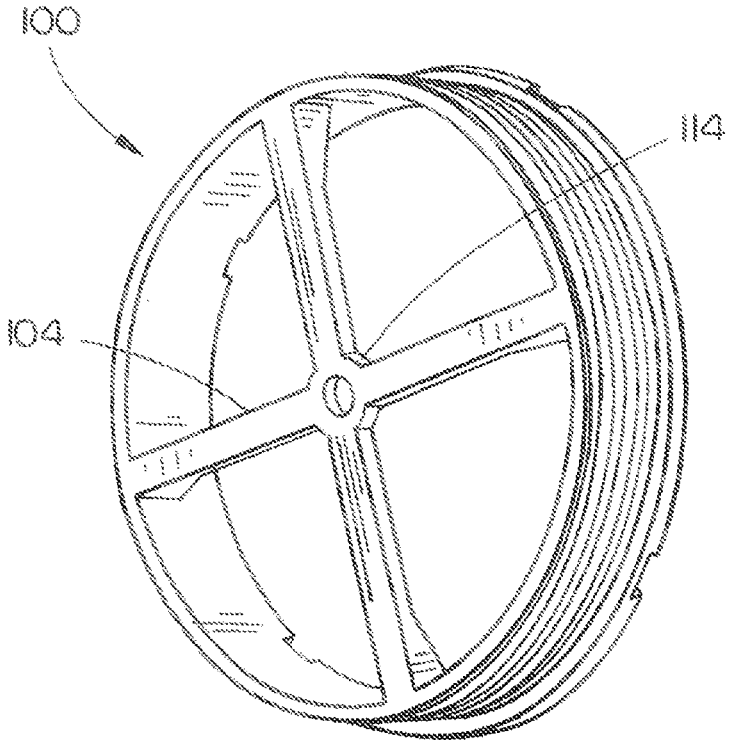
FIG. 4 is another isometric view of the parallax mitigation device illustrated in FIG. 1.
Figure 5:
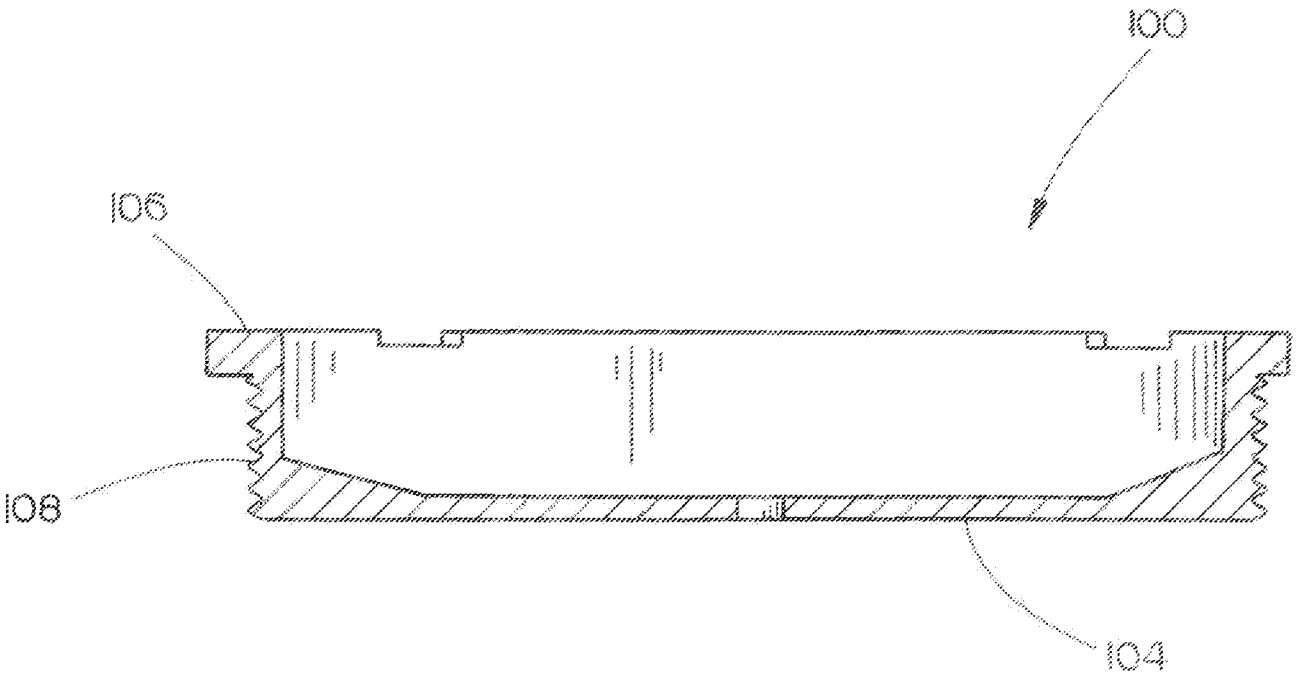
FIG. 5 is a cross-sectional view of the parallax mitigation device illustrated in FIG. 1.

FIG. 2 is an illustration depicting the shooter's view through the scope 102 with the parallax mitigation device 100 installed. In one embodiment, the reticle 104 is defined utilizing four equal length bars, each having one end secured to the cylindrical housing of the parallax mitigation device 100 at the 12, 3, 6 and 9 o'clock positions (with respect to the orientation shown in FIG. 2). The other end of each of the four bars extends from the cylindrical housing towards the center and terminates at a point leaving a gap of approximately a few millimeters apart from each other. A connecting member 114 connects the bars around the center and defines a hole (circular or other shapes) at the center. The hole in turn indicates the center position at which the shooter should place the red dot 116 provided by the scope 102. In this manner, the parallax mitigation device 100 of the present disclosure may eliminate the error caused by the parallax of the sight and give the shooter an accurate and consistent zero every time. In one embodiment, the radius of the hole defined by the connecting member 114 may be approximately one to two millimeters.

Figure 6:
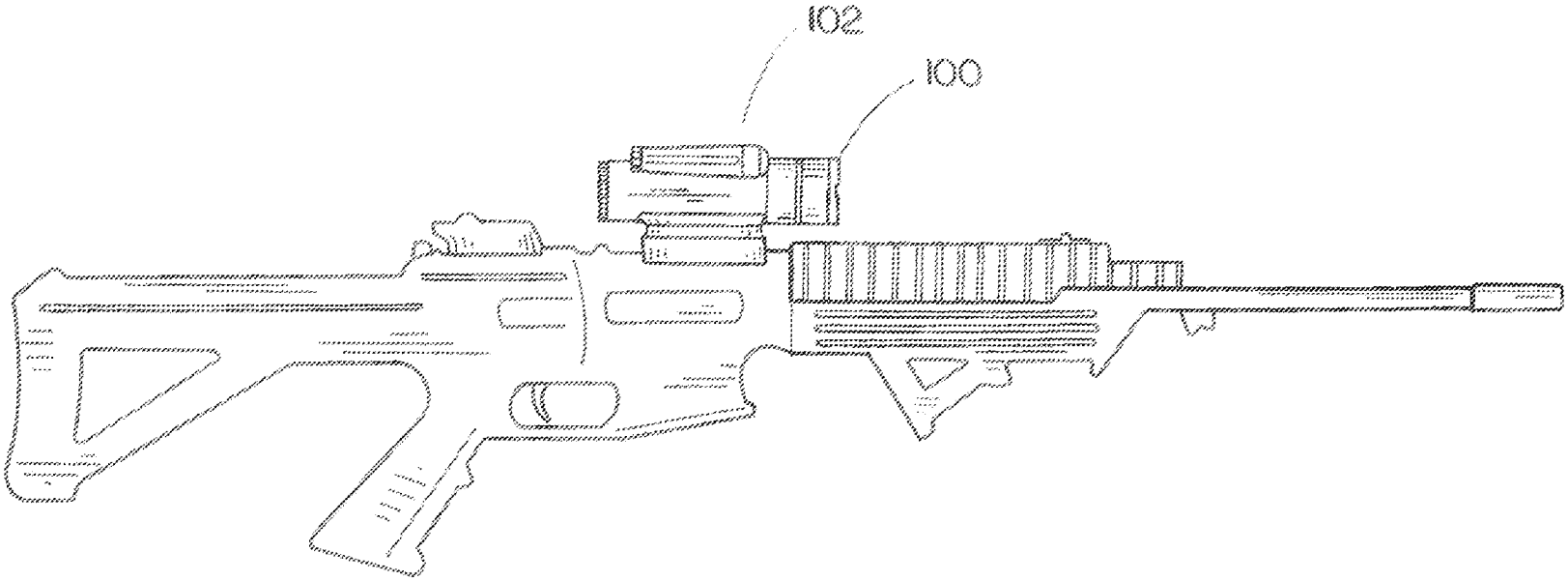
FIG. 6 is a side view of the parallax mitigation device and the red dot type scope, wherein the parallax mitigation device is mounted to the front portion of the red dot type scope.
Figure 7:
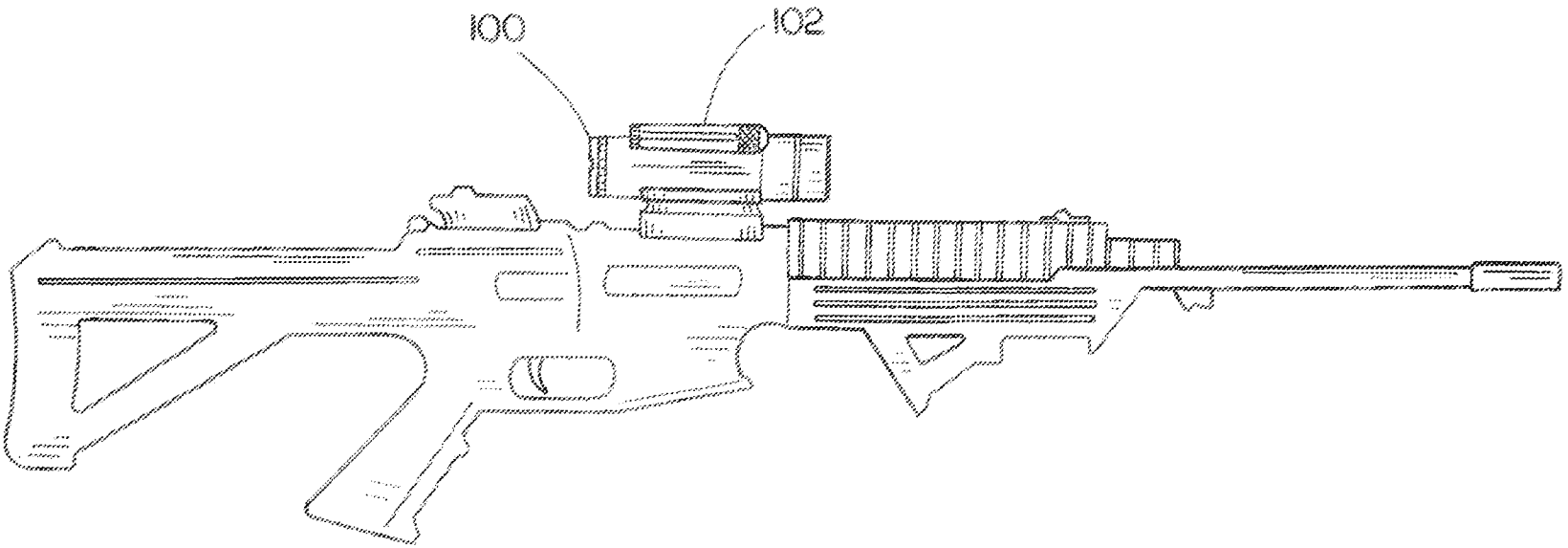
FIG. 7 is another side view of the parallax mitigation device and the red dot type scope, wherein the parallax mitigation device is mounted to the rear portion of the red dot type scope.

It is contemplated that the parallax mitigation device 100 may be positioned at the front of the scope 102 in various ways. The type of attachment could be of a slip on, flip up or any number of other methods to include those of an internal or illuminated design. For example, as illustrated in FIGS. 1 and 6, the front portion of the scope 102 may include a slot to accommodate an insertion of the parallax mitigation device 100. The design of the crosshairs could be of different configurations or colors as well as long as the purpose is to assist the shooter in exact centering of the red dot within the tube of the scope 102. It is also contemplated that the parallax mitigation device 100 may be positioned at the rear of the scope 102 to achieve the same results, as illustrated in FIG. 7. In general, the parallax mitigation device 100 may be placed in the optical path of the reflex scope (e.g., front, rear or within the scope) as long as it provides a reference to the shooter and thus helps the shooter to place the red dot in the center.

Figure 8:
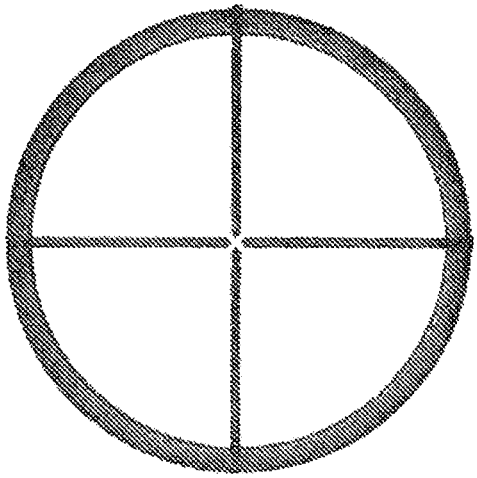
FIG. 8 is a top view of a parallax mitigation device having a standard crosshairs/reticle configuration.
Figure 9:
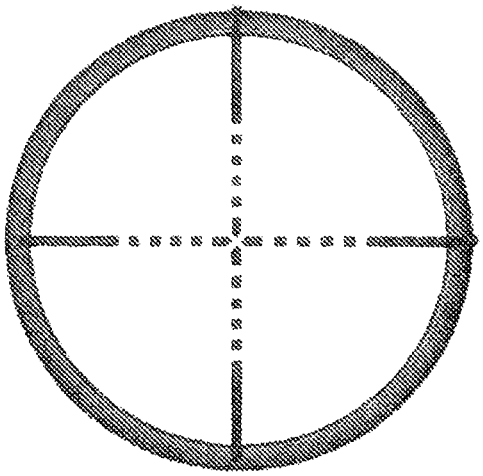
FIG. 9 is a top view of a parallax mitigation device having an offset crosshairs/reticle configuration.

It is also contemplated that the parallax mitigation device 100 may indicate the center position in a variety of ways. For instance, instead of utilizing the connecting member 114 supported by the bars to indicate the center position, other types of support members may be utilized without departing from the spirit and scope of the present disclosure. For example, a transparent/translucent support surface (e.g., glass) may be enclosed in the cylindrical housing 106. The support surface may have embedded and/or marked position indicators as shown in FIG. 8. Furthermore, an offset crosshairs/reticle as shown in FIG. 9 may also be utilized. Such crosshairs may be utilized to get consistent dot placement for off center testing/shooting purposes. Offset crosshairs may also be utilized to demonstrate the effects of incorrect placement as well as to validate the effectiveness of the parallax mitigation device 100. However, the reticle 104 as depicted in FIGS. 1 through 5 may be appreciated as this particular implementation does not introduce reflections and/or glares. Furthermore, the parallax mitigation device 100 utilizing the reticle 104 as depicted in FIGS. 1 through 5 may be modeled as a single-piece device, which may be easier to manufacture and maintain.

Figure 10:
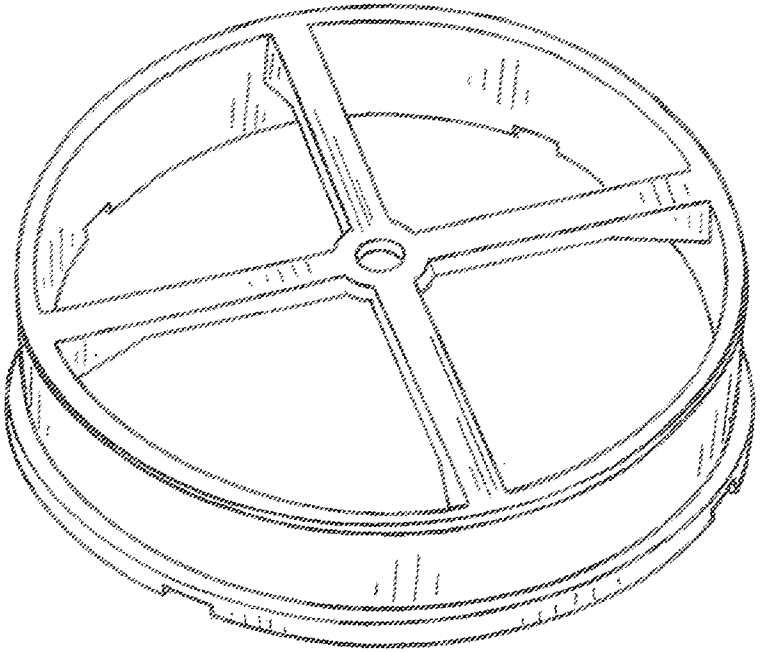
FIG. 10 is an isometric view of a parallax mitigation device utilizing friction fit mechanisms.

While the example above describes a threaded portion 108 for mounting the parallax mitigation device 100 to the scope 102, it is contemplated that other fastening mechanisms may be utilized for securing the parallax mitigation device 100 to the scope 102. For instance, the parallax mitigation device 100 as shown in FIG. 10 may utilize friction fit mechanisms to engage with the scope 102. Other mechanisms such as snap fit mechanisms or the like may be utilized without departing from the spirit and scope of the present disclosure.

Figure 11:
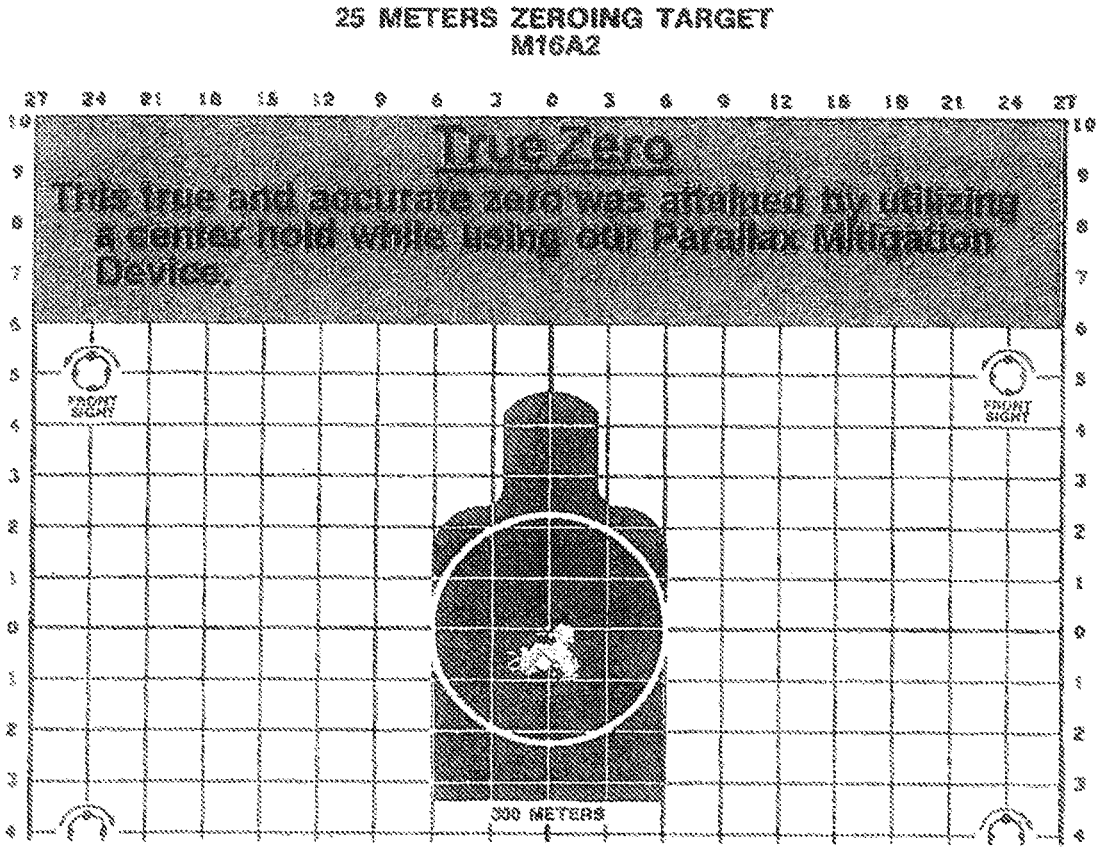
FIG. 11 is an illustration depicting a set of test results having true and accurate zero.
Figure 12:
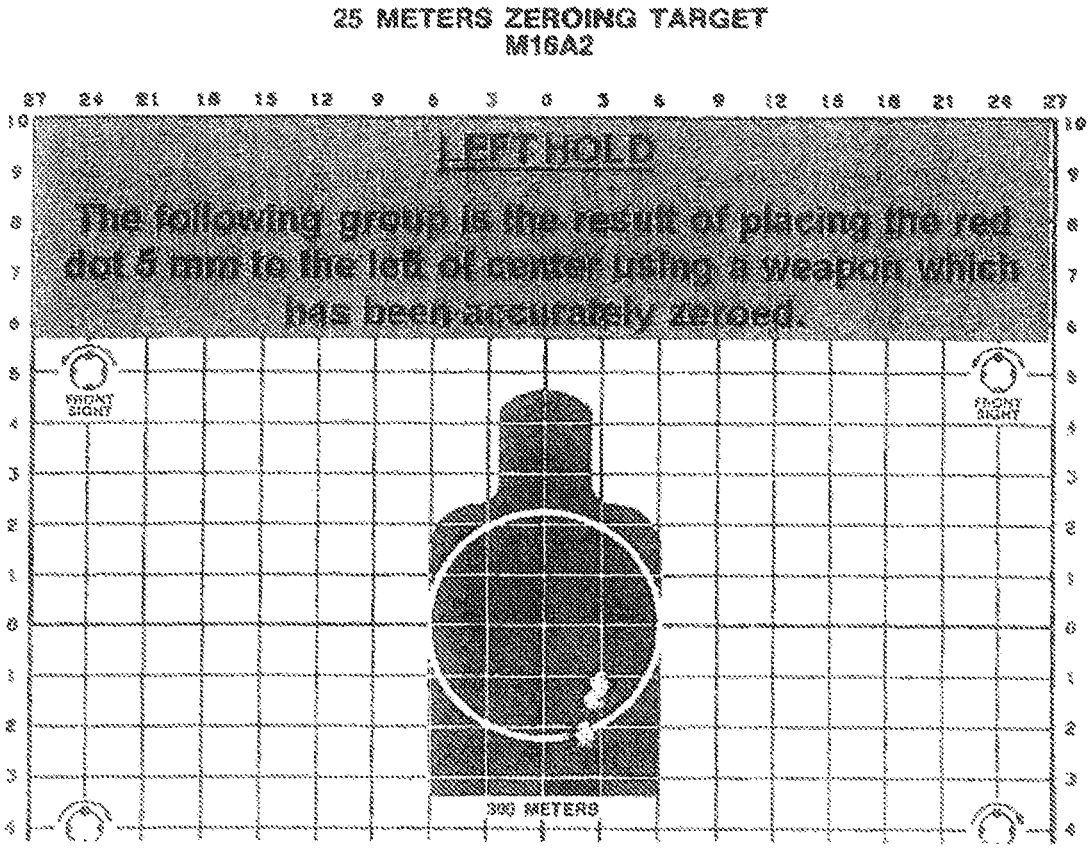
FIG. 12 is an illustration depicting a set of left hold test results.
Figure 13:
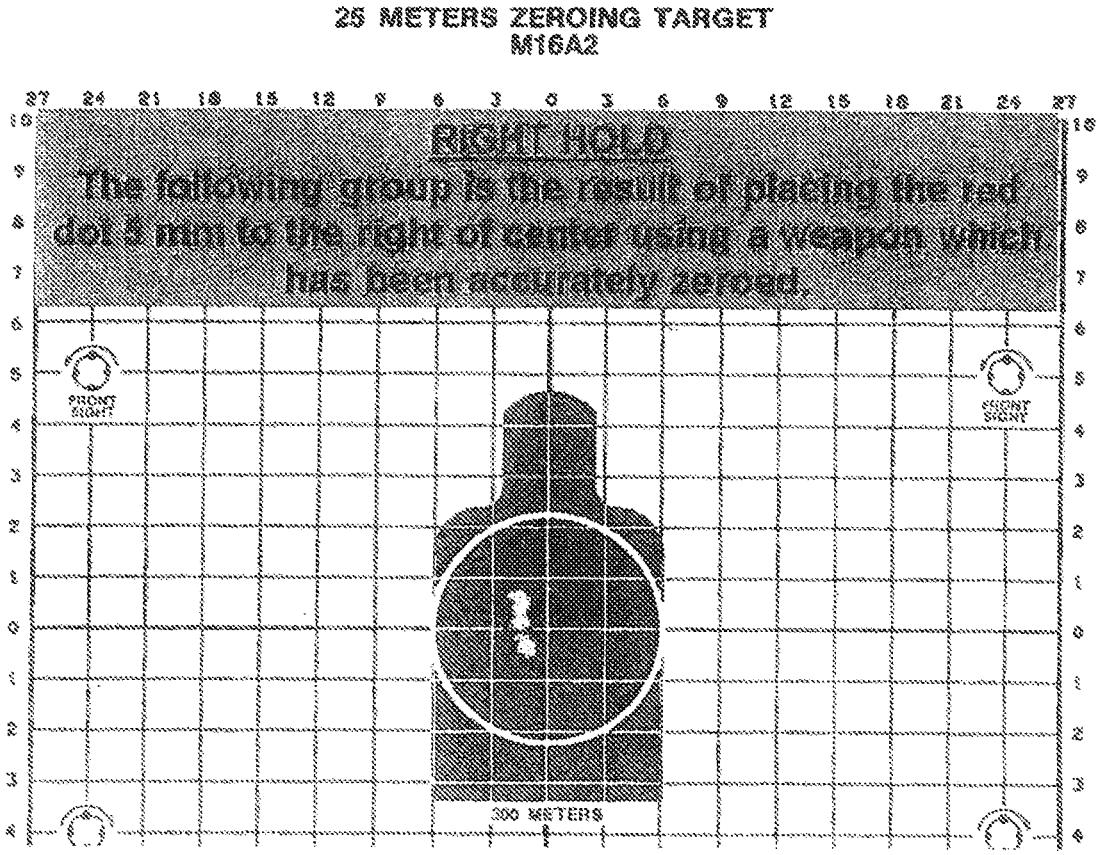
FIG. 13 is an illustration depicting a set of right hold test results.
Figure 14:
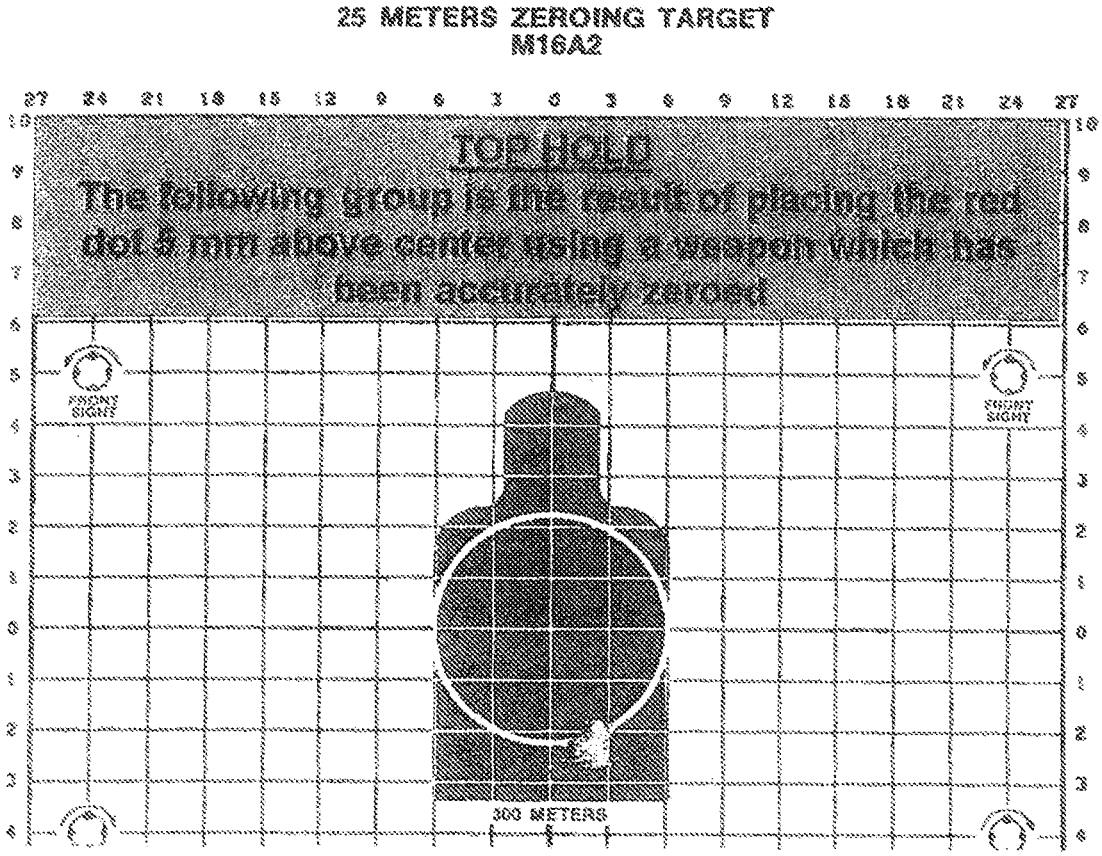
FIG. 14 is an illustration depicting a set of top hold test results.
Figure 15:
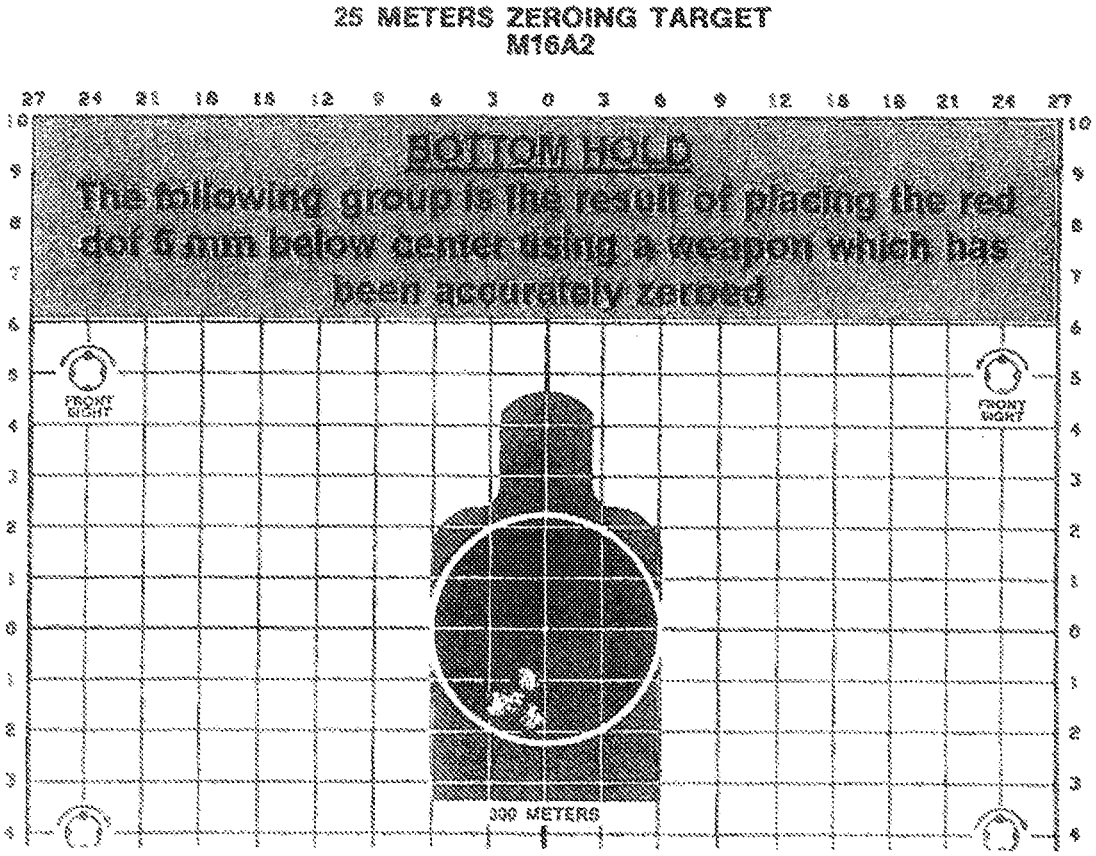
FIG. 15 is an illustration depicting a set of bottom hold test results.

Referring generally to FIGS. 11 through 17, a series of test results are illustrated. FIG. 11 illustrates a set of test results having true and accurate zero. This set was attained by utilizing a center hold while using the parallax mitigation device 100. FIG. 12 illustrates a set of left hold test results. This set was attained as a result of placing the red dot 5 mm to the left of center using a weapon which has been accurately zeroed. FIG. 13 illustrates a set of right hold test results. This set was attained as a result of placing the red dot 5 mm to the right of center using a weapon which has been accurately zeroed. FIG. 14 illustrates a set of top hold test results. This set was attained as a result of placing the red dot 5 mm above center using a weapon which has been accurately zeroed. FIG. 15 illustrates a set of bottom hold test results. This set was attained as a result of placing the red dot 5 mm below center using a weapon which has been accurately zeroed.

Figure 16:
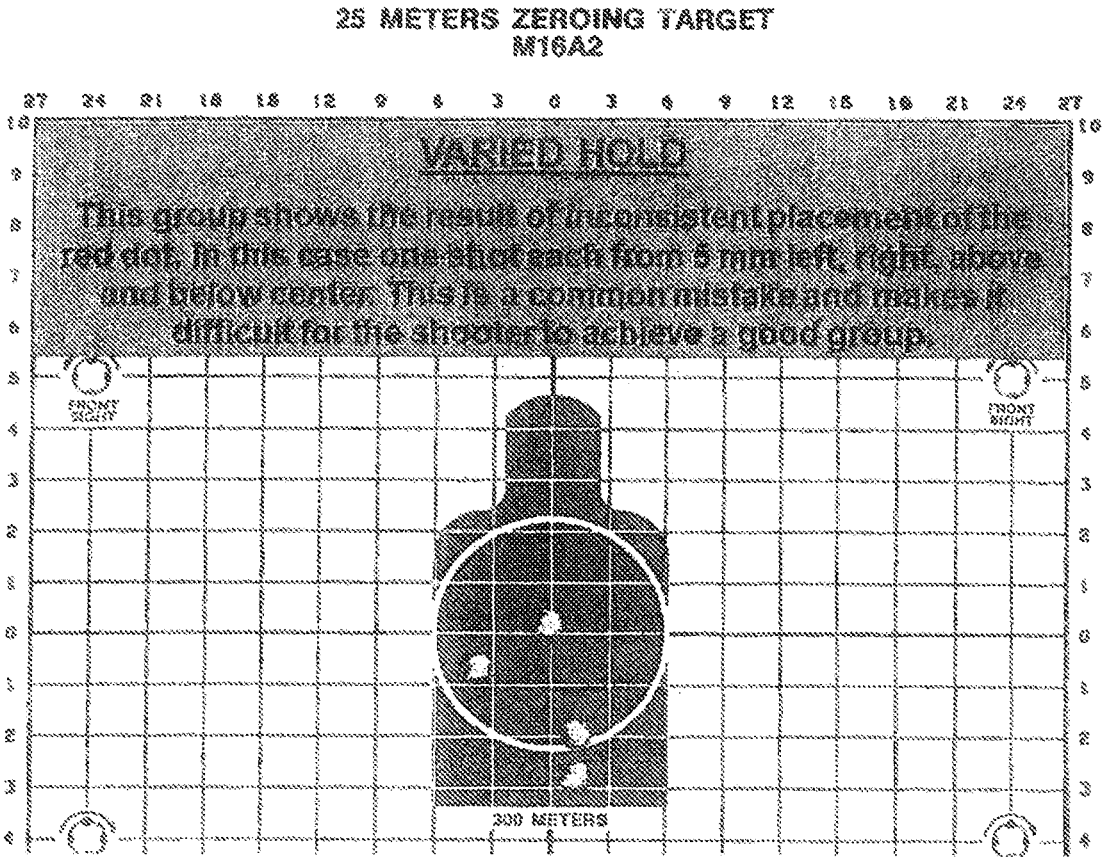
FIG. 16 is an illustration depicting a set of varied hold test results.
Figure 17:
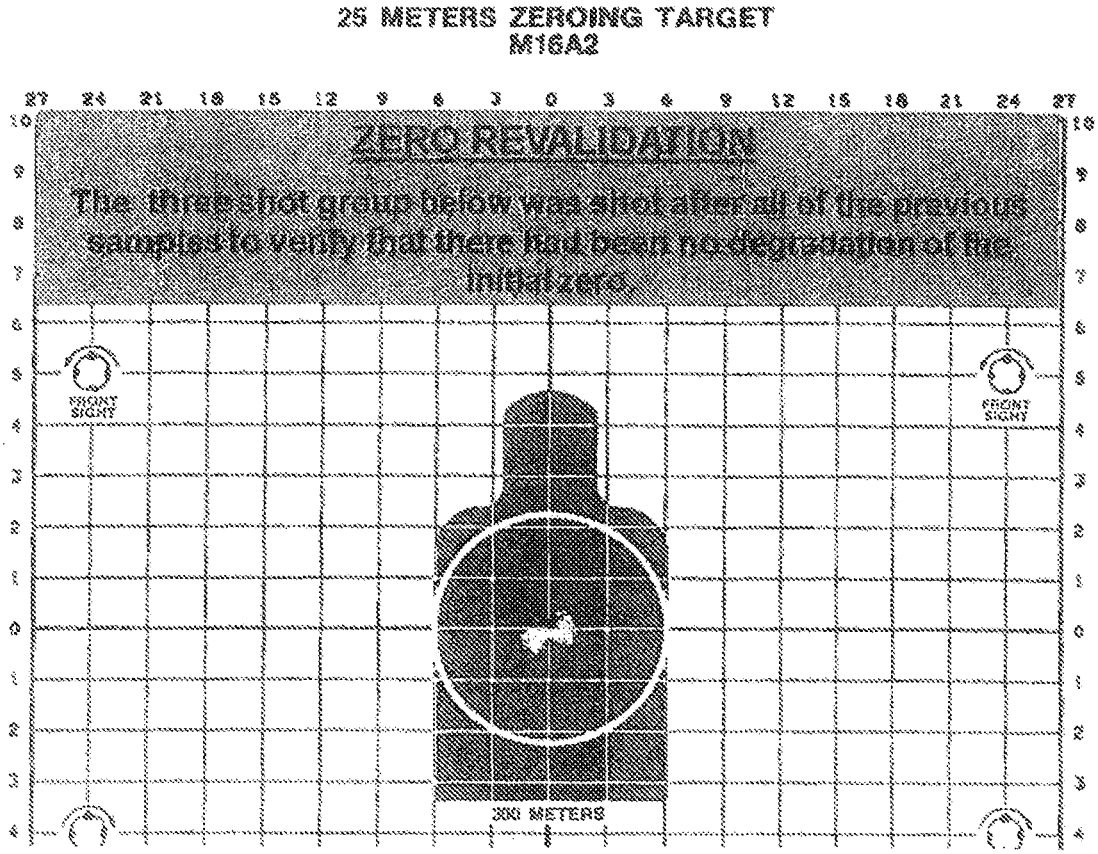
FIG. 17 is an illustration depicting a set of test results having true and accurate zero upon completion of the accuracy test.

Furthermore, FIG. 16 illustrates a set of varied hold test results. This set shows the result of inconsistent placement of the red dot. In this case one shot each from 5 mm left, right, above and below center. This is a common mistake and makes it difficult for the shooter to achieve a good group. To complete the verification of the accuracy, three shot groups was shot after all of the previous samples (FIGS. 11 through 16) to verify that there had been no degradation of the initial zero. The result of this last set is shown in FIG. 17.

As stated above, the parallax mitigation device in accordance with the present disclosure may be placed anywhere in the optical path of the reflex scope as long as it provides a reference to the shooter and thus helps the shooter to place the red dot in the center. It is contemplated that the placement of the parallax mitigation device in accordance with the present disclosure is not limited to the front or the rear end of the scope. That is, the parallax mitigation device may be placed within the scope and configured to be selectively engageable by the user.

It is also contemplated that the parallax mitigation device may be configured to indicate the center position in a variety of ways. For instance, in addition to utilizing a connecting member supported by bars and/or markings provided on one or more transparent/translucent support surfaces to indicate the center position, electronic displays, optical projection techniques and/or other mechanically engaged devices may also be utilized to indicate such center positions.

Figure 18:
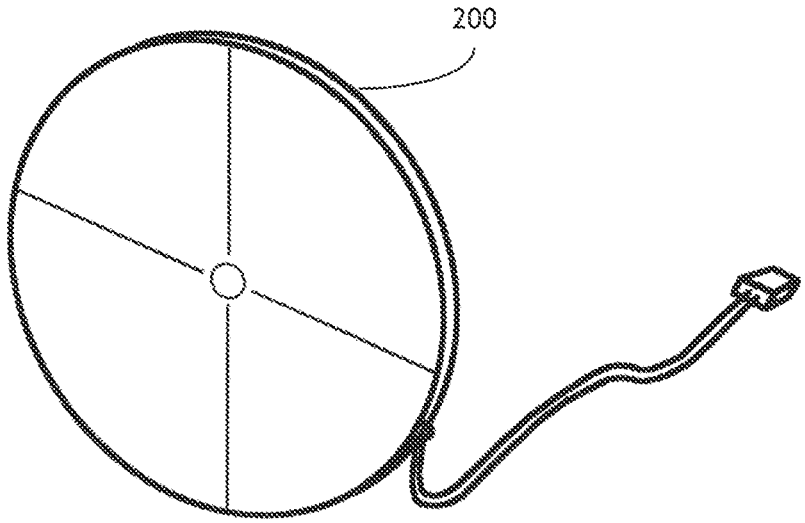
FIG. 18 is an isometric view depicting a parallax mitigation device when engaged.
Figure 22:
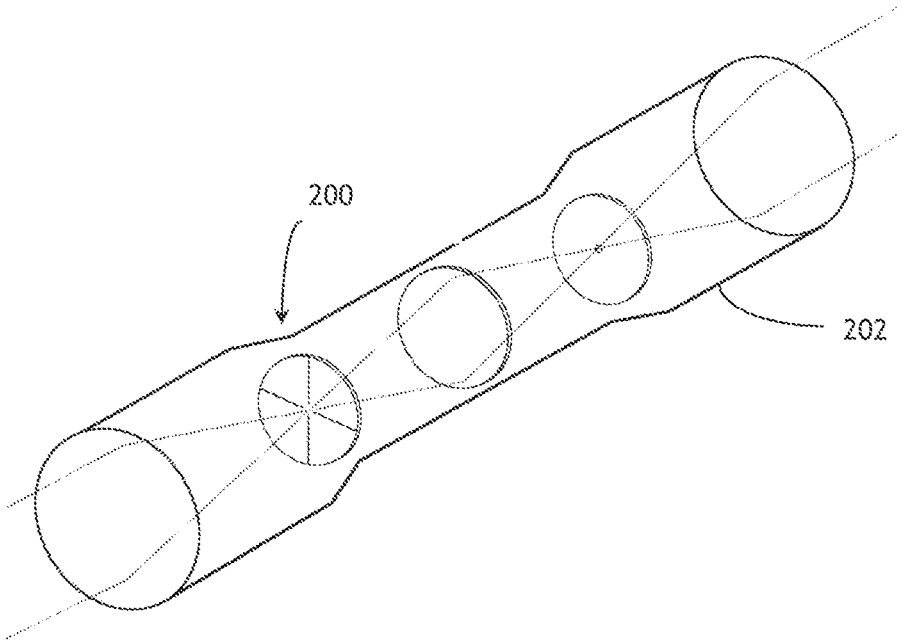
FIG. 22 is an isometric illustration depicting a parallax mitigation device installed within a sight.

For instance, as shown in FIGS. 18 and 22, a parallax mitigation device 200 in accordance with certain embodiments of the present disclosure is configured as an integrated component of the scope 202. While the parallax mitigation device 200 is shown to be positioned between the front and the rear end of the scope 202, it is understood that the parallax mitigation device 200 may also be positioned at the front or the rear end of the scope 202 without departing from the spirit and scope of the present disclosure.

Figure 19:
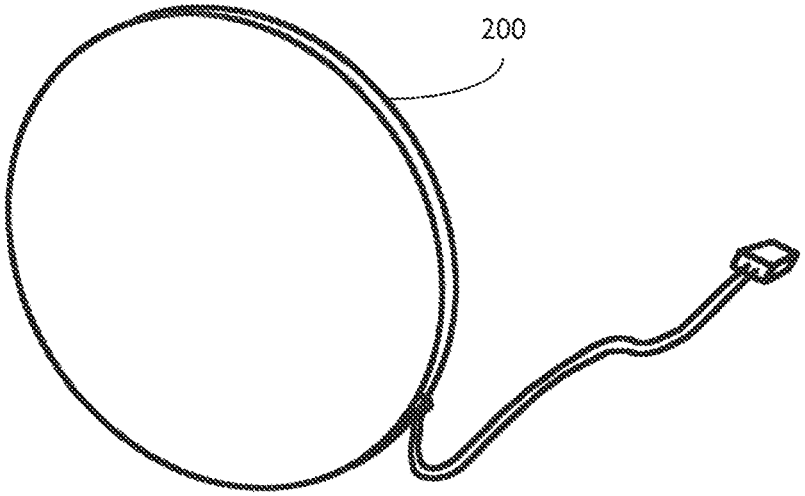
FIG. 19 is an isometric view depicting the parallax mitigation device when disengaged.
Figure 20:
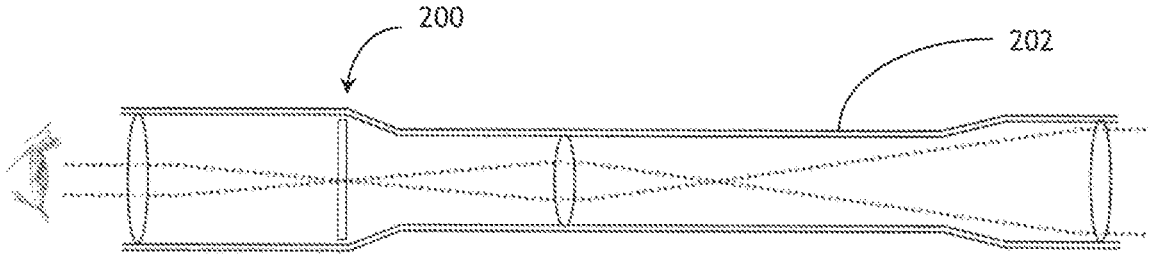
FIG. 20 is a cross-sectional view depicting a parallax mitigation device installed within a sight.

The parallax mitigation device 200 may include a transparent display in one embodiment. The transparent display may be configured as a see-through liquid-crystal display (LCD) or any optical/display device that provides a projected image when engaged without blocking the field of view through the scope 202. This allows the user of the scope 202 to selectively engage or disengage the parallax mitigation device 200. In this manner, when the parallax mitigation device 200 is engaged (as shown in FIG. 18), the center position indicator(s) are made visible to the user to help mitigate parallax. On the other hand, when the parallax mitigation device 200 is disengaged (as shown in FIG. 19), the center position indicator(s) are made substantially invisible to the user and do not cause substantial optical interference to the user.

It is contemplated that display devices such as liquid-crystal displays or the like may be utilized without departing from the spirit and scope of the present disclosure. In such implementations, the parallax mitigation device 200 may be electronically connected to a power source of the scope 202 via a power cord.

Figure 21:
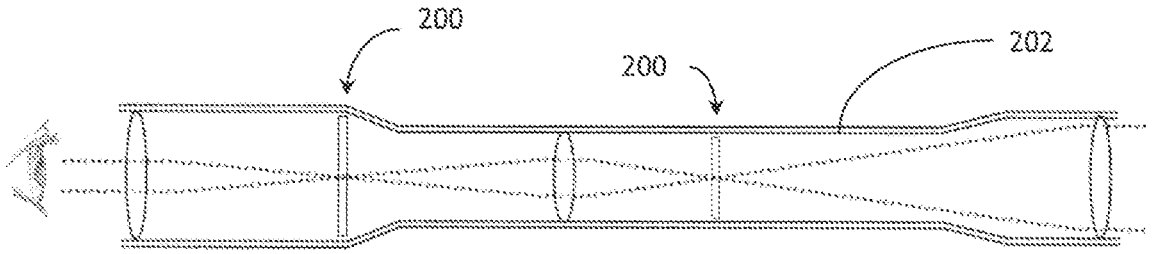
FIG. 21 is a cross-sectional view depicting more than one parallax mitigation device installed within a sight.

It is also contemplated that more than one of such parallax mitigation devices 200 may be utilized in a scope 202 for increased accuracy, as shown in FIG. 21. Alternatively, multiple parallax mitigation devices 200 may be utilized as multiple focal planes. For instance, one half of the center position indicator may be positioned on one device and the other half of the center position indicator may be positioned on the other device. In such a configuration, when the two halves are aligned, a complete image indicates no parallax.

Figure 23:
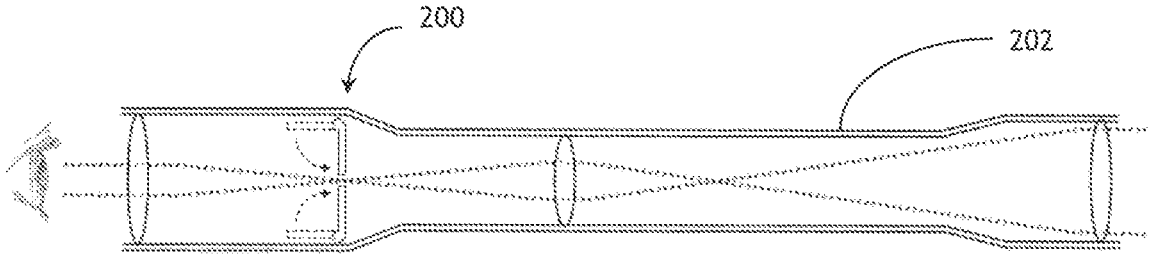
FIG. 23 is a cross-sectional view depicting an alternative parallax mitigation device installed within a sight.
Figure 24:
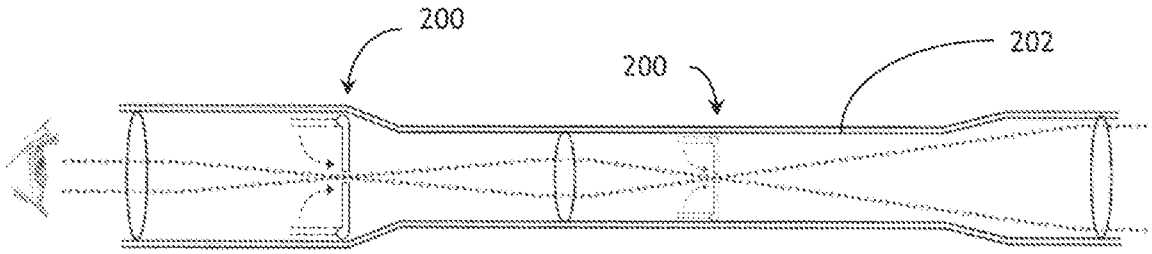
FIG. 24 is a cross-sectional view depicting more than one alternative parallax mitigation device installed within a sight.

Furthermore, alternative to the transparent display implementation, the parallax mitigation device 200 may also be engaged/disengaged mechanically. For instance, as depicted in FIGS. 23 and 24, the parallax mitigation device 200 may be mechanically rotated, slid or otherwise positioned into the optical path of the scope 202 when engaged for parallax mitigation. When the user needs to disengage the parallax mitigation device 200, it can then be mechanically rotated, slid or otherwise positioned outside of the optical path of the scope 202.

Figure 25:
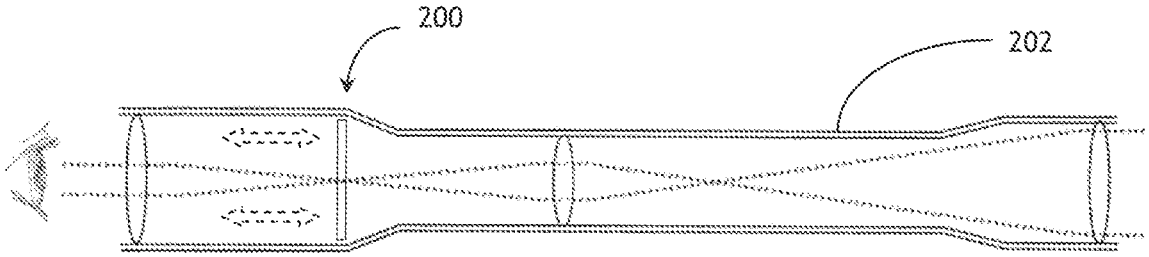
FIG. 25 is a cross-sectional view depicting another alternative parallax mitigation device installed within a sight.
Figure 26:
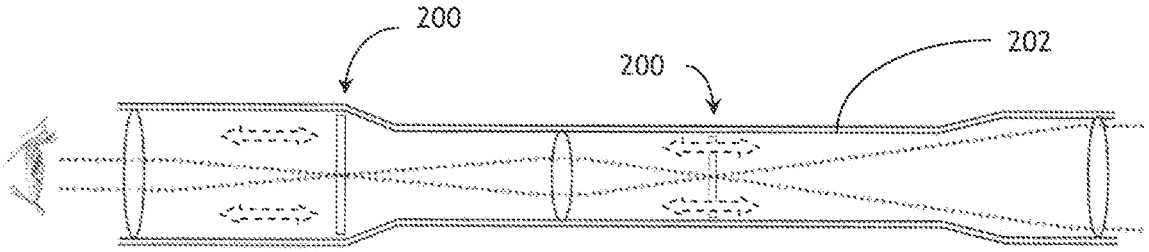
FIG. 26 is a cross-sectional view depicting more than one of the other alternative parallax mitigation device installed within a sight.

In another example, as depicted in FIGS. 25 and 26, the parallax mitigation device 200 may be mechanically shifted in or out of focus in order to be engaged or disengaged for parallax mitigation. That is, by shifting the parallax mitigation device 200 closer to or farther away from the user, the parallax mitigation device 200 may appear to be in or out of focus to the user. When the parallax mitigation device 200 appears to be in focus, the center position indicators on the parallax mitigation device 200 also appear to be in focus and sharp, allowing the user to use the center position indicators for parallax mitigation purposes. On the other hand, the more out of focus the parallax mitigation device 200 appears, the more blurred the center position indicators on the parallax mitigation device 200 appear to be, to the point where the center position indicators become substantially invisible to the user and do not cause substantial optical interference to the user.

In addition to the exemplary embodiments described above, it is contemplated that the parallax mitigation device may be mechanically engaged/disengaged in various other manners without departing from the spirit and scope of the present disclosure.

It is also understood that while crosshairs are utilized in the examples above to indicate the center positions, center position indicators may be configured in various other ways also without departing from the spirit and scope of the present disclosure.

Figure 27:
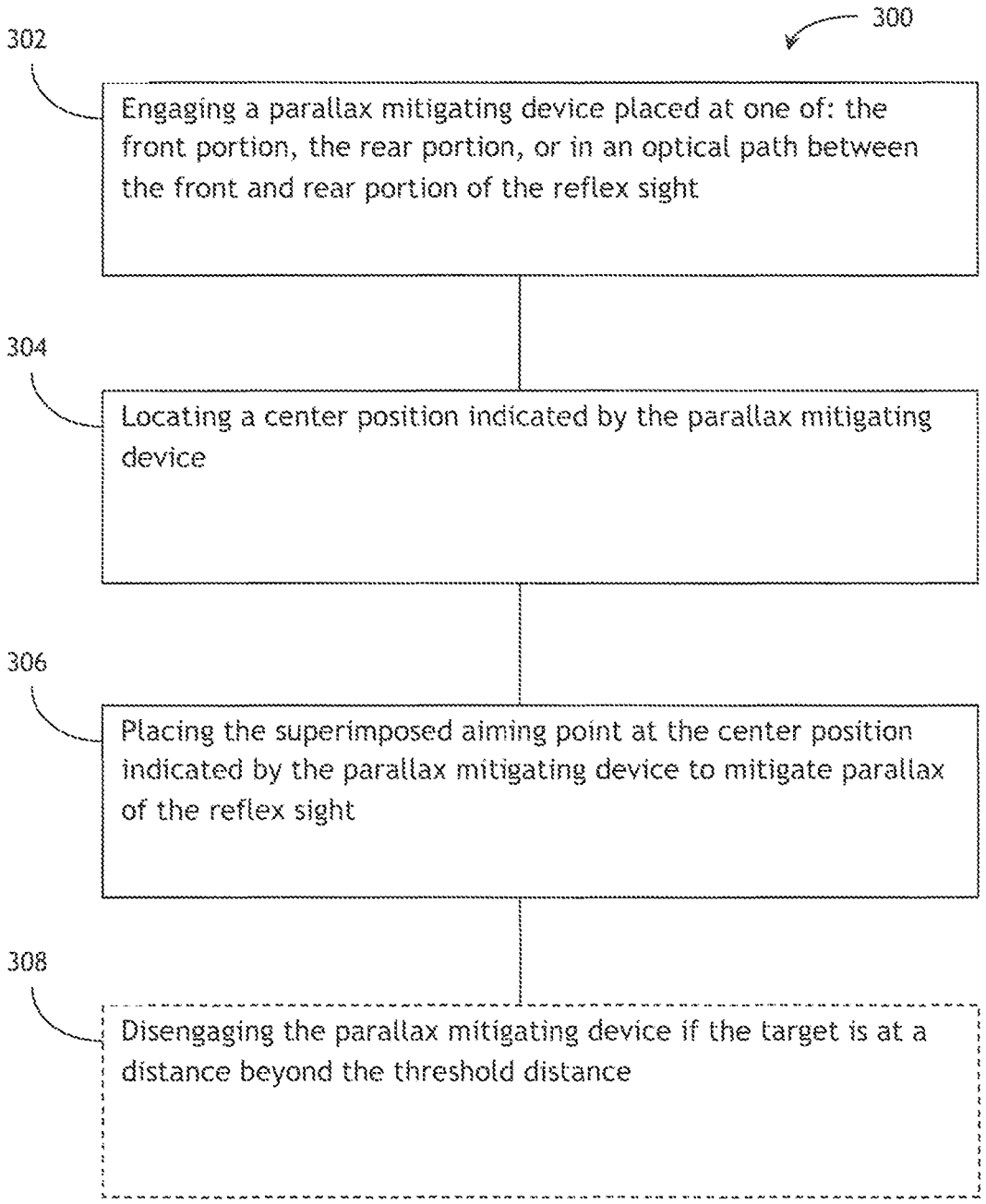
FIG. 27 is a flow diagram illustrating a method for mitigating parallax in a reflex sight.

Referring to FIG. 27, a flow diagram depicting a method 300 for mitigating parallax in a reflex sight is shown. A user may engage a parallax mitigating device in step 302. As described above, the parallax mitigating device may be located at one of: the front portion, the rear portion, or anywhere in the optical path between the front and rear portion of the reflex sight. In addition, the parallax mitigating device may be engaged electronically, optically or mechanically, as previously described. The user may locate the center position indicated by the parallax mitigating device in step 304, and place the aiming point at the center position indicated by the parallax mitigating device to mitigate parallax of the reflex sight in step 306.

It is contemplated that a reflex sight may be effectively parallax-free outside of a certain threshold distance (e.g., 50 meters), meaning that while the red dot moves around the inside of sight based on eye position, it always represents the point of aim. Therefore, the parallax mitigating device may be disengaged in step 308 if the target is at a distance beyond the threshold distance. In one embodiment, the parallax mitigating device only needs to be engaged if the target is at the threshold distance or closer.

While the examples above referenced reflex type optics, it is contemplated that the apparatus and methods in accordance with the present disclosure are not restricted to this use. The parallax mitigation device and method in accordance with the present disclosure may generally be used with any type of optical sight including, but not limited to, red dot sights, reflex sights, or magnified optical sights (e.g., magnified optics).

Magnified optical sights such as, but not limited to, an advanced combat optical gunsite (ACOG) may provide an alternative to reflex-type sights (e.g., red dot sights) as described above. In a magnified optic, parallax manifests itself when the lenses are not properly aligned with respect to an eye of a user. This is normally accounted for by the user maintaining precise eye relief. Proper eye relief is verified by the appearance of scope shadow which is observed as a dark ring within the view through the optic. The shooter must adjust their eye relief by moving their eye either closer to or further from the optic lens of the optic till the scope shadow just meets the outside edge of the visible field. However, the shooter must be careful to not move too close to the optic as well or the issue of parallax may return.

Referring now to FIGS. 28-30, a parallax mitigation device 100 configured for use with magnified optics (e.g., a magnified optical sight or an optical sight having a magnification other than 1) is described in greater detail. It is contemplated herein that a parallax mitigation device 100 may be suitable for use, integration with, or coupling with any type or design of magnified optical sight known in the art. However, various aspects or components of the parallax mitigation device 100 and/or the placement of the parallax mitigation device 100 may be tailored for mitigating parallax associated with a magnified optical sight. As a result, a particular design of a parallax mitigation device 100 suitable for one type of optical sight may not necessarily be suitable for use on a different type of optical sight.

For example, whereas a red dot or a reflex optical sight may include a projected dot as an alignment reference, a magnified optical sight may include a two-dimensional reticle pattern superimposed on an image through the magnified optical sight. For example, the reticle pattern may be placed at a suitable plane of the magnified optical sight such that the reticle pattern is simultaneously in focus with objects imaged by the magnified optical sight. For the purposes of the present disclosure, such a plane is referred to as a reticle plane. In some cases, one or more components of the magnified optical sight may be adjusted to provide for focusing of the reticle pattern.

In some embodiments, a user may mitigate parallax of a magnified optic by mounting a parallax mitigation device 100 within a line of sight of the magnified optic and adjusting a head and/or eye position to position the reticle pattern of the magnified optic at a center position of the parallax mitigation device 100.

A parallax mitigation device 100 may generally be mounted in any location with respect to a magnified optic such as, but not limited to, a front or rear portion of the magnified optic. It is contemplated herein that it may not be possible to mount the parallax mitigation device in a reticle plane such that it is sharply in focus along with the reticle pattern and objects viewed through the magnified optic. However, it is further contemplated herein that placement of the parallax mitigation device 100 at a reticle plane is not necessary. Rather, the parallax mitigation device 100 may be placed at an out of focus plane. In this configuration, the various components of the parallax mitigation device 100 in the line of sight of the magnified optic (e.g., the bars and/or the connecting member 114 of the reticle 104) may become slightly out of focus or blurry, but may generally retain the same shape and positions within a field of view. In this regard, the parallax mitigation device 100 is looked through rather than looked at. Accordingly, in the case that a central position indicator of the parallax mitigation device 100 is formed as a central aperture, this central aperture may appear as a halo (e.g., a fuzzy halo, a ghost ring, or the like). Because the fuzzy halo retains the same general shape and central position within the field of view, the parallax mitigation device 100 may still provide a convenient visual reference for alignment. In this configuration, the user may adjust a head and/or eye position to position the reticle pattern (or a desired portion thereof) of the magnified optic at a center position of the parallax mitigation device 100.

In some embodiments, the parallax mitigation device 100 is placed at a convenient location with respect to the magnified optic such as, but not limited to, a front or a rear end of the magnified optic. For example, a parallax mitigation device 100 placed at a front or rear portion of the magnified optic may be convenient and effective. Further, the parallax mitigation device 100 may remain on the magnified optic at all times to provide parallax mitigation in any shooting environment. In some embodiments, the parallax mitigation device 100 is integrated into an endcap to be placed over a portion of an ocular end of the magnified optic near the eye of the user. In this regard, the parallax mitigation device 100 may be easily added or removed. Further, the cap may remain on the optic for any firing operation as described herein. In some embodiments, the parallax mitigation device 100 is integrated within and internal to a magnified optic.

FIGS. 28A-30 illustrate views of a parallax mitigation device 100 through a magnified optic, in accordance with one or more embodiments of the present disclosure.

In some embodiments, the parallax mitigation device 100 includes a central position indicator to indicate a central position of the parallax mitigation device 100, which is aligned to a central position of the magnified optic when installed. The central position indicator may be formed as any shape or pattern visible to the user when viewed through a magnified optic suitable for identifying the central position of the parallax mitigation device 100.

In one embodiment, the central position indicator may include a central aperture. For example, a central aperture may be, but is not required to be, formed by a connecting member 114 held in place by bars as illustrated in FIGS. 1-4. Further, the central aperture may have any shape including, but not limited to, a circle, a triangle, a square, or a diamond. In another embodiments, the central position indicator may be formed as a crosshair or arrow pattern as illustrated in FIGS. 8 and 9.

Additionally, in some embodiments, various aspects of the central position indicator are tailored to provide an unobstructed view to a user of at least a portion of a reticle pattern of a magnified optic when installed on the magnified optic (e.g., at a known location). For example, aspects such as, but not limited to, the shape and/or thickness of the portions of the parallax mitigation device 100 forming the central position indicator may be designed to provide a visual reference indicative of the central portion of the parallax mitigation device 100 when the parallax mitigation device 100 is positioned at an out of focus plane. For instance, the out of focus plane may correspond to a front or rear end of a known magnified sight or a range of out of focus planes associated with expected placements that may correspond to typical design parameters of commercially available magnified sights.

Figure 28A:
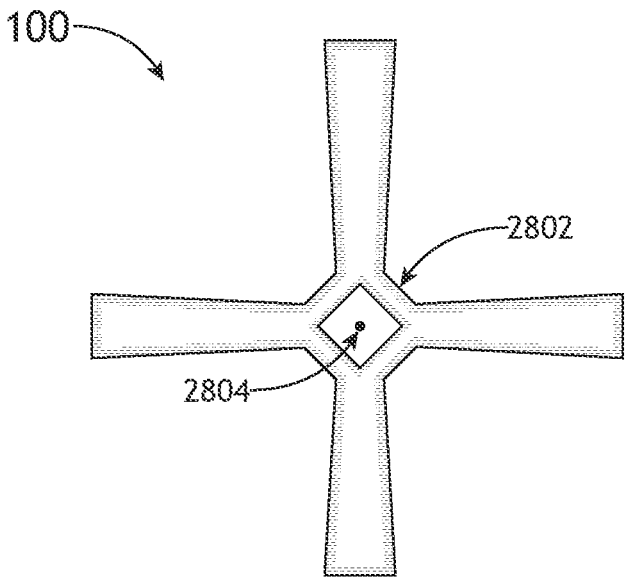
FIG. 28A is an image of a view through a magnified optic with a parallax mitigation device located on an ocular end of the magnified optic, in accordance with one or more embodiments of the present disclosure.

FIG. 28A is an image of a view through a magnified optic with a parallax mitigation device 100 located on an ocular end of the magnified optic, in accordance with one or more embodiments of the present disclosure. As illustrated in FIG. 28A, the features of the parallax mitigation device 100 appear out of focus (e.g., as a halo, reticle halo, a ghost ring, or the like), but are still clearly distinguishable and provide a visual reference to a center 2804 of the parallax mitigation device and thus a center position of the magnified optic when the parallax mitigation device 100 is installed onto the optical sight. For example, FIG. 28A illustrates a diamond-shaped central position indicator 2802.

Figure 28B:
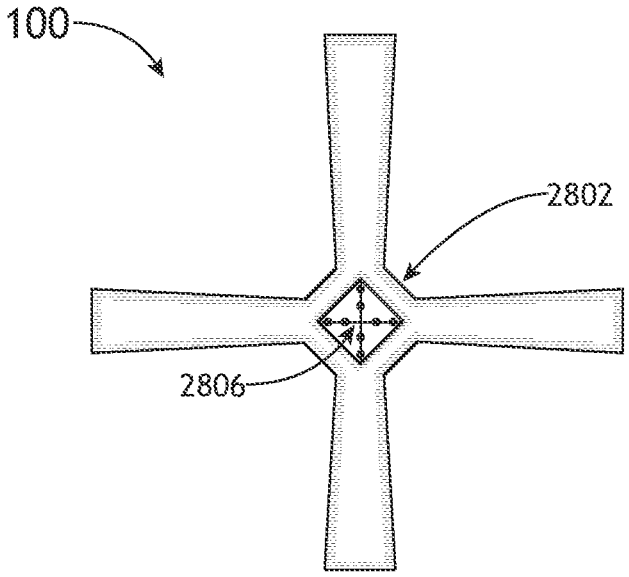
FIG. 28B is an image of a view through a magnified optic with a parallax mitigation device located on an ocular end of the magnified optic and an in-focus Mildot-style reticle, in accordance with one or more embodiments of the present disclosure.

FIG. 28B is an image of a view through a magnified optic with a parallax mitigation device 100 located on an ocular end of the magnified optic and an in-focus Mildot-style reticle pattern 2806 (e.g., provided by the magnified optic), in accordance with one or more embodiments of the present disclosure.

Figure 29A:
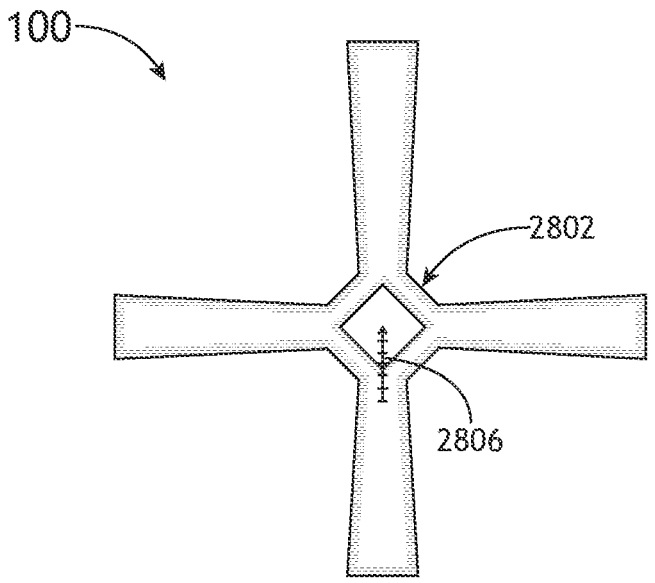
FIG. 29A is an image of a view through a magnified optic with a parallax mitigation device located on an ocular end of the magnified optic and an in-focus Trijicon ACOG-style reticle, in accordance with one or more embodiments of the present disclosure.
Figure 29B:
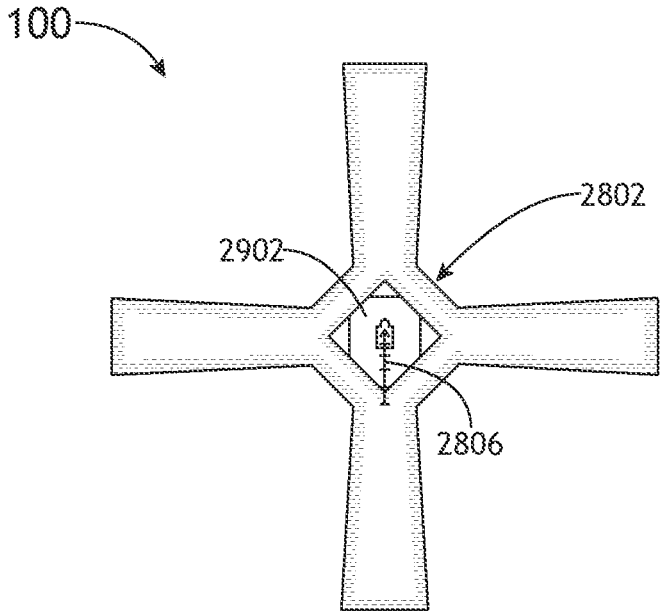
FIG. 29B is an image of a view through a magnified optic with a parallax mitigation device located on an ocular end of the magnified optic and an in-focus Trijicon ACOG-style reticle superimposed on a traditional Army zero target, in accordance with one or more embodiments of the present disclosure.

As illustrated in FIG. 29B, the reticle pattern 2806 visible and in focus when viewed through the magnified optic and the parallax mitigation device 100. In this case, the reticle may be clearly viewed and may be centered within the central position indicator 2802. Accordingly, when looking through the out-of-focus central position indicator 2802, the user may focus on a crisp reticle within the optic. In this regard, the reticle may be surrounded by the out-of-focus central position indicator 2802. Further, the reticle pattern 2806 may be superimposed on a target down range such that a user may proceed with the rest of the firing process.

FIG. 29A is an image of a view through a magnified optic with a parallax mitigation device 100 located on an ocular end of the magnified optic and an in-focus Trijicon ACOG-style reticle pattern 2806, in accordance with one or more embodiments of the present disclosure. FIG. 29B is an image of a view through a magnified optic with a parallax mitigation device 100 located on an ocular end of the magnified optic and an in-focus Trijicon ACOG-style reticle superimposed on a traditional Army zero target 2902, in accordance with one or more embodiments of the present disclosure. As illustrated in FIGS. 29A and 29B, the parallax mitigation device 100 may be designed to provide that the in-focus reticle pattern 2806 from the magnified optic and physical objects imaged by the magnified optic (e.g., the target 2902) are visible and may be aligned relative to the out of focus central position indicator 2802 when a position of the user's head and/or eye is properly aligned.

It is contemplated herein that in instances in which the shooter is unable to maintain proper eye relief, the parallax mitigation device 100 will nonetheless facilitate centering the user's eye behind the ocular lens and will ensure that the lenses are properly aligned to provide accurate firing. It is noted that in this situation, the user may rely on the center of the reticle crosshairs and, if there is an integral bullet drop compensator, it will not be effective as the correct eye relief was not maintained. However, the user will however still be able to deliver accurate fire using the center point of the reticle.

It is further contemplated herein that the parallax mitigation device 100 fixed in place during firing may provide multiple benefits to the user in a wide range of situations.

The parallax mitigation device 100 may facilitate training by providing an easily verifiable reference point to reinforce eye placement training and may further facilitate training on basic optics operation and concepts. In particular, by using the parallax mitigation device 100 on a magnified optic, the user may immediately know what correct sighting looks like and can repeat this as needed in other situations.

Additionally, the parallax mitigation device 100 may facilitate accurate firing from challenging positions or angles in which it is difficult to maintain proper eye relief and thus parallax is induced in the optic. Unlike reflex or zero magnification sights, magnified sights always contain parallax. Examples of such challenging positions may include, but are not limited to, offhand shooting, follow-up shots, moving targets, or constraints arising from wearing gear or body armor. Each of these presents unique challenges as outlined below.

In a military or hunting situation when a user's first shot is not sufficient to dispatch the target, they must fire a follow up shot. As time is of the essence and the target more than likely has changed position, the user is not able to achieve a proper firing position nor proper eye relief. This results in parallax being induced in the optic and as a result the accuracy of the user is greatly diminished. By utilizing the parallax mitigation device 100 when mounted on the ocular lens of the optic, the user gains an additional point of alignment and is guaranteed that the eye is centered behind the optic and by centering the central focal point of the optics reticle. This ensures that the lenses within the optic remain aligned and accounts for any parallax that has been induced in the optic. The result of this is that the follow-up shot will be accurately placed and the user will be successful with any follow-up shots.

Additionally, when firing from the standing or offhand position, it is often difficult for a shooter to maintain proper eye relief or a steady position. There is often a wobble associated with such shots in which the shooter may or may not have proper eye relief and lens alignment at the moment the shot is fired. By utilizing the parallax mitigation device 100 to the optic in front of the ocular lens, the shooter is assured that the lenses are aligned and that their point of aim will remain accurate.

In the situation of moving targets, the position of the user by definition will not be steady. In this case, both the shooter and the target are typically in motion. As such, it may be difficult for the shooter to retain the requisite eye relief or to ensure equal amounts of scope shadow indicating alignment of the lenses of the optic. The use of the parallax mitigation device 100 mounted to the optic on the optical lens will ensure that the lenses remain aligned and shots are accurate.

Hunting presents many challenges to the shooter that can be overcome by the addition of the parallax mitigation device 100. Examples of these include, but are not limited to, an inability to have a correct or steady position, obstacles such as trees that require last minute adjustments of shooting position, elevated shooting platforms, or bulky clothing. In these situations, the application of the parallax mitigation device 100 mounted to the optic on the optical lens may ensure that the lenses remain aligned and shots are accurate.

Bore-sighting presents shooters with additional challenges with magnified optics. When bore-sighting, the shooter must align the lenses of the optic by use of proper eye relief as well as the that emitted laser dot form the bore-sighting device and also align the reticle with a target to adjust for an offset as appropriate for the optic and mount being used as well as the distance at which the bore-sighting occurs. By installing the parallax mitigation device 100 as described herein, the shooter may have a reference point to ensure that the lenses of the optic aligned and that there is no parallax in the optic. This additional aiming point adds efficiency and accuracy to the bore-sight process.

For Military shooters using the M-249 or M240 series machine guns with sights such as the Trijicon ACOG or the Machine Gun Optic (MGO), the parallax mitigation device 100 may be used as described herein. Often the shooters of these machine guns have challenges achieving proper eye relief for several reasons such as, but not limited to, firing from a tripod either on the ground or vehicle mounted, firing from moving vehicles, or group and zero processes. In these situations, the application of the parallax mitigation device 100 mounted to the optic on the optical lens will ensure that the lenses remain aligned and shots are accurate.

Figure 30A:
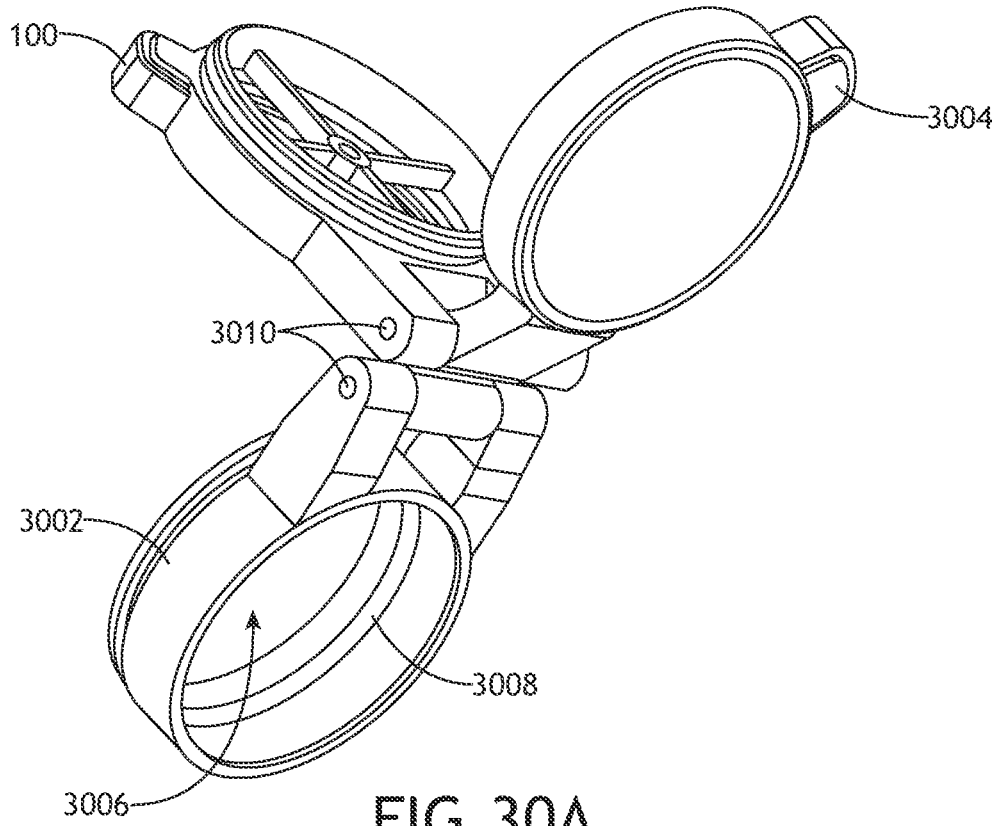
FIGS. 30A and 30B are perspective views of an assembly including a parallax mitigation device, an adapter, and a lid, in accordance with one or more embodiments of the present disclosure.
Figure 30B:
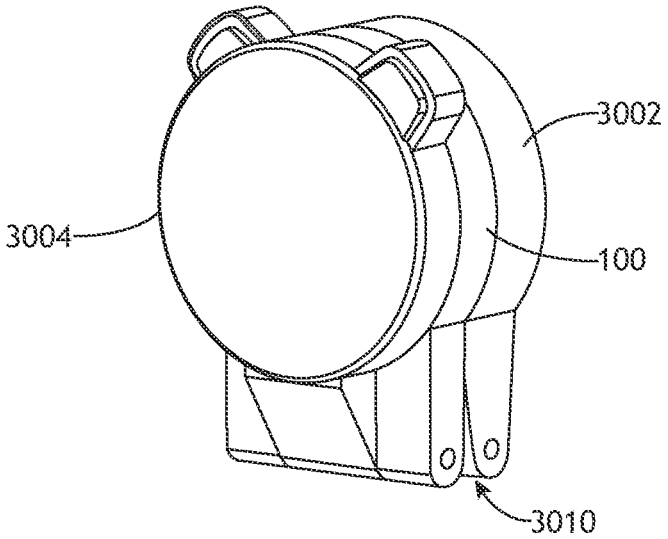
Figure 30C:
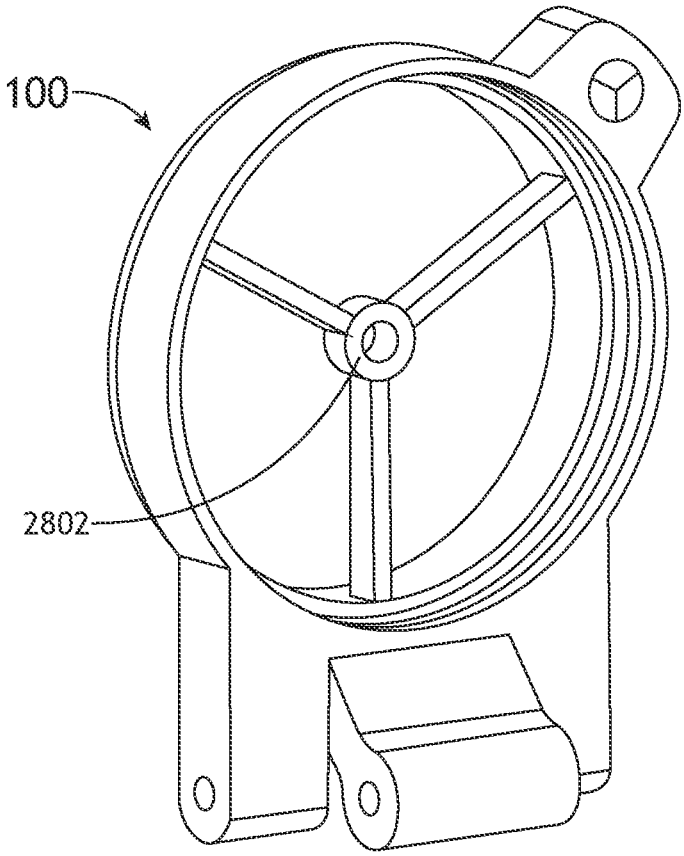
FIGS. 30C-30E are perspective views of the parallax mitigation device of FIGS. 30A and 30B detached from the adapter and the lid.
Figure 30D:
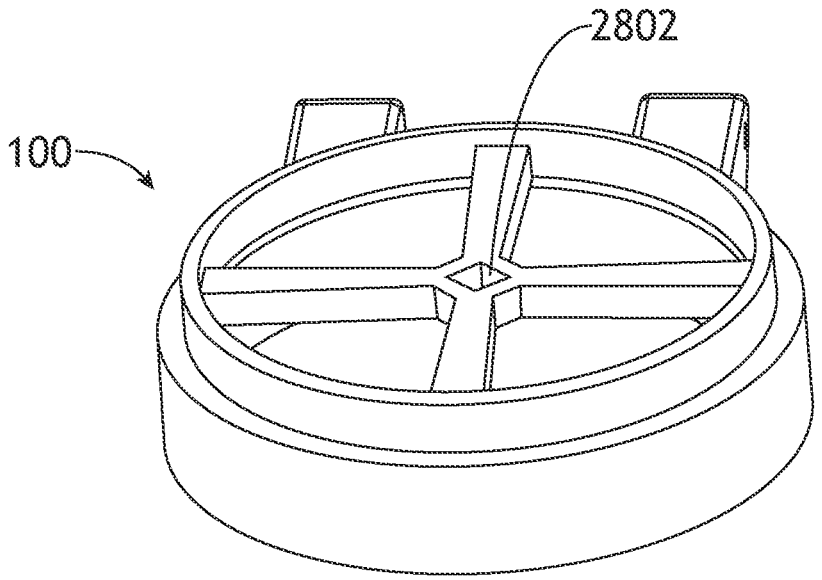
Figure 30E:
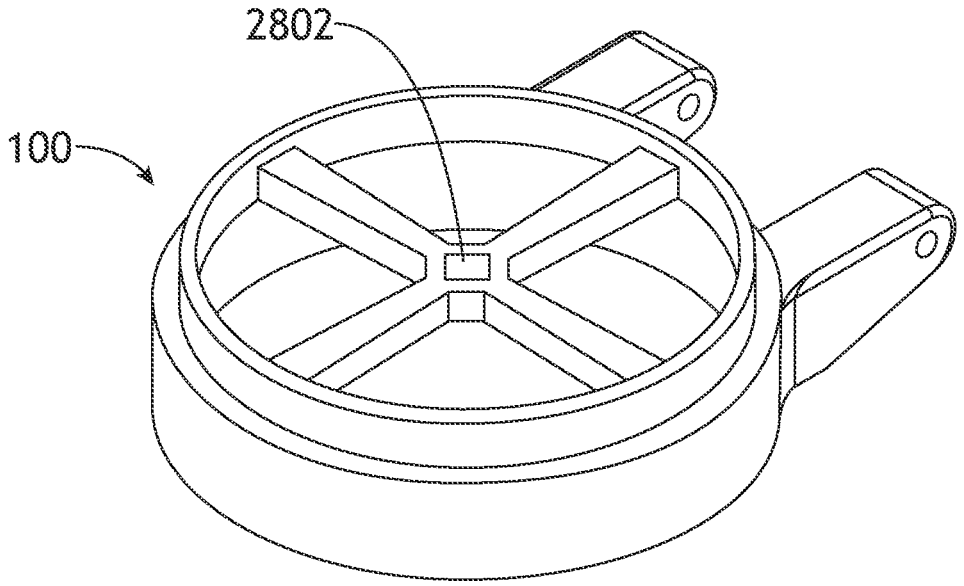
Figure 30F:
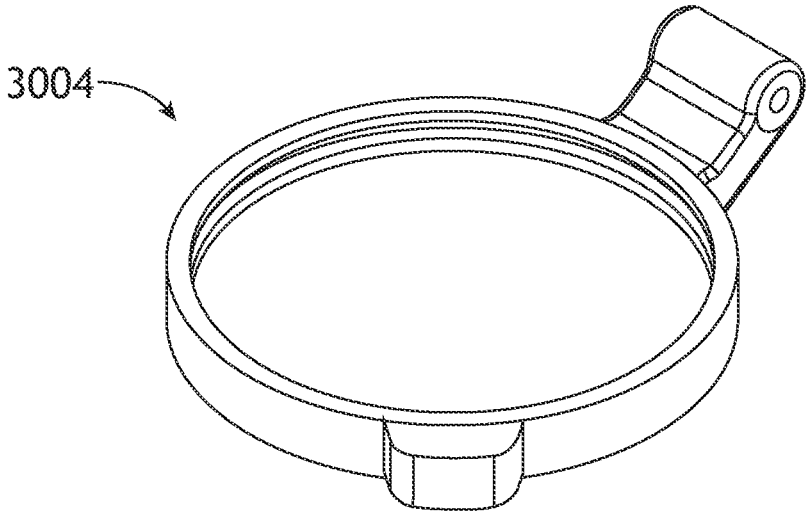
FIGS. 30F and 30G are perspective views of the lid of FIGS. 30A and 30B detached from the adapter and the parallax mitigation device.
Figure 30G:
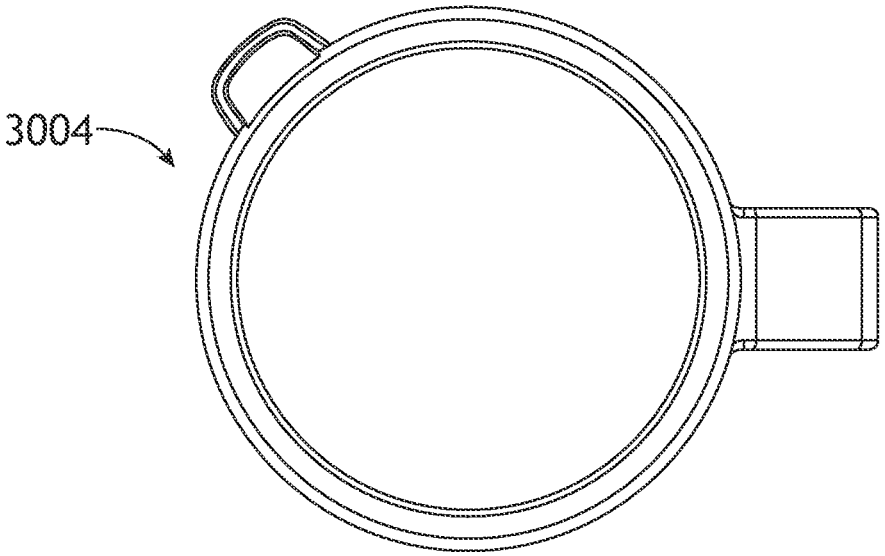

In some embodiments, the parallax mitigation device 100 is provided with at least one of an adapter or a lid. Such a configuration may generally be suitable for use with any type of optical sight including, but not limited to, a reflex sight or a magnified sight. FIGS. 30A-30G illustrate views of a parallax mitigation device 100 attached to an adapter 3002 and a lid 3004 in accordance with one or more embodiments of the present disclosure. FIGS. 30A and 30B are perspective views of an assembly including a parallax mitigation device 100, an adapter 3002, and a lid 3004, in accordance with one or more embodiments of the present disclosure. FIGS. 30C-30E are perspective views of a parallax mitigation device 100 detached from the adapter 3002 and the lid 3004. FIGS. 30F and 30G are perspective views of the lid 3004 of FIGS. 30A and 30B detached from the adapter 3002 and the parallax mitigation device 100. Additionally, FIGS. 30A and 30C illustrate a parallax mitigation device 100 with a circular central position indicator 2802, while FIGS. 30D and 30F illustrate a parallax mitigation device 100 with a square or diamond-shaped central position indicator 2802. As described previously herein, the central position indicator may generally have any shape or pattern suitable for indicating a central position of the parallax mitigation device 100 to the user.

In one embodiment, the parallax mitigation device 100 is attached to or may be attached to an adapter 3002, where the adapter 3002 may generally attach to any portion of an optical sight. In this way, the adapter 3002 may operate as a mount to attached the parallax mitigation device 100 to an optical sight.

The adapter 3002 may secure to an optical sight using any technique known in the art. For example, the adapter 3002 may include an opening 3006 sized to fit over a portion of an optical sight as an end-cap. In this configuration, the adapter 3002 may be secured to the optical sight through friction such that the adapter 3002 may be a slip-on adapter enabling the adapter 3002 and thus the parallax mitigation device 100 to be slipped on and off of the optical sight. By way of another example, though not shown, the adapter 3002 may include threads to screw into a portion of the optical sight.

The adapter 3002 may further include one or more keyed features 3008 positioned to control the orientation of the adapter 3002 and/or the parallax mitigation device 100 with respect to the optical sight. For instance, FIG. 30A illustrates a keyed feature 3008 including a protrusion positioned to limit the depth of travel of the adapter 3002 when mounted to an optical sight.

In one embodiment, the parallax mitigation device 100 is attached to or may be attached to a lid 3004. For example, the lid 3004 may protect the parallax mitigation device 100, or the components thereof, when in storage.

The parallax mitigation device 100 may attach to the adapter 3002 and/or the lid 3004 using any technique in the art. In one embodiment, as illustrated in FIGS. 30A-30G, the parallax mitigation device 100 is attached to an adapter 3002 and a lid 3004 by one or more hinges 3010. In this regard, any combination of the parallax mitigation device 100, the adapter 3002, or the lid 3004 may be selectively moved in or out of a line of sight (e.g., an optical path) of an optical sight.

As an illustration, FIGS. 30A and 30B illustrate dual hinges 3010 between an adapter 3002, a parallax mitigation device 100, and a lid 3004 allowing each to be adjusted independently. In one configuration, the parallax mitigation device 100 and the lid 3004 may be moved to a closed position illustrated in FIG. 30B in which both the parallax mitigation device 100 and the lid 3004 are in the light of sight of the optical path. Such a configuration may be suitable for storage and/or protection of the optical sight and/or the parallax mitigation device when not in use. In another configuration, though not explicitly illustrated, parallax mitigation device 100 may be positioned in the line of sight of the optical sight, but the lid 3004 may be positioned out of the line of sight. Such a configuration may correspond to the illustration in FIG. 30B where the only lid 3004 is flipped (e.g., to a position illustrated in FIG. 30A) and may be suitable for operation of the firearm with the parallax mitigation device 100 visible while using the optical sight as described throughout the present disclosure. In another configuration, the parallax mitigation device 100 and the lid 3004 may both be positioned out the line of sight of the optical sight (e.g., as illustrated in FIG. 30A). Such a configuration may be suitable for operation of the firearm without the parallax mitigation device 100, but providing the flexibility of placing the parallax mitigation device 100 within the line of sight of optical sight at the convenience of the user.

It is to be understood, however, that FIGS. 30A-30G are provided solely for illustrative purposes and should not be interpreted as limiting. In one embodiment, the parallax mitigation device 100 is attached to an adapter 3002, but does not include the lid 3004. Further, the parallax mitigation device 100 may include any type of positional adjustment mechanism known in the art suitable for selectably positioning the parallax mitigation device 100 in or out of a line of sight of an optical sight. In this regard, the illustration of the use of hinges 3012 in FIGS. 30A-30G is merely an illustration. In another embodiment, a parallax mitigation device 100 may be integrated with an adapter 3002 as a single component. In this configuration, the parallax mitigation device 100 may secure directly to an optical sight and may not be flipped out of the optical path of the optical sight when attached.

Referring now to FIGS. 31-38, systems and methods for boresighting a firearm by loading a boresight device into the chamber of a firearm in the place of a bolt carrier group are described in greater detail. Further, the laser boresight described herein may be used in combination with the parallax mitigation device 100 described previously herein for accurate sighting.

Embodiments of the present disclosure are directed to systems and methods for boresighting a firearm by loading a boresight device into the chamber of a firearm in the place of a bolt carrier group, whereupon the boresight device may propagate a laser beam through the barrel of the firearm for alignment with a sighting device.

Boresighting typically requires two stages of alignment to properly align a sighting device to the barrel of a firearm. First, a boresight device must be aligned to the barrel. For example, a laser boresight device must be aligned such that a laser beam may propagate along an axis of the barrel (e.g., a center axis of the barrel, an axis parallel to the center axis, or the like). Second, the sighting device must be aligned to the point of impact of the laser beam on a target at a selected distance.

Embodiments of the present disclosure are directed to a laser boresight device designed to be loaded into the chamber of a firearm. In this regard, the laser boresight device may direct a laser beam through the length of the barrel towards a target. Additional embodiments of the present disclosure are directed to a boresight device with one or more keyed features that engage with corresponding features of the firearm to provide self-alignment of the laser beam with an axis of the barrel when loaded into the firearm.

Additional embodiments of the present disclosure are directed to a boresight device designed to be loaded into the chamber of a firearm in the place of a bolt carrier group. Many firearms, such as, but not limited to, M-16 rifles, AR-15 rifles, or the like include a bolt carrier group that may be easily and quickly removed to provide access to the chamber. Further, the dimensions and features of the bolt carrier group are keyed to provide self-alignment within the chamber for reliable operation. For example, the bolt carrier group may be generally cylindrically shaped with an outer diameter closely matched to the inner diameter of the chamber such that the bolt carrier group may controllably slide back and forth within the chamber during firing with minimal wobble. Further, the bolt carrier group may include one or more rails, grooves, protrusions, cut-outs, or the like to engage with components such as, but not limited to, the charging handle, the end face of the barrel, or a gas return line.

Embodiments of the present disclosure are directed to a boresight device having dimensions and/or keyed features to engage with the firearm in a similar manner as a bolt carrier group. In this regard, the boresight device may self-align the path of a laser beam to the axis of the barrel when loaded into the chamber without additional alignment by the user.

It is recognized herein that a boresight device providing self-alignment with the barrel of a firearm (e.g., the first alignment step of boresighting) may facilitate efficient operation of the boresight device itself without the need for user training on the operation of the device. For example, a user may simply remove the bolt carrier group, insert the boresight device, power on the laser beam, aim the laser beam at the target, and align the sighting device to the target (e.g., the second alignment step of boresighting). Further, a boresight device providing self-alignment with the barrel of the firearm may be rapidly switched between multiple firearms. Accordingly, the boresight device may be used to boresight many (e.g., greater than 100) firearms in a day and may thus be suitable for reliable and fast in-field military operations.

It is further recognized herein that a laser boresight device inserted into the chamber in the place of a bolt carrier group may provide highly accurate self-alignment of the laser beam with the axis of the barrel with without the time, effort, or uncertainty associated with manually aligning the boresight device to the barrel during the first alignment step. Accordingly, a boresight device inserted into the chamber in the place of a bolt carrier group may provide a higher accuracy than typical laser boresight devices such as, but not limited to, those placed within the firing end of a barrel or those shaped as bullets and loaded into the firearm. For example, boresight devices inserted into the firing end of the rifle may sag due to weight protruding from the end of the barrel, loose fit within the barrel, or the like. Further, boresight devices inserted into the barrel pose a risk of physically damaging the barrel (e.g., via abrasions, chips, or the like), particularly through repeated use, that may ultimately reduce the firing accuracy of the firearm. By way of another example, boresight devices shaped as ammunition loaded into the firearm may have dimensions that do not precisely match the inner diameter of the barrel and/or do not precisely match the type of ammunition to be used, which may lead to inaccurate alignment and unreliable operation. In contrast, a boresight device inserted into the chamber in the place of a bolt carrier group may be rigidly fixed within the chamber (e.g., by pressure from the recoil spring, snug fit within the chamber, keyed features, or the like) and may thus not exhibit sag and/or wobble that may lead to alignment errors. Further, the length of a boresight device designed to replace a bolt carrier group may be, but is not required to be, 30-50 millimeters, which may provide substantial interaction length with the chamber for accurate self-alignment with the firearm.

Additional embodiments of the present disclosure are directed to a boresight device with laser power switch accessible when loaded into the chamber of a firearm. For example, the boresight device may have a laser power switch accessible through a chamber door. By way of another example, the boresight device may have a laser power switch that may be actuated by a component of the firearm such as, but not limited to, the safety switch or the trigger/hammer. In this regard, a user may selectively actuate the power of the laser with the device inserted into the firearm, which may facilitate safe operation and minimize stray reflections of the laser beam into the eyes of the user and/or any bystanders.

The boresight device may be powered by any power source known in the art such as, but not limited to, batteries (e.g., single-use or rechargeable) or an external power supply. It is recognized herein that a boresight device designed to be loaded into the chamber in the place of a bolt carrier group may be powered by long-lasting and/or rechargeable batteries suitable for extended use, which may facilitate prolonged field use of the boresight device. In particular, boresight device the size of a bolt carrier group may be, but is not required to be, sufficient to provide for a wide variety of battery form factors such as, but not limited to, C, AA, AAA, AAAA, or button.

It is further recognized herein that a boresight device may be used for a variety of purposes beyond zeroing a firearm. For example, a boresight device in which a laser beam may be selectively actuated by the user (e.g., via the trigger) may provide ammunition-less training in which a point of impact of the laser beam is gauged as a fire rather than the point of impact of a round of fired ammunition.

Figure 31:
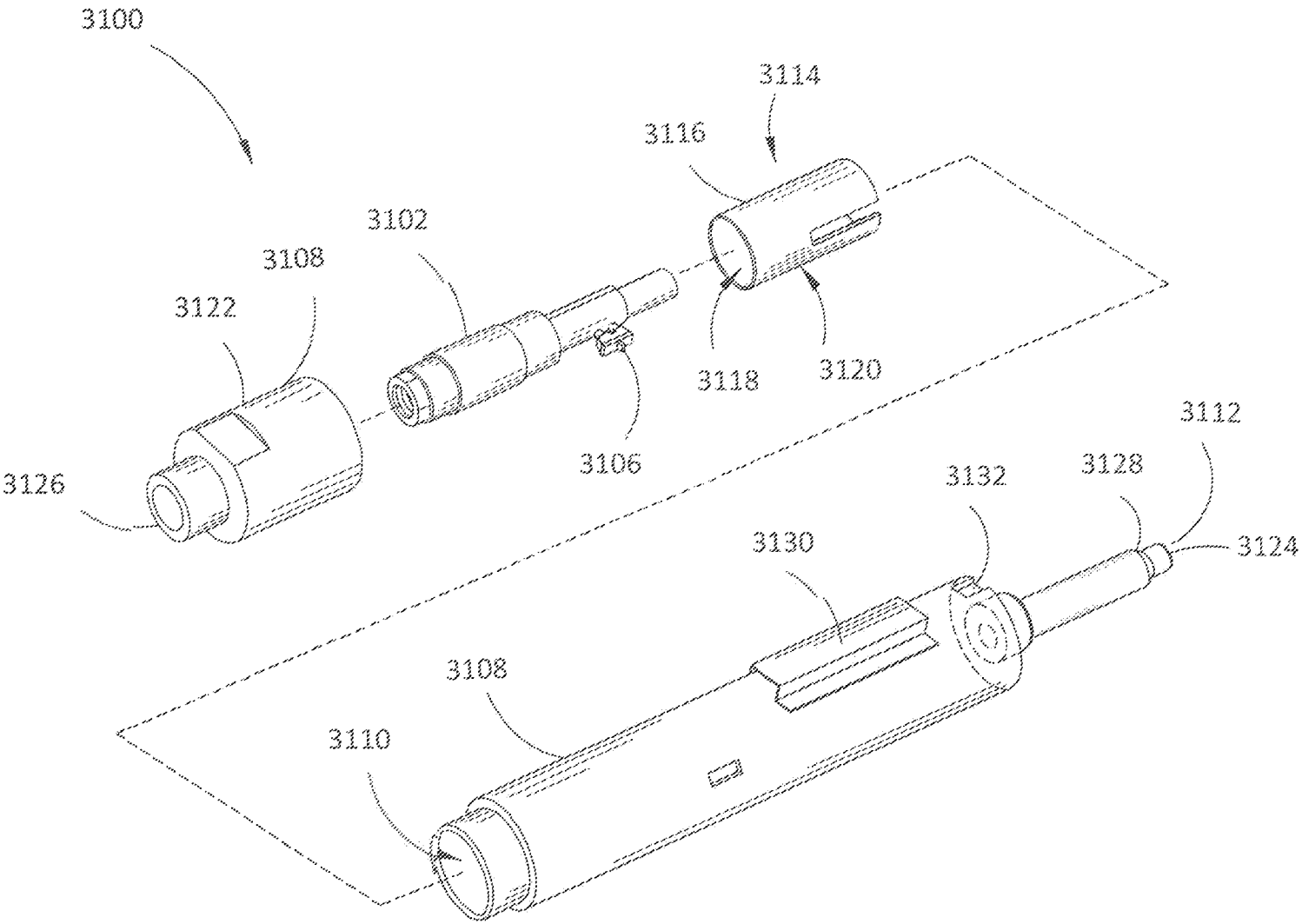
FIG. 31 is an exploded perspective view of a boresight device, in accordance with one or more embodiments of the present disclosure.
Figure 32:
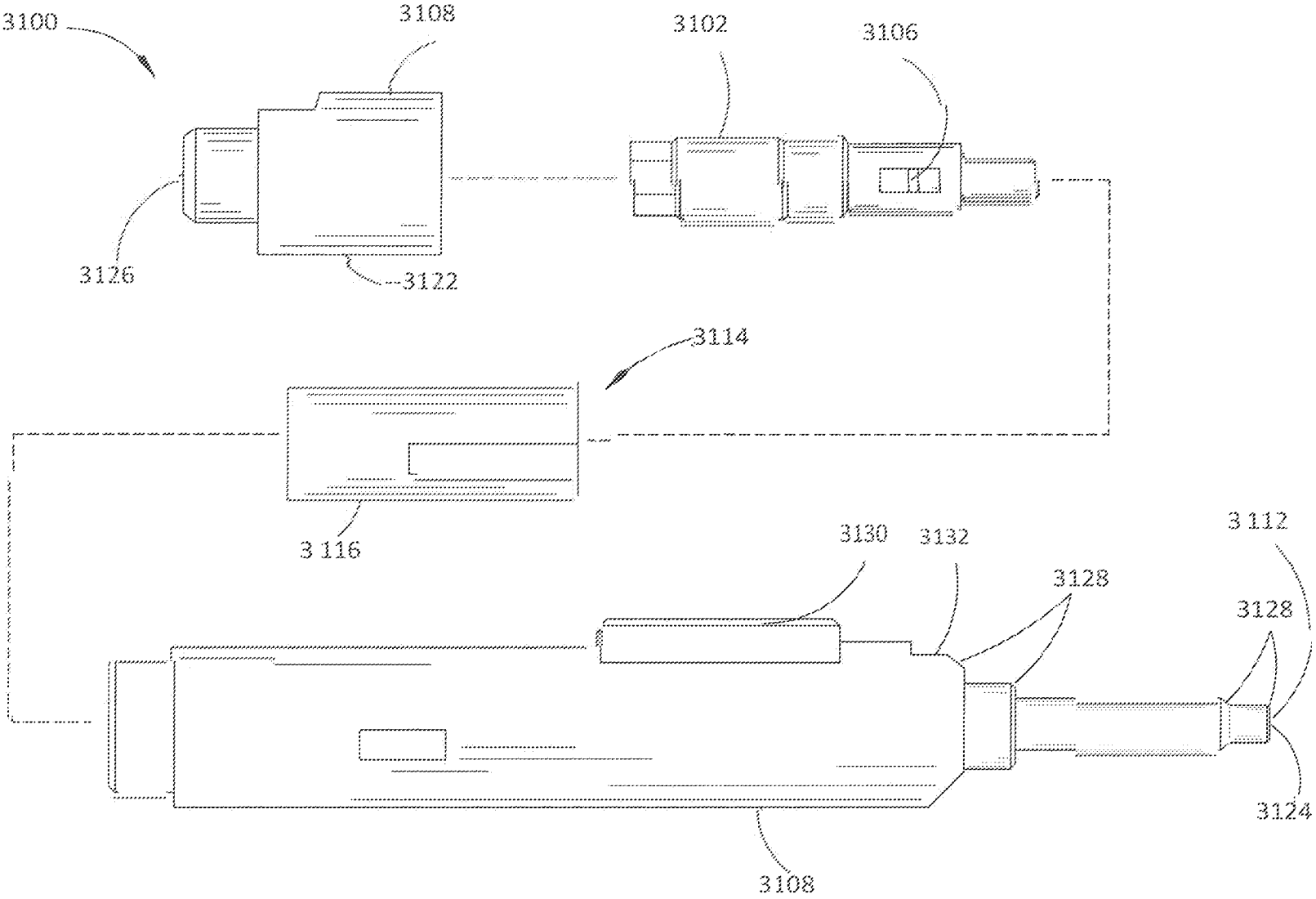
FIG. 32 is an exploded orthogonal view of a boresight device, in accordance with one or more embodiments of the present disclosure.
Figure 33:
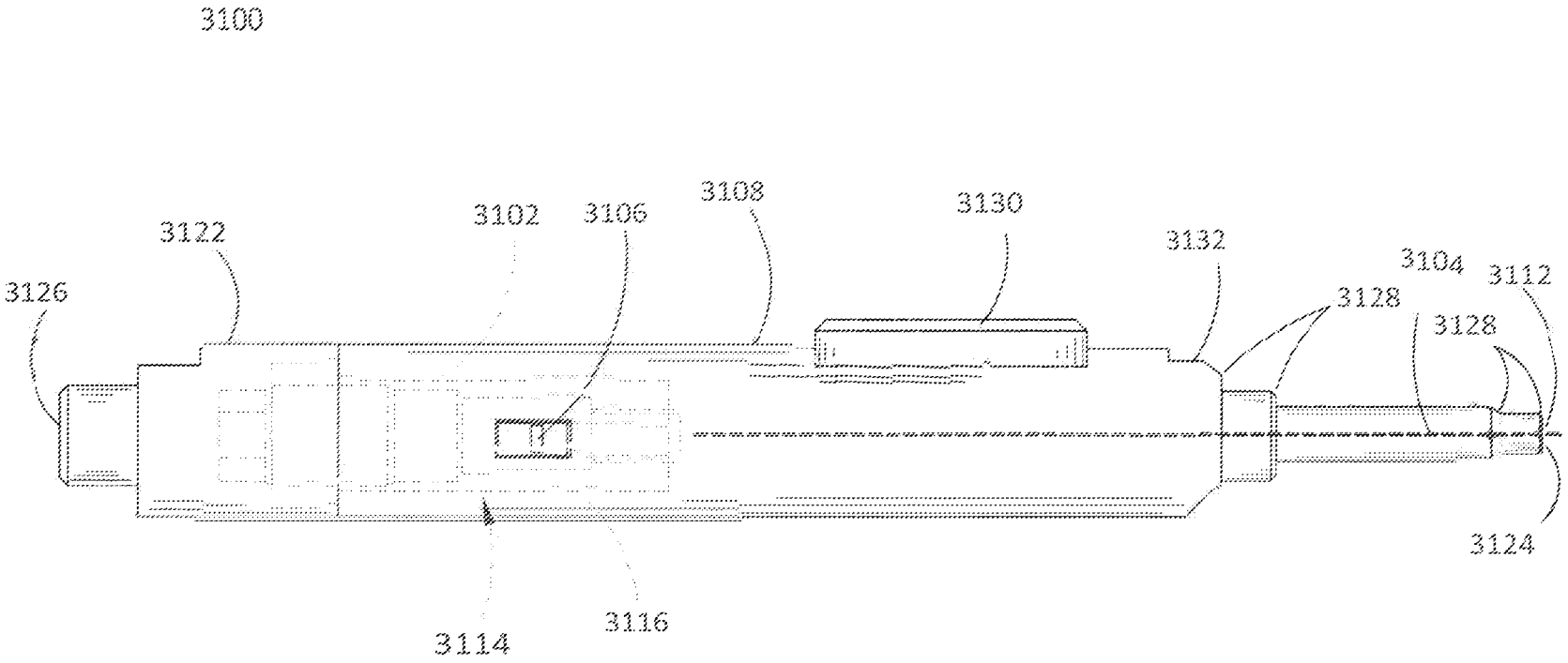
FIG. 33 is an orthogonal assembled view of a boresight device, in accordance with one or more embodiments of the present disclosure.

Referring now to FIGS. 31 through 33, a boresight device designed to be loaded into a chamber of a firearm is generally shown. FIG. 31 is an exploded perspective view of a boresight device 3100, in accordance with one or more embodiments of the present disclosure. FIG. 32 is an exploded orthogonal view of the boresight device 3100, in accordance with one or more embodiments of the present disclosure. FIG. 33 is an orthogonal assembled view of the boresight device 3100, in accordance with one or more embodiments of the present disclosure.

In one embodiment, the boresight device 3100 includes a laser device 3102 suitable for generating a laser beam 3104. Further, the laser beam 3104 may include any wavelength or combination of wavelengths. For example, the laser device 3102 may generate a laser beam 3104 including one or more visible wavelengths such as, but not limited to, red, yellow, green, or blue wavelengths. Such wavelengths are typically visible to the human eye and may be readily seen on an alignment target. By way of another example, the laser device 3102 may generate a laser beam 3104 including one or more wavelengths typically not detectable with the human eye such as, but not limited to, infrared (IR) wavelengths. In one instance, the laser beam 3104 may include infrared wavelengths that may be classified as "eye-safe" at certain power levels (e.g., due to an inability of the human eye to focus a beam of such light onto the retina). In this case, the laser beam 3104 may generate visible light when incident on a target through fluorescence or a similar process. Alternatively, the laser beam 3104 may be viewed using additional viewing equipment such as, but not limited to, an IR camera, or an IR viewer (e.g., a "night-vision" viewer).

The laser device 3102 may be any type of laser suitable for generating the laser beam 3104. In one embodiment, the laser device 3102 includes a laser diode suitable for directly generating laser light at a desired wavelength. For example, the laser device 3102 may include an aluminum-gallium-indium-phosphide (AlGaInP) laser diode for generating a laser beam at wavelengths in the range of 630-650 nm, or red wavelengths. In another embodiment, the laser device 3102 includes a diode-pumped solid-state (DPSS) laser in which a laser diode generates light that pumps a solid-state material (e.g., a crystal) that in turn generates wavelengths of interest (e.g., 671 nm). In another embodiment, the laser device 3102 may include a gas laser such as, but not limited to, a helium-neon laser. In another embodiment, the laser device 3102 includes a frequency-conversion component to generate one or more desired wavelengths through nonlinear optical interactions such as, but not limited to, frequency doubling or four-wave mixing. For example, green laser light at a wavelength of 532 nm may be, but is not required to be, generated by a three-step DPSS process in which a laser diode emits 808 nm light, which pumps a nonlinear crystal (e.g., neodymium-doped yttrium aluminum garnet (Nd:YAG), neodymium-doped yttrium orthovanadate (Nd:$YvO_4$), or the like) to generate 1064 nm laser light, which is then frequency-doubled in a nonlinear crystal (e.g., lithium triborate (LBO), potassium titanyl phosphate (KTP), or the like) to generate the 532 nm laser light. Similar processes may be utilized to generate any desired wavelength or range of wavelengths by the laser device 3102. In a general sense, the laser device 3102 may utilize any mechanism to generate a laser beam 3104 suitable for boresighting.

The laser device 3102 may be powered by any power source known in the art such as, but not limited to, batteries (e.g., single-use or rechargeable) or an external power supply. For example, batteries suitable for powering the boresight device may include, but are not limited to, alkaline, silver cell, nickel-cadmium, lithium-ion, or zinc-carbon. Further, batteries suitable for powering the boresight device may have any shape or form-factor known in the art, such as, but not limited to, C, AA, AAA, AAAA, or button.

In another embodiment, the laser device 3102 includes a laser power actuator 3106. The laser power actuator 3106 may include any component known in the art suitable for providing a user interface for the adjustment of the power of the laser beam 3104 such as, but not limited to, a button, a switch, or a dial. For example, the laser power actuator 3106 may toggle the laser beam 3104 on and off. By way of another example, the laser power actuator 3106 may provide intensity control of the laser beam 3104. Further, the laser power actuator 3106 may be accessible on the exterior of the casing 3108 such that a user may interface with the laser power actuator 3106 while the boresight device 3100 is fully assembled. In another embodiment, the laser power actuator 3106 includes a wireless transmitter/receiver suitable for providing wireless control of the laser beam 3104. For example, the laser power actuator 3106 may operate wirelessly using any frequency and/or protocol known in the art such as. For example, the laser power actuator 3106 may include a radio frequency (RF) transmitter/receiver operating on any frequency such as, but not limited to 315 MHz. By way of another example, the laser power actuator 3106 may include a Bluetooth transmitter/receiver.

In another embodiment, the boresight device 3100 includes a casing 3108 to house the laser device 3102. For example, the casing 3108 casing may include an enclosure with a cavity 3110 suitable for containing the laser device 3102. The casing 3108 may be fabricated from any material suitable for insertion into the chamber of a firearm. For example, the casing 3108 may be fabricated at least in part out of a metal such as, but not limited to, aluminum or stainless steel. Further, the casing 3108 may be treated with a coating and/or a hardening process (e.g., peening, or the like), which may provide increased durability and/or reliable operation for many uses. By way of another example, the casing 3108 may be fabricated at least in part out of glass-filled nylon.

In another embodiment, the casing 3108 includes an exit port 3112 to allow the laser beam 3104 generated by the laser device 3102 to propagate out of the casing 3108. For example, the exit port 3112 may include an open hole through which the laser beam 3104 may propagate. By way of another example, the exit port 3112 may include a window formed from a material at least partially transparent to the wavelength of the laser beam 3104. The window may be formed from any material known in the art suitable for transmitting a laser beam 3104 such as, but not limited to, a glass (e.g., fused silica, borosilicate glass, or the like), a crystal (e.g., quartz, sapphire, or the like), or a plastic material.

In another embodiment, the boresight device 3100 includes one or more laser positioning devices 3114. For example, as illustrated in FIGS. 31-33, the one or more laser positioning devices 3114 may include a guide lug 3116 to mechanically couple the laser device 3102 to the casing 3108. In this regard, the interior portion 3118 of the guide lug 3116 may accept at least a portion of the laser device 3102 and an exterior portion 3120 of the guide lug 3116 may couple with an interior wall of the casing 3108. Accordingly, the guide lug 3116 may secure may secure the laser device 3102 within the casing 3108. By way of another example, though not shown, the one or more laser positioning devices 3114 may include one or more adjustable components (e.g., alignment screws, or the like) to adjust the path of the laser beam 3104. In this regard, a user may adjust the direction that the laser beam 3104 exits the exit port 3112.

In another embodiment, as illustrated in FIGS. 31-33, the casing 3108 includes a removable end cap 3122 to provide access to the cavity 3110 of the boresight device 3100. For example, the end cap 3122 may provide a user with access to insert, remove, and/or adjust the laser device 3102. A user may thus selectively replace the laser device 3102 to provide a laser beam 3104 with a selected output wavelength, a selected laser intensity, or the like. In one instance, an adjustable guide lug 3116 may accommodate multiple laser devices 3102 with different form factors. In another instance, a dedicated guide lug 3116 may be used for each form factor. Further, the end cap 3122 may provide a user with access to insert, remove, and/or replace a battery to power the laser device 3102. In another embodiment, though not shown, the boresight device 3100 includes an integrated laser device 3102. For example, the laser device 3102 may not be removable. Further, the casing 3108 may be configured without a removable guide lug 3116 and may directly couple to the integrated laser device 3102.

In another embodiment, the boresight device 3100 includes one or more optical elements to control and/or modify the laser beam 3104 from the laser device 3102 such as, but not limited to one or more lenses, filters, or polarizers. The one or more optical elements may be integrated within any component the boresight device 3100 such as, but not limited to, the laser device 3102 itself, the cavity 3110, the guide lug 3116, or the exit port 3112. For example, the boresight device 3100 may include one or more filters to modify the spectral or spatial characteristics of the laser beam 3104. In one instance, the boresight device 3100 may include a spectral filter to at least partially reduce the intensity of one or more wavelengths of light generated by the laser device 3102. For example, a laser device 3102 including a nonlinear crystal may output a desired wavelength (e.g., visible green or blue wavelengths) as well as unconverted wavelengths (e.g., IR wavelengths). Accordingly, a spectral filter may selectively transmit the desired wavelengths and reflect and/or absorb undesired wavelengths. In another instance, the boresight device 3100 may include a spatial filter and/or one or more optical elements to shape the beam profile of the laser beam 3104.

Figure 34:
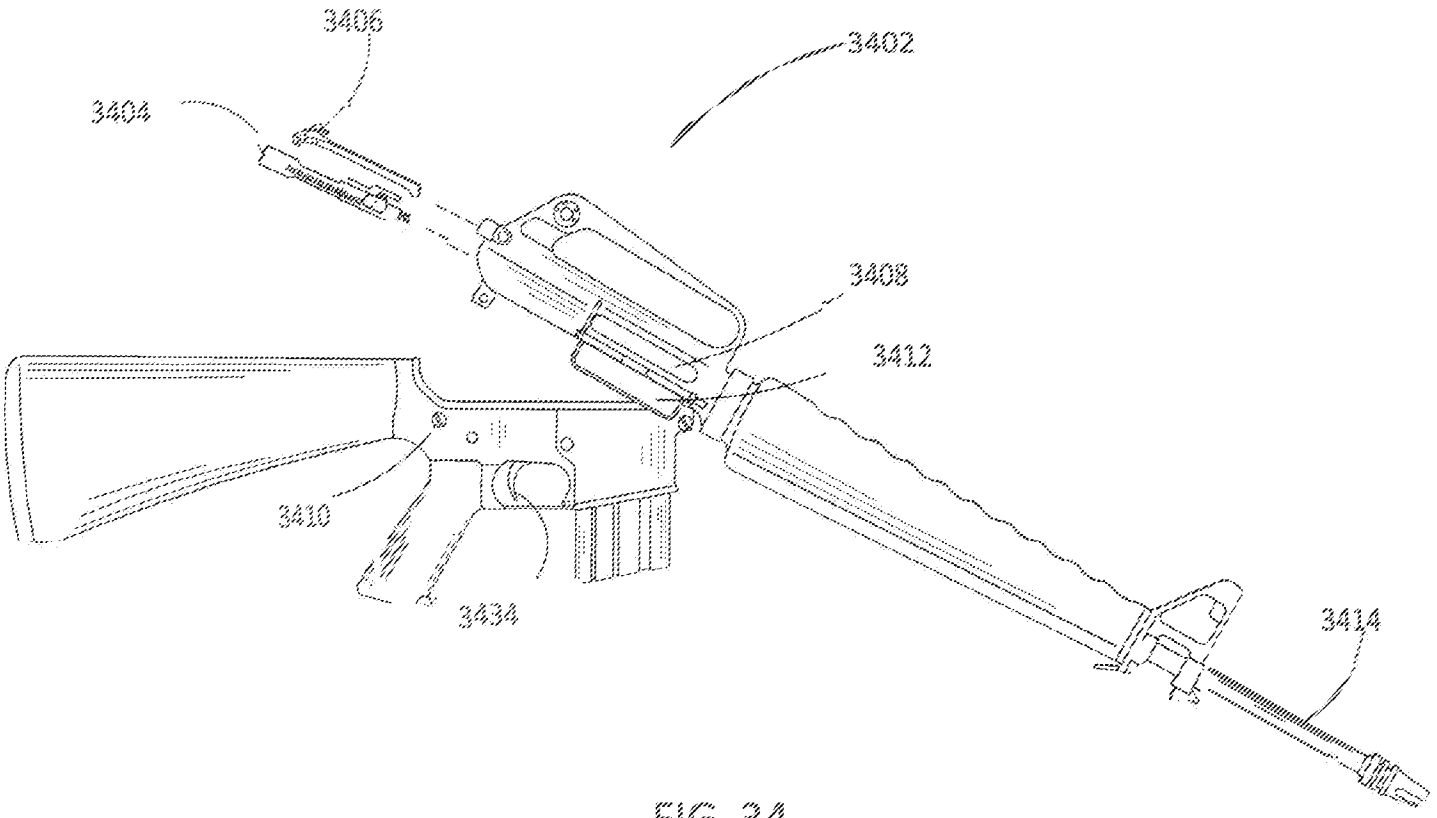
FIG. 34 is an exploded side view of an M-16 firearm in an opened position illustrating a bolt carrier group and a charging handle removed to provide access to a chamber of the firearm, in accordance with one or more embodiments of the present disclosure.
Figure 35:
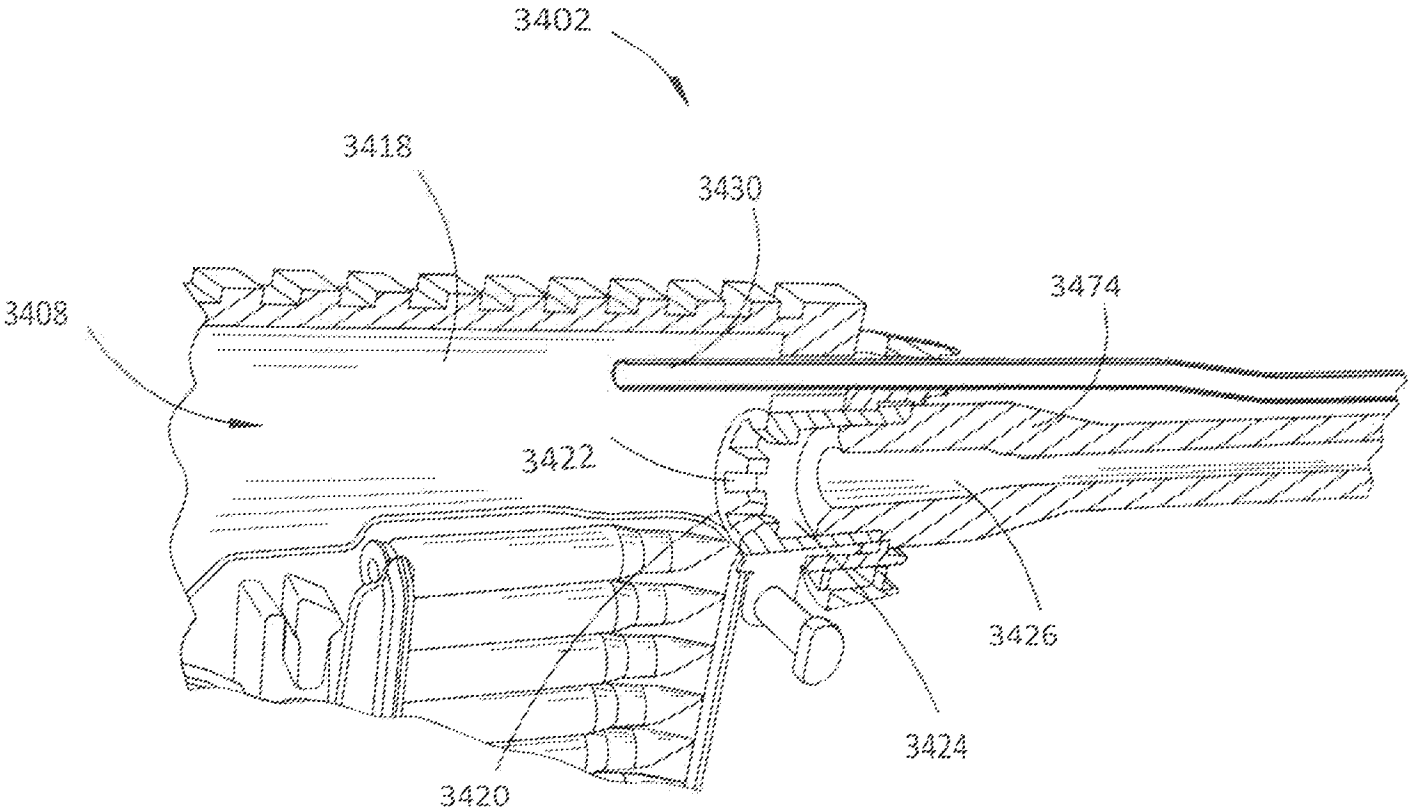
FIG. 35 is a perspective cut-out view of an empty chamber of a firearm, in accordance with one or more embodiments of the present disclosure.
Figure 36:
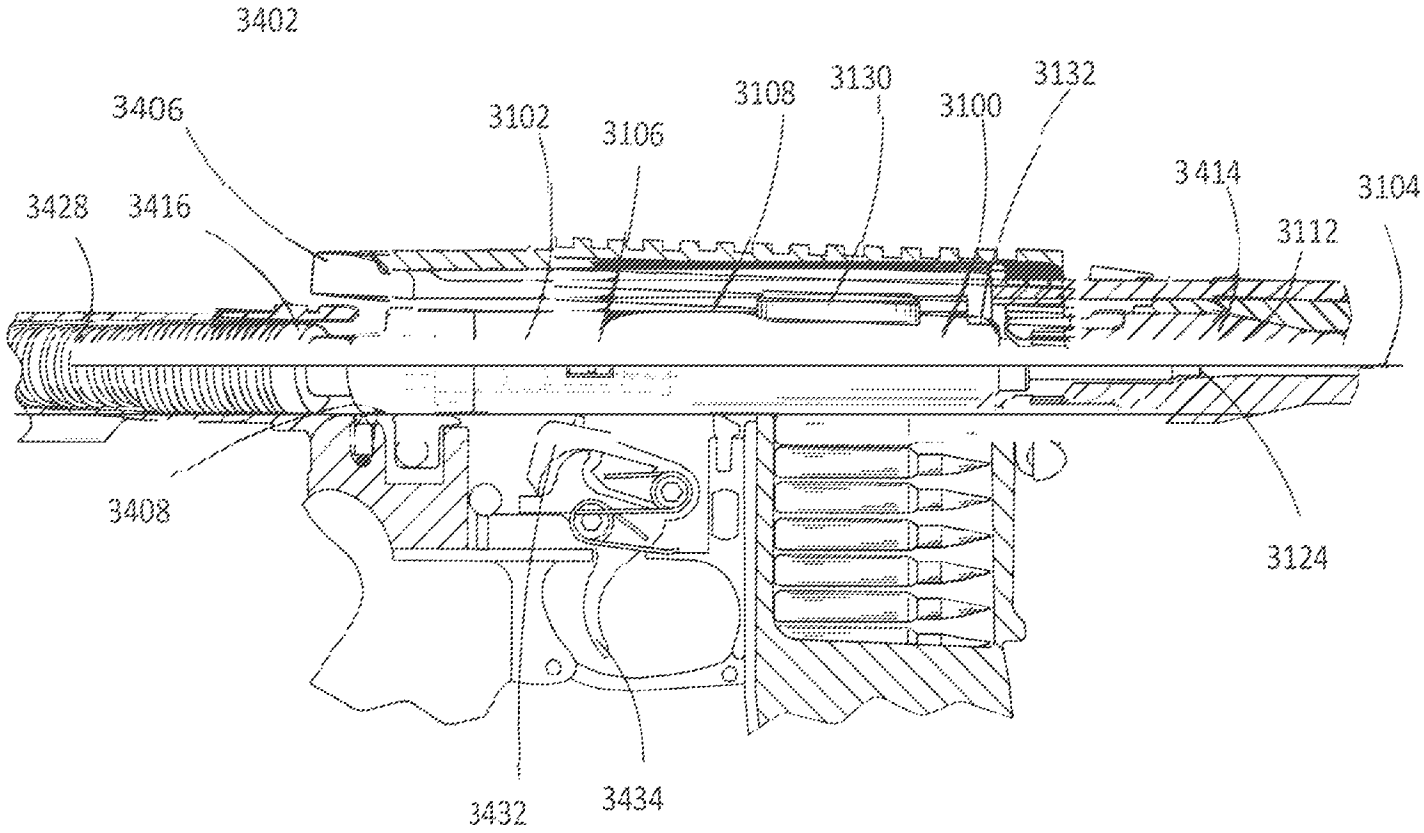
FIG. 36 is a cut-out view of a chamber illustrating a loaded boresight device, in accordance with one or more embodiments of the present disclosure.
Figure 37:
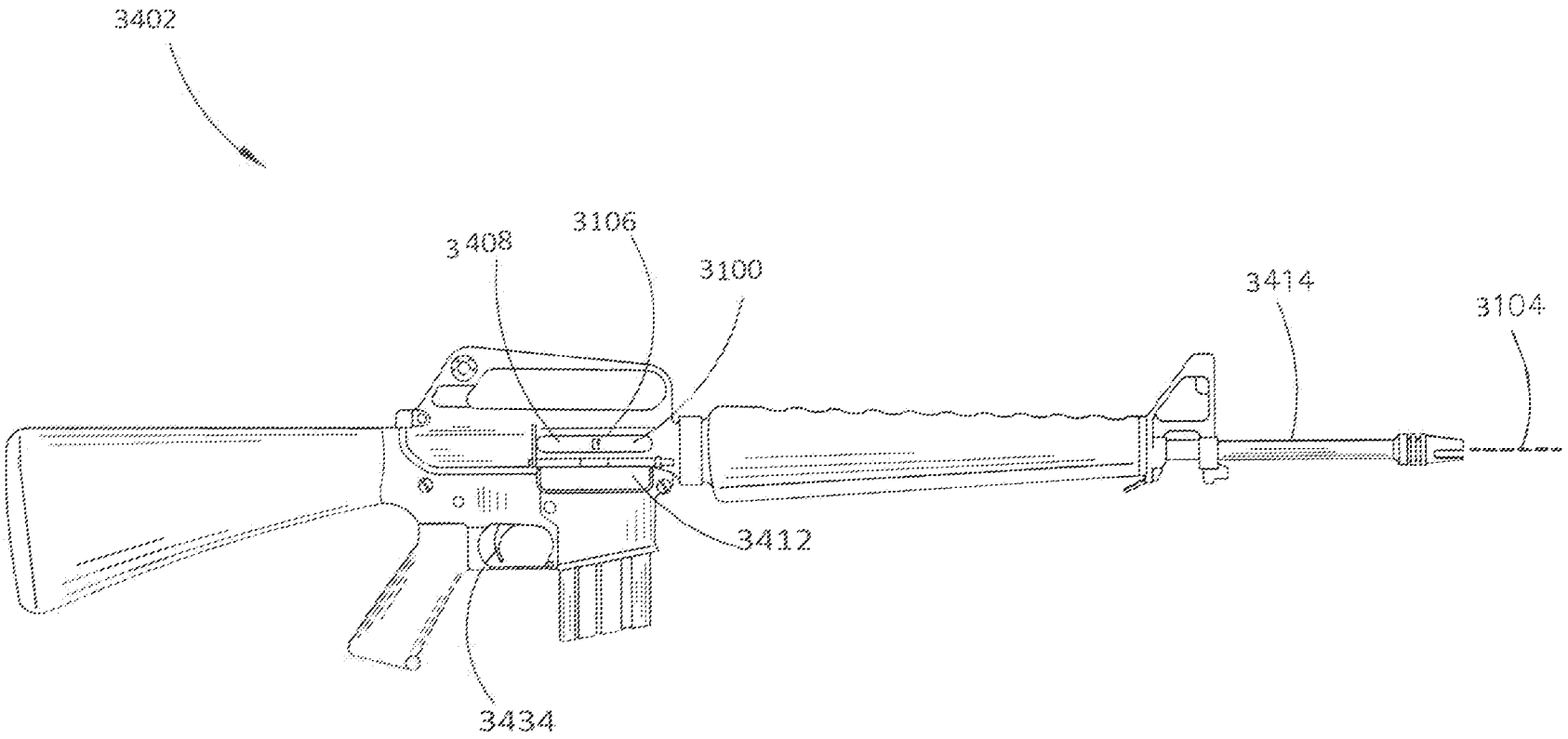
FIG. 37 is a side view of a firearm with a loaded boresight device, in accordance with one or more embodiments of the present disclosure.

Referring now generally to FIGS. 34 through 37, the coupling of a boresight device 3100 with a chamber of an M-16-style firearm is shown. FIGS. 34 and 35 illustrate an M-16-style firearm suitable for receiving a boresight device 3100. FIGS. 36 and 37 illustrate a boresight device 3100 loaded within the firearm. It is to be understood, however, that FIGS. 34 through 37 and the accompanying descriptions are provided solely for illustrative purposes and should not be interpreted as limiting the present disclosure. The boresight device 3100 may be designed to be loaded into the chamber of a firearm of any style and of any caliber. For example, the boresight device 3100 may be designed to be loaded into any M-16 or AR-15 style firearm or derivatives thereof. By way of another example, the boresight device 3100 may be designed to be loaded into additional styles of firearms without departing from the spirit and scope of the present disclosure.

FIG. 34 is an exploded side view of an M-16 firearm 3402 in an opened position illustrating a bolt carrier group 3404 and a charging handle 3406 removed to provide access to a chamber 3408 of the firearm, in accordance with one or more embodiments of the present disclosure. For example, the chamber 3408 may be accessed by removing a locking pin 3410, pivoting open the firearm 3402, and removing the bolt carrier group 3404 with the charging handle 3406. In FIG. 34, a chamber door 3412 is opened to view the interior of the chamber 3408. FIG. 35 is a perspective cut-out view of an empty chamber 3408 of a firearm 3402, in accordance with one or more embodiments of the present disclosure.

In one embodiment, the boresight device 3100 is designed to be loaded into the chamber 3408 in the place of the bolt carrier group 3404. For example, a user may use the charging handle 3406 to insert and/or remove the boresight device 3100 from the chamber 3408 in the same manner as the bolt carrier group 3404.

FIGS. 36 and 37 illustrate multiple views of the boresight device 3100 loaded in the chamber 3408 of the firearm 3402 and the path of the laser beam 3104 during operation. FIG. 36 is a cut-out view of the chamber 3408 illustrating a loaded boresight device 3100, in accordance with one or more embodiments of the present disclosure. FIG. 37 is a side view of the firearm 3402 with a loaded boresight device 3100, in accordance with one or more embodiments of the present disclosure.

In one embodiment, the chamber 3408 may be bounded by the barrel 3414 towards the firing end of the firearm 3402, a recoil buffer 3416 towards the butt of the firearm 3402, and a chamber wall 3418 on the sides.

In another embodiment, the boresight device 3100 is designed to be loaded into the chamber of a firearm (e.g., firearm 3402, or the like) such that the exit port 3112 self-aligns with the axis of the barrel of the firearm upon loading. In this regard, the laser beam 3104 generated by the laser device 3102 may propagate along the axis of the barrel 3414 and out the firing end of the barrel 3414. A user may thus immediately align the laser beam 3104 on a target at a selected distance and align a sighting device to the laser beam 3104 to boresight the firearm without alignment of the laser device 3102 to the barrel 3414.

The boresight device 3100 may include one or more keyed features to facilitate the alignment of the exit port 3112 with the axis of the barrel of the firearm when loaded into the chamber 3408.

In one embodiment, the one or more keyed features include the outer dimensions of the boresight device 3100 (e.g., the outer dimensions of the casing 3108. For example, the outer dimensions of the boresight device 3100 (e.g., the casing 3108) may correspond to those of the bolt carrier group 3404 such that the boresight device 3100 may be firmly secured into the chamber 3408 in a fixed position. In this regard, the laser device 3102 may be roughly the shape of a cylinder with a diameter approximating that of the bolt carrier group 3404. Further, the length of the bolt carrier group 3404 may correspond to the length of the chamber 3408. In this regard, a front face 3124 of the boresight device 3100 including the exit port 3112 may be proximate to or be in contact with the barrel 3414, and a rear face 3126 may be in contact with the recoil buffer 3416.

In another embodiment, a portion of the boresight device 3100 is designed to extend into the barrel 3414 to facilitate self-alignment of the exit port 3112 to the axis of the barrel 3414 when loaded into the chamber 3408. For example, the casing 3108 may include (e.g., as one or more chamfered edges 3128 designed to contact one or more interior portions of the barrel such as, but not limited to, an end face 3420, one or more bolt grooves 3422 (e.g., grooves designed to engage with a bolt during firing of the firearm 3402), a bolt-receiving chamber 3424, a bullet-receiving chamber 3426, or the like. For example, a portion of the casing 3108 may be formed in the shape of a bullet and may be configured to extend into the bullet-receiving chamber 3426 of the barrel 3414 to facilitate alignment of the boresight device 3100 with the axis of the barrel 3414. Further, a portion of the casing 3108 designed in the shape of a bullet may be removable. In this regard, a user may customize the portion of the casing 3108 designed in the shape of a bullet to accommodate firearms suitable for firing any caliber of bullet. In another embodiment, though not shown, the boresight device 3100 is designed to be loaded into the chamber 3408, but not protrude into the barrel 3414.

In another embodiment, the rear face 3126 of the boresight device 3100 is designed to engage with the recoil buffer 3416 such that a recoil spring 3428 firmly secures the boresight device 3100 in the chamber 3408. Further, the boresight device 3100 may contact portions of the chamber wall 3418, the barrel 3414, or the like to provide a secure fit and robust alignment.

In another embodiment, the boresight device 3100 includes one or more keyed features (e.g., rails, grooves, protrusions, cut-outs, or the like) to engage with corresponding components of the firearm 3402 to secure and/or align the boresight device 3100 within the chamber 3408. For instance, keyed features of the boresight device 3100 may include a rail assembly 3130 and/or a notch 3132 to engage with the charging handle 3406. In another instance, keyed features of the boresight device 3100 may include a protrusion to engage with the gas return supply 3430. In another instance, keyed features of the boresight device 3100 may include one or more grooves to engage with bolt grooves 3422. In another instance, keyed features of the boresight device 3100 may include chamfered portions of the casing designed to extend into the barrel 3414 to contact one or more portions of the interior of the barrel 3414.

In another embodiment, the laser power actuator 3106 is accessible to a user when the boresight device 3100 is loaded within the chamber 3408 of the firearm 3402. For example, as illustrated in FIG. 36, the laser power actuator 3106 may be accessible through the chamber door 3412 when opened. By way of another example, the laser power actuator 3106 may engage with the safety switch of the firearm 3402. In this regard, a user may utilize the safety switch to toggle the laser beam 3104 and/or adjust the beam intensity. By way of a further example, the laser power actuator 3106 may engage with the hammer 3432 of the firearm 3402. In this regard, a user may toggle the laser beam 3104 on and off by pulling the trigger 3434.

In another embodiment, the boresight device 3100 includes a pressure-sensitive switch located on the rear face 3126 of the boresight device 3100. Accordingly, pressure from the recoil buffer 3416 provided by the recoil spring 3428 when the boresight device 3100 is loaded into the chamber 3408 engage the pressure-sensitive switch. For example, the pressure-sensitive switch may toggle the laser beam 3104 on only when the boresight device 3100 is loaded and may toggle the laser beam 3104 off otherwise. By way of another example, the pressure-sensitive switch may serve as a safety such that a user may only engage the laser power actuator 3106 to toggle or adjust the intensity of the laser beam 3104 only when the pressure-sensitive switch is engaged (e.g., when the boresight device 3100 is loaded into the firearm 3402).

In another embodiment, at least one laser positioning device 3114 is accessible to a user when the boresight device 3100 is loaded within the chamber 3408 of the firearm 3402. For example, the at least one laser positioning device 3114 may be accessible through the chamber door 3412 when opened. In this regard, a user may make adjustments of the alignment of the laser beam 3104 to the barrel 3414 if required. For example, it may be the case that the boresight device 3100 may not properly self-align during loading such that the laser beam 3104 does not propagate along the axis of the barrel 3414. By way of another example, it may be the case that adjustments may be necessary based on the exact specifications of a particular firearm. Accordingly, a user may adjust the alignment as necessary.

Referring now to FIGS. 38-41, systems and methods for boresighting using the boresight device 3100 are described in greater detail herein. It is contemplated herein that boresighting with the boresight device 3100 may provide multiple advantages over traditional boresighting methods.

As an illustration, a typical method for boresighting a M68 series sight with a borelight configured to be placed in a muzzle of a firearm may require the use of a distance-specific boresight target having two alignment features (e.g., a first alignment feature for aiming and a second alignment feature for boresight alignment). An illustrative typical method for boresighting at a distance of 10 meters in this manner may include the following steps:

1. Check the alignment of a borelight.
   a. Place an appropriate mandrel with the borelight attached in the muzzle of the firearm.
   b. Turn on the borelight so that the laser beam strikes a boresight target offset 10 meters away.
   c. Slowly rotate the borelight one-half turn (180 degrees) while watching the beam on the target area (note any circular pattern made).
   d. If the beam remains stationary, the laser is boresighted, go to step 3 and use the appropriate boresight target for the weapon being boresighted.
   e. If the beam rotates in a circle, adjust the windage or elevation (or both) until the beam remains stationary or rotates on itself, no more than 1 centimeter (go to step 2).
2. Adjust the borelight (if necessary).
   a. Move the target to a distance of 2 meters.
   b. Mark the location of the laser beam.
   c. Slowly rotate the borelight one-half turn.
   d. Note the new location of the laser beam.
   e. Adjust the windage and elevation until the laser beam moves one-half the distance to its original location.
   f. Continue this procedure until the laser beam remains stationary (or spins upon itself within one centimeter) when the bore light is rotated.
   g. Move the target to a distance of ten meters and recheck the boresight (repeat this process at 10 meters if necessary).
3. Boresight the M68 sight to the weapon.
   a. Select a boresight target offset for the appropriate weapon (M16-series rifle, M4 carbine, or M4 modular weapon) and the M68 sight
   b. Position the weapon so the borelight strikes the black dot on the boresight target.
   c. Adjust the M68 sight until the red dot is centered on the cross on the boresight target offset.
   d. The weapon is boresighted when the laser borelight is on the black dot and the red dot (from the M68 sight) is centered on the cross.

However, it is contemplated herein that the above procedure may be overly time-consuming and impractical in many situations. Additionally, the typical approach requires that the user has the correct reflective 10-meter bore-sight target, where the user must maintain two points of aim simultaneously. Such targets may be readily available at a range, but a user in the field may not have the time or resources to follow the typical approach.

It is further contemplated herein that boresighting with the boresight device 3100 may be sufficiently accurate that additional steps to zero the firearm and optical sight (e.g., aligning a point of aim through the optical sight and a point of impact of ammunition fired by the firearm) may not be necessary. In some embodiments, the boresight device 3100 may enable zeroing of a firearm with little to no ammunition, which may provide multiple benefits including, but not limited to, savings of ammunition including the cost thereof, and savings of the time and effort associated with zeroing a firearm. Further, this approach may provide a "true zero," which results in improved accuracy, improved qualification metrics, and immediate effects on intended target(s). Accordingly, for the purposes of the present disclosure, the terms boresighting and zeroing may be used interchangeably. However, the use of the boresight device 3100 does not preclude the use of traditional zeroing steps such as, but not limited to, firing one or more shot groups to validate a zero or making final adjustments based on positions of the shot groups (e.g., to compensate for bullet drop at long distances).

As an illustration, zeroing of a firearm is typically performed using one of the two following methods, each of which may require a minimum of 10-15 rounds of ammunition when performed perfectly and sometimes substantially more in many practical situations.

In a first typical zeroing method, a user simply shoots a shot group to verify the current alignment of the sights/optic to the barrel of the firearm and makes adjustments one at a time until the desired zero is achieved. For example, the following process may be followed:

1. Set up a target at a desired zero distance
2. Fire a first shot group (e.g., 5 rounds) at the desired zero distance to have a measurable shot group to adjust
3. Perform initial adjustments to the optical sight based on positions of shots within the first shot group to align a point of aim with a point of impact
4. Fire an additional shot group
5. Make additional adjustments to the optical sight based on positions of the shots within the additional shot group to align the point of aim with the point of impact
6. Fire a final shot group to validate that zero has been achieved.

It is noted that this method may require at least 15 rounds (for 5-round shot groups) when perfectly followed and may in practice require additional adjustments and shot groups to achieve an accurate zero at the desired distance. For example, steps 4 and 5 may be repeated multiple times to achieve an accurate zero.

In a second typical zeroing method, a user utilizes a traditional laser bore-sight device for initial alignment utilizing an offset between point of aim and point of impact that accounts for the difference between these spots at a desired distance (e.g., an initial distance and a final/long-range distance). The user then uses live fire for shot groups to make a final adjustment for zero validation. For example, the following process may be followed:

1. Set up the firearm for boresighting by attaching a traditional boresight to a firearm per the instructions specific for the type of bore-sigh being used
2. Set up a target at a desired zero distance, where the target is marked to show the appropriate offset between a point of aim and a point of impact provided by the traditional boresight
3. View the target through the optical sight to estimate deviation from zero (e.g., an estimated offset between the point of aim and the point of impact)
4. Make initial adjustment to the optical sight to compensate for the estimated deviation from zero
5. View the target through the optical sight to estimate a remaining deviation from zero and make additional adjustments to the optical sight to achieve an initial alignment if necessary. For example, steps 3 and 4 may need to be repeated to achieve an initial alignment
6. Fire a first shot group (e.g., 5 rounds) to have a measurable group to adjust
7. Perform initial adjustments to the optical sight based on positions of shots within the first shot group to align a point of aim with a point of impact
8. Fire an additional shot group
9. Make additional adjustments to the optical sight based on positions of the shots within the additional shot group to align the point of aim with the point of impact
10. Fire a final shot group to validate that zero has been achieved.

It is noted that this method may require at least 10 rounds (for 5-round shot groups) when perfectly followed and may in practice require additional adjustments and shot groups to achieve an accurate zero at the desired distance.

Figure 38:
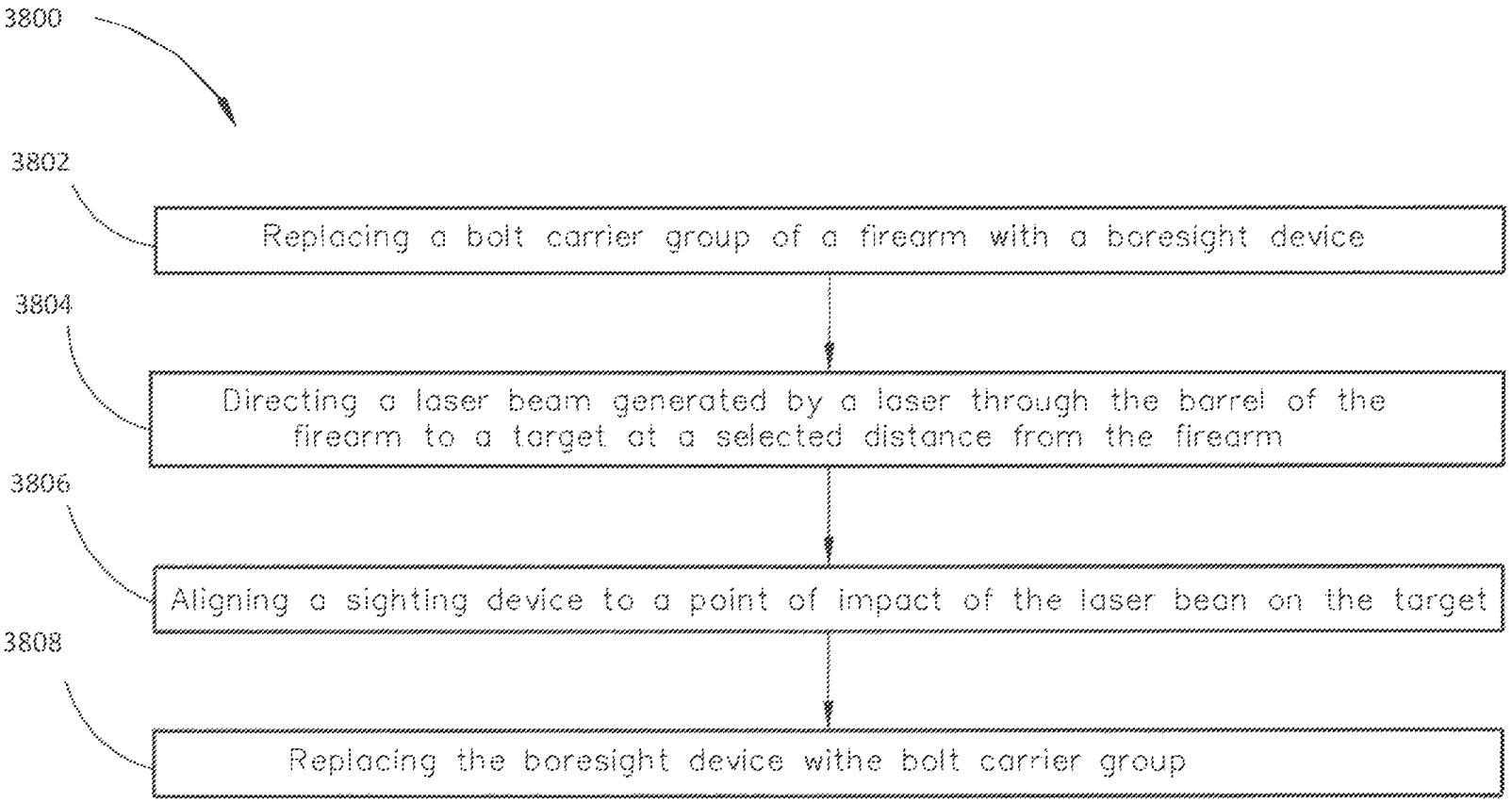
FIG. 38 is a flow diagram illustrating a method for boresighting a firearm using a boresight device, in accordance with one or more embodiments of the present disclosure.

FIG. 38 is a flow diagram illustrating a method 3800 for boresighting a firearm using a boresight device located in place of a bolt carrier group, in accordance with one or more embodiments of the present disclosure. Applicant notes that the embodiments and enabling technologies described previously herein in the context of boresight device 3100 should be interpreted to extend to method 3800. It is further noted, however, that the method 3800 is not limited to the architecture of boresight device 3100.

In one embodiment, the method 3800 includes a step 3802 of replacing a bolt carrier group of a firearm with a boresight device (e.g., boresight device 3100). For example, the boresight device may be loaded into the chamber in the place of a bolt carrier group. Accordingly, a user may first unload the bolt carrier group (e.g., with the charger handle), and replace the bolt carrier group with the boresight device.

In another embodiment, the boresight device includes a laser device for generating a laser beam and an exit port from which the laser beam may exit the boresight device. Further, the boresight device may self-align the exit port of the boresight device to the axis of the barrel when loaded into the chamber without requiring adjustment from the user. In this regard, the laser beam may propagate along the axis of the barrel and out the firing end of the barrel to indicate a direction at which the barrel is pointed. For example, the boresight device may have dimensions and/or keyed features designed to engage with components of the firearm during loading to align the exit port to the axis of the barrel.

In another embodiment, the method 3800 includes a step 3804 of directing a laser beam generated by a laser through the barrel of the firearm to a target at a selected distance from the firearm. In this regard, the user may establish the direction at which the barrel is pointed.

In another embodiment, the method 3800 includes a step 3806 of aligning a sighting device to a point of impact of the laser beam on the target. The user may thus align the sighting device to the barrel of the target.

In another embodiment, the method 3800 includes a step 3808 of replacing the boresight device with the bolt carrier group. After boresighting the firearm, the user may return the firearm to operational status such that the firearm is ready to fire ammunition. For example, the user may replace the boresight device with the bolt carrier group removed in step 3802.

As necessary, the user may perform further steps to zero the firearm at any distance using any method known in the art. For example, the user may fire one or more rounds of ammunition and adjust the optical sight to align a point of aim with the point of impact to further refine the alignment of the optical sight with the firearm. It is recognized herein that boresighting the firearm using method 3800 prior to firing ammunition may improve the speed at which firearms may be zeroed and reduce the amount of ammunition wasted during the zeroing process.

Further, in contrast to the typical boresighting and zeroing approaches above, the method 3800 is substantially more efficient. For example, a well-trained shooter can complete the Army bore-sight process in approximately 5-10 minutes per rifle, whereas the method 3800 may be completed in a substantially shorter timeframe such as, but not limited to, 30-45 seconds per rifle.

Additionally, in contrast to the typical approaches requiring a correct distance-specific target that forces a user to maintain two points of aim simultaneously, the systems and methods disclosed herein are simpler and more accurate. For example, the laser of a boresight device 3100 may reach a distance of 25 meters and beyond (e.g., 100 meters, 1000 meters, or beyond). As such, the user does not need a target, but rather only needs a suitable background object located at the correct distance.

Figure 39B:
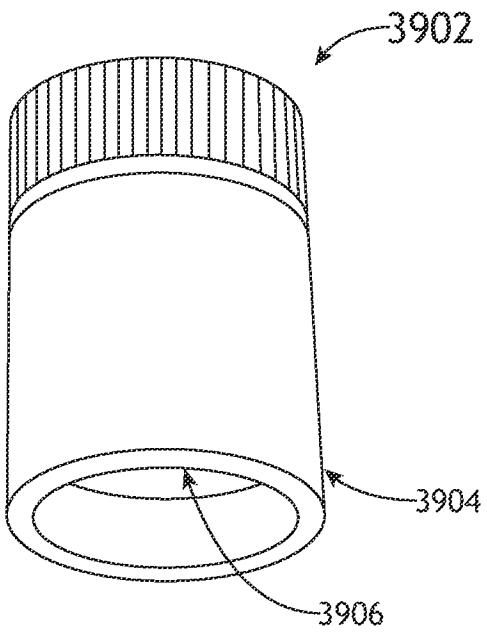
FIG. 39B is a second perspective view of a windage and elevation adjustment tool, in accordance with one or more embodiments of the present disclosure.
Figure 39A:
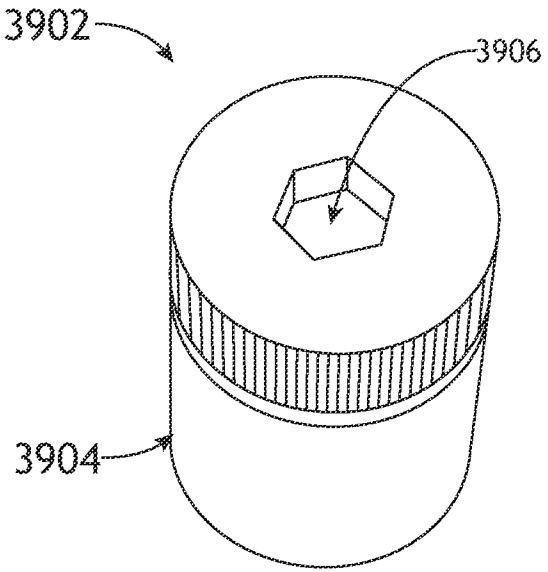
FIG. 39A is a first perspective view of a windage and elevation adjustment tool, in accordance with one or more embodiments of the present disclosure.

Referring now to FIGS. 39A and 39B, an adjustment tool for an optical sight is described in accordance with one or more embodiments of the present disclosure. FIG. 39A is a first perspective view of a windage and elevation adjustment tool 3902, in accordance with one or more embodiments of the present disclosure. FIG. 39B is a second perspective view of a windage and elevation adjustment tool 3902, in accordance with one or more embodiments of the present disclosure. It is contemplated herein that the windage and elevation adjustment tool 3902 may enable convenient adjustment of an optical sight such as, but not limited to, adjustments to the windage and elevation settings. It is further contemplated herein that many optical sights include one or more adjustment screws located within adjustment turrets that may be protected by a cover that may optionally be attached to the optical sight by screw threads. In one embodiment, the tool 3902 includes an outer sleeve 3904 with a screwdriver bit 3906 that is centered and recessed into the outer sleeve 3904. The outer sleeve 3904 may be sized to slip over an exposed portion of the adjustment turret on the optical sight such as, but not limited to, an exposed threaded portion of the adjustment turret for securing a cover or cap. In this way, the outer sleeve 3904 may enable accurate and stable positioning of the screwdriver bit 3906 with the adjustment screw of the optical sight. In some cases, the tool 3902 may enable adjustments from behind the firearm while the user is looking through the optical sight. Further, this tool 3902 makes the adjustments much more efficient and allows the operator to easily make large corrections as well as fine corrections in which they need to feel and count each adjustment click. Additionally, the tool 3902 may be used for any optical sight having removable windage and elevation caps in which the windage and elevation is adjusted via a slot or screw type adjuster including, but not limited to, M-68 series optics.

Figure 40A:
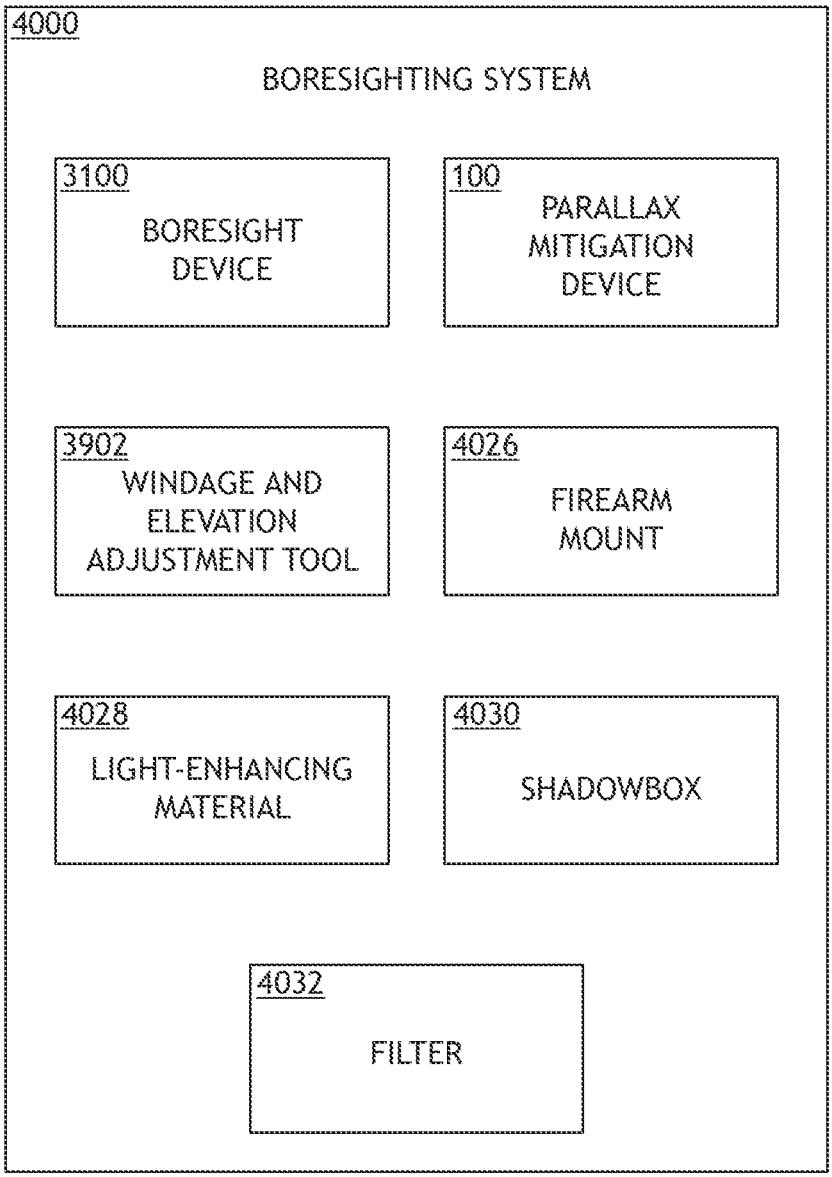
FIG. 40A is a block diagram view of a boresighting system in accordance with one or more embodiments of the present disclosure.
Figure 40B:
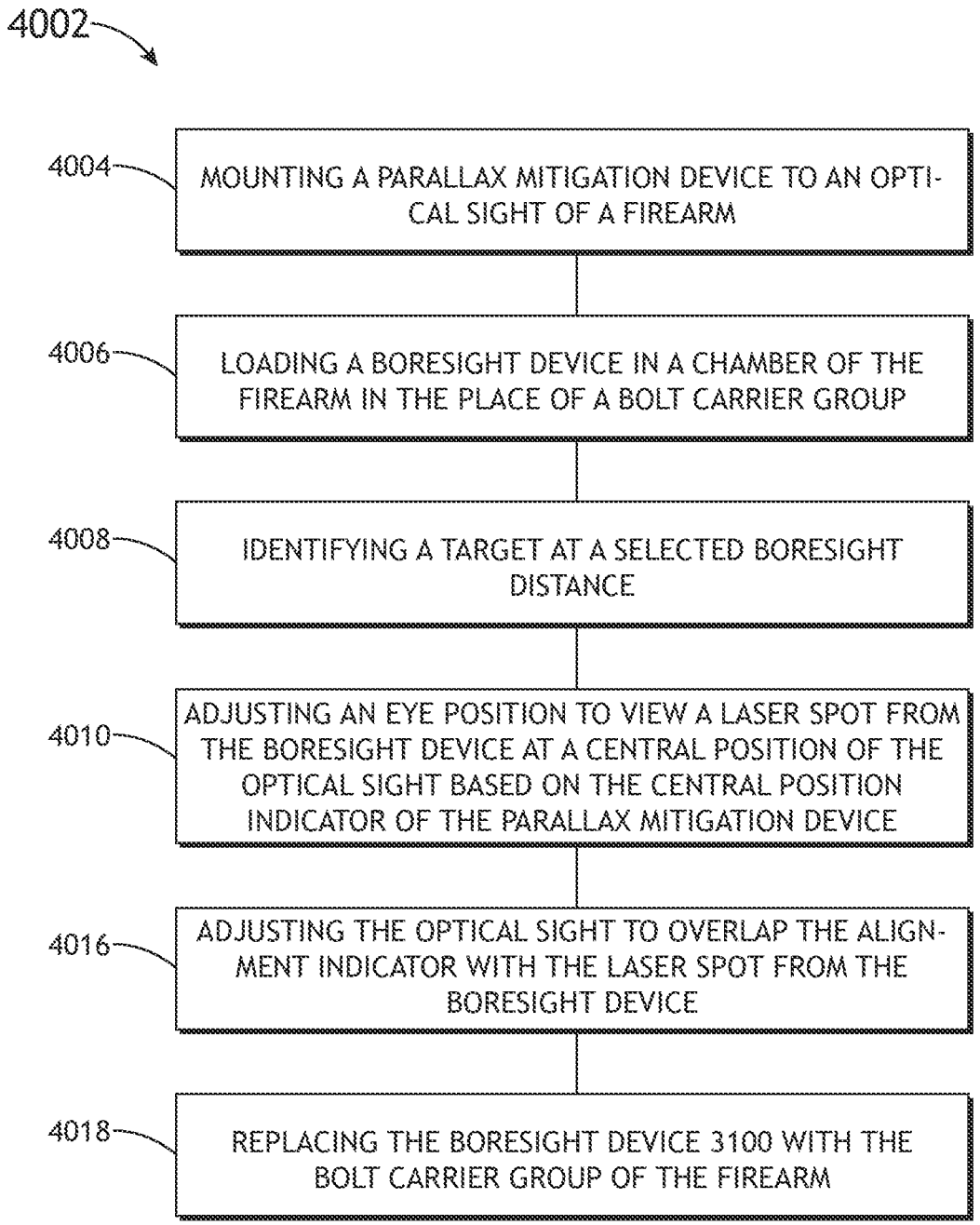
FIG. 40B is a flow diagram illustrating a method for boresighting with a boresight device and a parallax mitigation device, in accordance with one or more embodiments of the present disclosure.
Figure 40D:
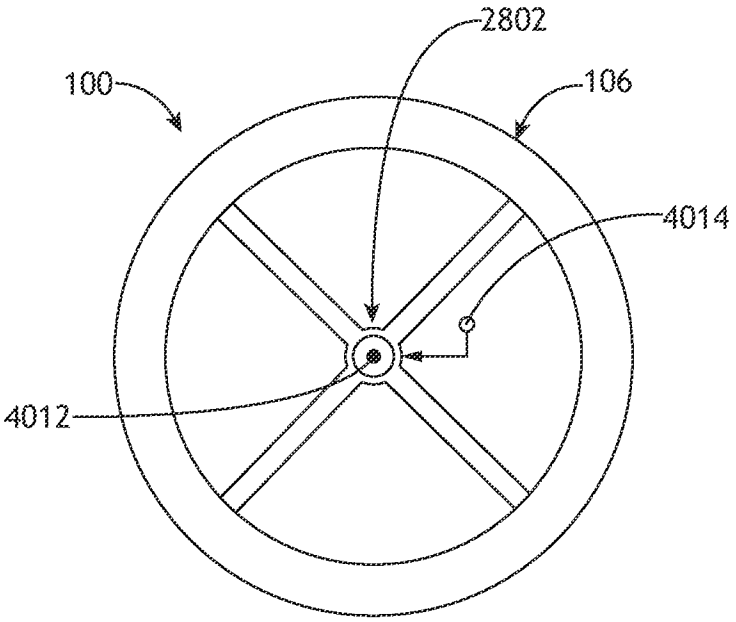
FIG. 40D is the image of FIG. 4C with an illustrative arrow indicating a desired movement of the alignment indicator of the optical sight during boresighting, in accordance with one or more embodiments of the present disclosure.
Figure 40C:
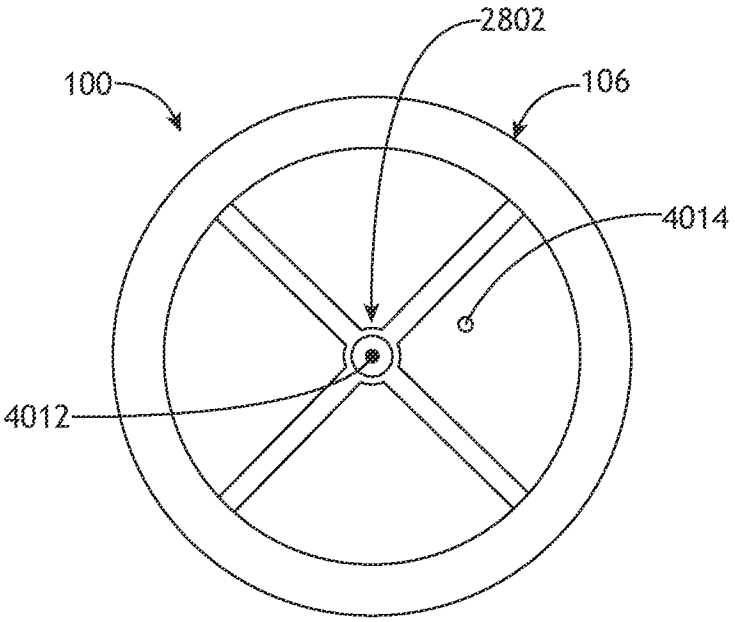
FIG. 40C is an image through an optical sight with a parallax mitigation device installed illustrating a laser spot associated with a laser beam from the boresight device centered in a central position indicator 2802 of the parallax mitigation device, in accordance with one or more embodiments of the present disclosure.
Figure 40E:
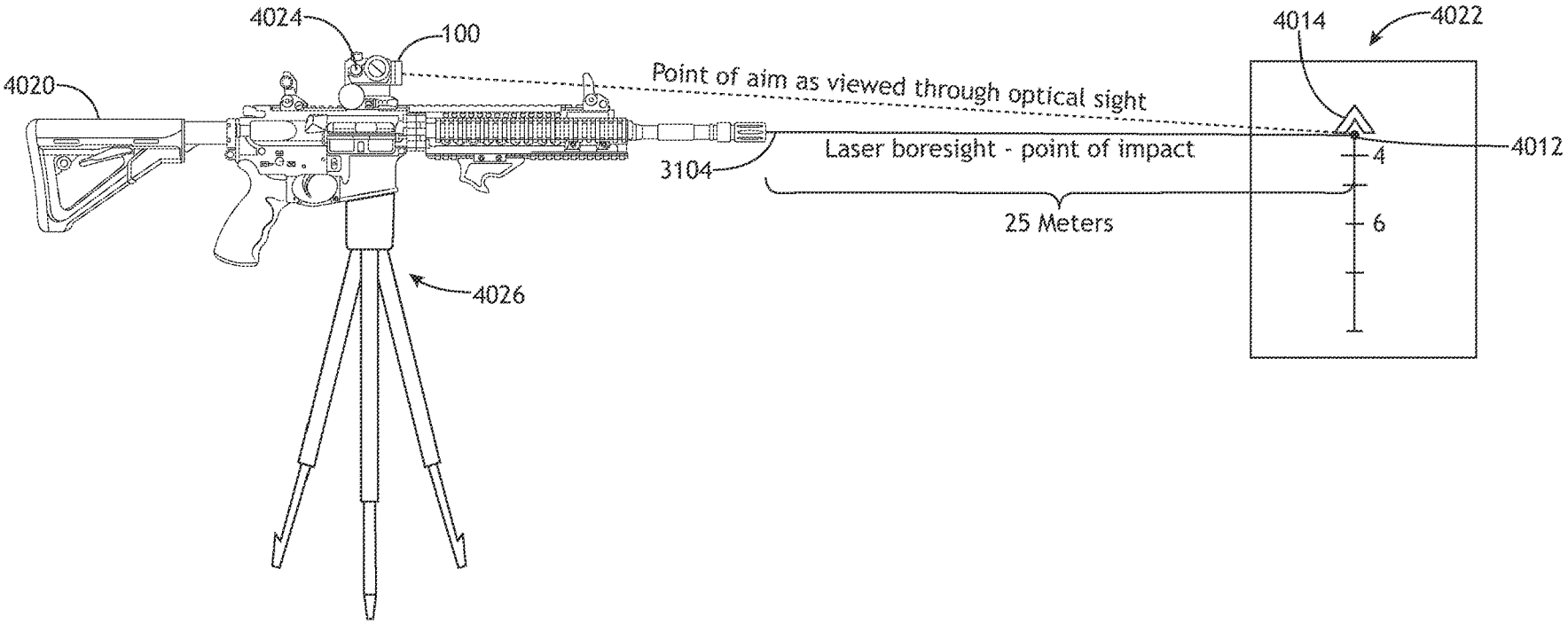
FIG. 40E is a conceptual illustration of sighting the firearm using an installed boresight device on a target at a range of 25 meters, where the view on the target is illustrated as seen through the optical sight, in accordance with one or more embodiments of the present disclosure.
Figure 40F:
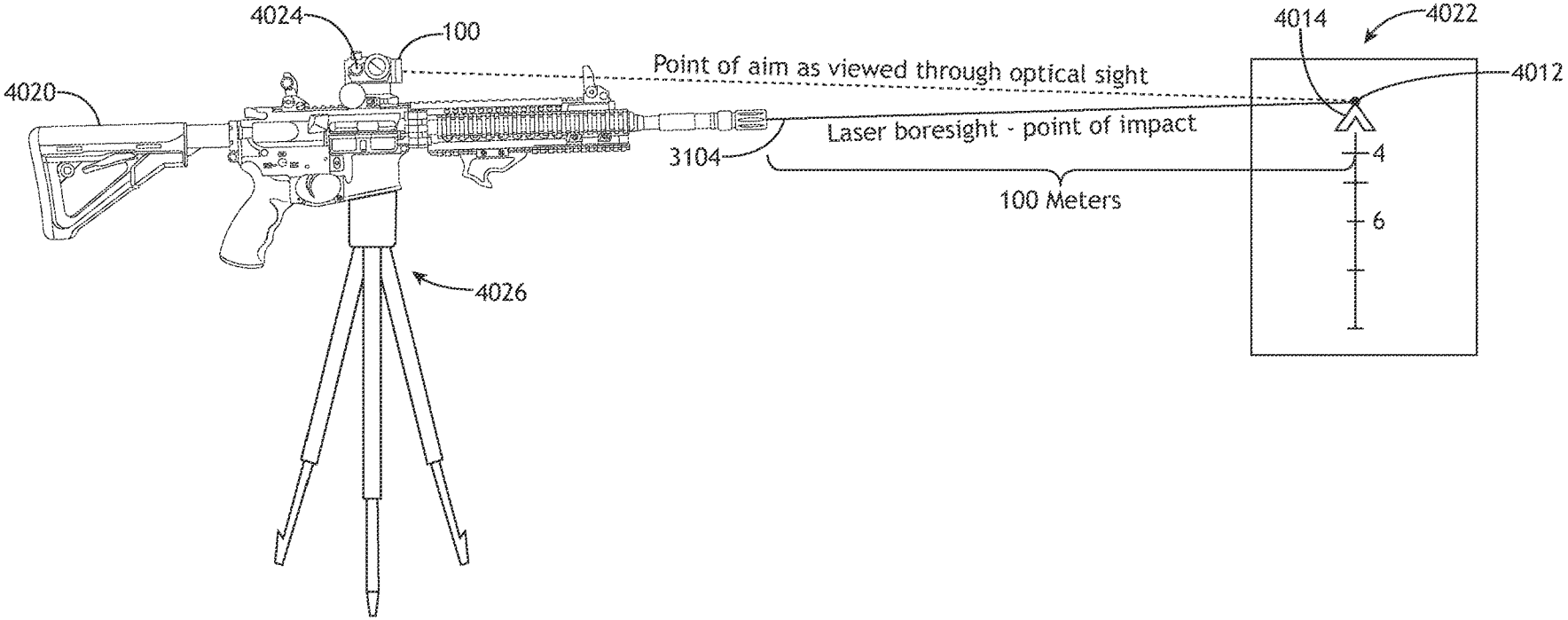
FIG. 40F is a conceptual illustration of sighting the firearm using the installed boresight device on the target at a range of 100 meters, where the view on the target is illustrated as seen through the optical sight, in accordance with one or more embodiments of the present disclosure.
Figure 41:
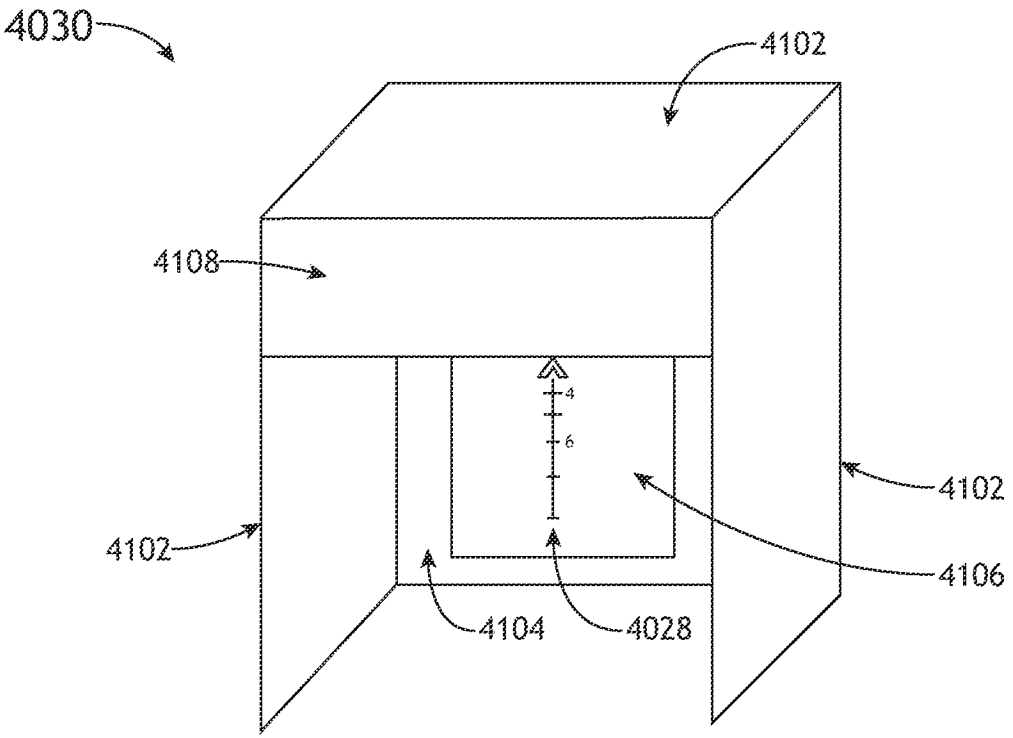
FIG. 41 is a conceptual view of a shadowbox in accordance with one or more embodiments of the present disclosure.

Referring now to FIGS. 40A-41, systems and methods for boresighting with a boresight device 3100 and a parallax mitigation device 100 are described in accordance with one or more embodiments of the present disclosure. It is contemplated herein that the use of a boresight device 3100 and a PMD 100 in combination may enable boresighting at greater distances than achievable without this combination. For example, the systems and methods disclosed herein may be suitable for accurate boresighting at distances between 100 and 1000 meters.

FIG. 40A is a block diagram view of a boresighting system 4000 in accordance with one or more embodiments of the present disclosure. In one embodiment, the boresighting system 4000 includes a boresight device 3100 a parallax mitigation device 100.

As described previously herein, a boresight device 3100 located in a chamber of a firearm (e.g., chamber 3408 in FIGS. 34-37) in place of a bolt carrier group 3404 may facilitate accurate boresighting of a firearm by self-aligning a laser beam 3104 with the barrel of the firearm. In this way, the location of a laser spot associated with the laser beam 3104 on a target may accurately represent the point of impact of the bullet when bullet drop is negligible or within an accuracy tolerance. As described with respect to the method 3800, boresighting or zeroing of the firearm at a selected boresight distance may be achieved by aligning an optical sight to a laser spot from the boresight device 3100 on a target at the selected boresight distance. Further, the target need not be a traditional sighting target, but may be any object located at the selected boresight distance.

However, it is contemplated herein that parallax induced by the optical sight may nonetheless pose challenges to a user when performing the boresight process and further contemplated herein that a parallax mitigation device 100 attached to the optical sight may overcome these challenges.

Additionally, it is contemplated herein that the boresight device 3100 and the parallax mitigation device 100 may be used in combination for zero re-validation or confirmation. For example, a soldier and their unit may typically boresight and zero their rifles prior to a movement or deployment. During transport to this deployment, weapons may be stored or handled roughly such that that the zero adjustments previously applied to the weapon and optic may have been compromised. The traditional way to ensure that the zero is good is to perform a validation fire at the destination. Often in current operating environments, there is no range readily available or time frames do not allow for this.

FIG. 40B is a flow diagram illustrating a method 4002 for boresighting with a boresight device (e.g., boresight device 3100) and a parallax mitigation device 100, in accordance with one or more embodiments of the present disclosure.

In one embodiment, the method 4002 includes a step 4004 of mounting a parallax mitigation device 100 to an optical sight of a firearm. Any type of optical sight may be used including, but not limited to, a red dot sight, a reflex sight, or a magnified optical sight. Further, as described previously herein, a parallax mitigation device 100 may include a central position indicator 2802 providing a visual indication of a central position of the parallax mitigation device 100 and thus a visual indication of a central position of the optical sight to the user when viewing through the optical sight. Additionally, the optical sight may include an alignment indicator, which may be indicative of a point of aim. For example, an alignment indicator of a red dot style sight may provide an illuminated dot, which may be, but is not required to be red, to the user. By way of another example, an alignment indicator of a magnified optic may include a reticle pattern.

In another embodiment, the method 4002 includes a step 4006 of loading a boresight device 3100 in a chamber of the firearm in the place of a bolt carrier group. In another embodiment, the method 4002 includes a step 4008 of identifying a target at a selected boresight distance. For example, the selected boresight distance may be 25 meters, 100 meters, 1000 meters, or more. It is contemplated herein that the method 4002 may enable accurate boresighting at distances greater than achievable without the combination of the boresight device 3100 and the parallax mitigation device 100.

In another embodiment, the method 4002 includes a step 4010 of adjusting an eye position (e.g., of a user) to view a laser spot from the boresight device 3100 at the central position of the optical sight based on the central position indicator of the parallax mitigation device 100. In this way, the parallax mitigation device 100 may ensure proper eye position of the user and may mitigate parallax by the optical sight.

FIG. 40C is an image through an optical sight with a parallax mitigation device 100 installed illustrating a laser spot 4012 associated with a laser beam 3104 from the boresight device 3100 centered in a central position indicator 2802 of the parallax mitigation device 100, in accordance with one or more embodiments of the present disclosure. FIG. 40C further illustrates a red dot alignment indicator 4014 associated with a red dot sight, though it is to be understood that this is merely an illustration and any suitable alignment indicator from any style of optical sight may be provided within the spirit and scope of the present disclosure.

As illustrated in FIG. 40C, a typical first view through the optical sight may reveal that the point of alignment associated with the location of the alignment indicator 4014 is not overlapped with the point of impact associated with the laser spot 4012. In another embodiment, the method 4002 includes a step 4016 of adjusting the optical sight (e.g., using the windage and/or elevation of the optical sight) to overlap the alignment indicator 4014 with the laser spot 4012 from the boresight device 3100. As described previously herein, the method 4002 may be implemented using any type of optical sight. For example, in the case of a red dot sight illustrated in FIG. 40C, the step 4016 may include adjusting the red dot alignment indicator 4014 to overlap the laser spot 4012 from the boresight device 3100. By way of another example, in the case of a magnified optical sight, the step 4016 may include adjusting the reticle pattern to overlap the laser spot 4012 from the boresight device 3100.

FIG. 40D is the image of FIG. 4C with an illustrative arrow indicating a desired movement of the alignment indicator 4014 of the optical sight during boresighting, in accordance with one or more embodiments of the present disclosure. It is contemplated herein that the exact position of the alignment indicator 4014 may vary based on an eye position of the user relative to the optical sight due to parallax. As a result, accurately adjusting the alignment indicator 4014 to overlap the laser spot 4012 may require highly accurate control of the eye placement of the user. However, the use of the parallax mitigation device 100 may substantially ease the burden on the user. For example, the parallax mitigation device 100 may provide a guide for the user for accurate eye positioning to mitigate parallax by the optical sight. In particular, adjusting the eye position to view the laser spot 4012 in the center of the central position indicator 2802 and thus the center of the optical sight results in accurate eye positioning for the mitigation of parallax. In this way, the user may keep this eye position while adjusting the optical sight to accurately overlap the alignment indicator 4014 with the laser spot 4012 (or iteratively adjust the optical sight and easily return to this eye position) without parallax from the optical sight.

In another embodiment, the method 4002 includes a step 4018 of replacing the boresight device 3100 with the bolt carrier group of the firearm. At this point, the firearm is accurately boresighted for the selected boresight distance and may further be zeroed to a selected tolerance due to the accuracy of the boresight process. However, a user may optionally perform further steps to zero the firearm such as, but not limited to, firing one or more shot groups at a suitable target and making additional adjustments to the optical sight to align the point of aim of the optical sight (e.g., the alignment indicator 4014) with the actual point of impact as determined by a shot group. In particular, it is contemplated herein that the method 4002 may provide accurate alignment of the laser spot 4012 from the boresight device 3100 and the alignment indicator 4014 of the optical sight for distances at which bullet drop becomes non-negligible. In such cases, the user may perform additional zeroing actions with or without ammunition to compensate for the bullet drop at a selected distance.

It is further contemplated herein that the method 4002 above may have numerous benefits including, but not limited to, ammunition savings, time savings, eye-safe operation at extended distances, flexibility for use with both civilian and military sights/optics, and applicability for use with many types of firearms including, but not limited to, machine guns.

In some applications, it may be the case that that the optical sight is sufficiently far out of alignment at a desired boresight or zeroing distance that multiple iterations of the method 3800 or the method 4002, or any portion or combination thereof, may be necessary at successively increasing distances. In this way, operations at relatively shorter distances may enable the user to iteratively improve the alignment accuracy. Using traditional boresighting or zeroing techniques, this is commonly referred to as "getting on paper." However, it is contemplated herein that boresighting using the method 3800 and/or method 4002 may be carried out without "paper" or a dedicated target, though the general technique may still be utilized. Further, such operations may be carried out without ammunition such that ammunition-free boresighting or zeroing is possible based on the systems and methods disclosed herein. However, as described previously herein, the user may optionally utilize ammunition to verify and/or refine the alignment at the desired distance.

As an illustration, ammunition-free zeroing at a distance of 100 meters may be carried out by 1) performing the method 3800 and/or the method 4002 or portions thereof (e.g., boresighting with the boresight 3100 with or without a parallax mitigation device 100 installed on an optical sight of the firearm) at an initial target distance such as, but not limited to, 25 meters, and 2) performing the method 3800 and/or the method 4002 or portions thereof at the final distance of 100 meters. FIG. 40E is a conceptual illustration of sighting the firearm 4020 using an installed boresight device 3100 (not shown) on a target 4022 at a range of 25 meters, where the view on the target 4022 is illustrated as seen through the optical sight 4024, in accordance with one or more embodiments of the present disclosure. In FIG. 40E, the target includes a paper target, though any object at the selected distance may be utilized. FIG. 40F is a conceptual illustration of sighting the firearm 4020 using the installed boresight device 3100 (not shown) on the target 4022 at a range of 100 meters, where the view on the target 4022 is illustrated as seen through the optical sight 4024, in accordance with one or more embodiments of the present disclosure. In FIG. 40F, the point of aim 4012 is adjusted relative to the reticle alignment indicator 4014 as appropriate for the distance and the reticle type. Further, a parallax mitigation device 100 is installed on the optical sight 4024 in FIGS. 40E and 40F.

However, it is to be understood that this is merely an illustration. In many applications, the method 3800 and/or the method 4002 may be sufficiently accurate to boresight or zero the firearm at any selected distance including, but not limited to, 100 meters without requiring iterations at shorter distances.

Referring now again to FIG. 40A, additional components suitable for boresighting a firearm are described in greater detail in accordance with one or more embodiments of the present disclosure. In some embodiments, the use of any combination of such components with the boresight device 3100 and/or the parallax mitigation device 100 may facilitate long-range boresighting such as, but not limited to, distances of 100 meters or greater.

In one embodiment, the boresighting system 4000 includes the windage and elevation adjustment tool 3902 (e.g., as illustrated in FIGS. 39A and 39B). For example, the windage and elevation adjustment tool 3902 may facilitate precise adjustments of an optical sight while performing the method 3800 and/or the method 4002. In particular, the windage and elevation adjustment tool 3902 may enable the user to make adjustments while viewing a target through the optical sight, which may enable efficient and accurate adjustments with a consistent eye position. Further, the windage and elevation adjustment tool 3902 may enable fine adjustments without moving or bumping the firearm and/or optical sight.

In another embodiment, the boresighting system 4000 includes a firearm mount 4026 such as, but not limited to, a tripod mount. A firearm mount 4026 may secure a firearm using any of a variety of techniques within the spirit and scope of the present disclosure. In some embodiments, a firearm mount 4026 includes mounting component shaped as a magazine for the firearm. In this way, the firearm may rest on the mounting component, which takes the place of a magazine. As an illustration FIGS. 40D and 40E illustrate a firearm mount 4026 securing the firearm 4020 using a mounting component (hidden from view) taking the place of a magazine. The firearm 4020 may further include one or more clamps or fasteners to secure the firearm to the firearm mount 4026. It is contemplated herein that such a design may facilitate efficient zero-ammunition boresighting or zeroing as described throughout the present disclosure. In some embodiments, the firearm mount 4026 enables the user to perform any of the steps of the method 3800 and/or the method 4002 from a standing position.

In another embodiment, the boresighting system 4000 includes a laser visibility enhancing material 4028. A laser visibility enhancing material 4028 may include any material providing enhanced visibility of the laser spot 4012 from the boresight device 3100 and/or the alignment indicator 4014 provided by the optical sight.

In another embodiment, the laser visibility enhancing material 4028 includes a light-enhancing material sensitive to or operational at the wavelength of the laser used in the boresight device 3100 and/or a laser sight to increase visibility of the associated laser dot(s) to the user. For example, in the case that the boresight device 3100 includes a laser device 3102 emitting a green laser beam 3104, the light-enhancing material may enhance visibility of at least green wavelengths. In this way, the use of a laser visibility enhancing material 4028 as a target when performing the method 3800 and/or the method 4002 may enable boresighting at greater distances than achievable without the laser visibility enhancing material 4028 based on the increased visibility of a laser spot associated with the boresight device 3100.

The laser visibility enhancing material 4028 may operate to enhance the visibility of incident laser dots using any technique known in the art including, but not limited to, retroreflectivity, luminescence, fluorescence, phosphorescence, or the like. For example, the light-enhancing material may include any combination of materials or structures designed to enhance the intensity of retroreflected light back to the user. By way of another example, the laser visibility enhancing material 4028 may absorb a portion of the incident laser beam 3104 and may emit light at the same or a different wavelength to enhance the visibility of the laser dot to the user.

The laser visibility enhancing material 4028 may include any material or combinations of materials known in the art suitable for enhancing the visibility of laser dots to the user. For example, the light-enhancing material may include, but is not limited to, Scotchlite™ reflective material from 3M™. By way of another example, the light-enhancing material may be formed from any combination of fabric or rigid materials to increase the visibility of laser dots to the user.

In another embodiment, the boresighting system 4000 includes a shadowbox 4030. FIG. 41 is a conceptual view of a shadowbox 4030 in accordance with one or more embodiments of the present disclosure.

In one embodiment, shadowbox 4030 includes one or more side walls 4102 surrounding a rear wall 4104 for securing a target 4106. Further, the shadowbox 4030 may include a front plate 4108 facing the user. In this regard, any of the side walls 4102 or the front plate 4108 may at least partially block direct or indirect light from reaching the target 4106 to enhance the visibility of laser dots (e.g., from the boresight device 3100, a laser sight, or the like) to the user.

It is contemplated herein that both the laser visibility enhancing material 4028 and the shadowbox 4030 are intended to improve long-range boresighting or zeroing by enhancing the visibility of at least at target spot associated with the boresight device 3100 to the user at a desired distance. In a general sense, the laser visibility enhancing material 4028 or the shadowbox 4030 may either be used alone or in combination. As an illustration of combined use, FIG. 41 illustrates the use of a laser visibility enhancing material 4028 as the target 4106. For example, when used in the context of the method 3800 and/or method 4002 (e.g., boresighting using the boresight device 3100 with or without the parallax mitigation device 100), the laser visibility enhancing material 4028 or the shadowbox 4030, alone or in combination, may enable boresighting or zeroing at ranges of 300 meters or more (e.g., up to 1000 meters or more based on the conditions).

In another embodiment, the boresighting system 4000 includes a filter 4032 for increasing the visibility of a laser spot associated with the boresight device 3100 on a target. Such a filter 4032 may be utilized by the user in a variety of ways. In one embodiment, the filter 4032 is attached to the sight at either the objective or ocular end. In another embodiment, the filter 4032 is integrated into glasses to be work by the user.

In one embodiment, the filter 4032 is a spectral filter. For example, the filter 4032 may include a bandpass filter designed to pass the wavelength of the laser light and suppress other wavelengths. It is recognized herein, however, that suppression of visible wavelengths other than the laser wavelength may decrease the ability of the user to view the target itself. Accordingly, an amount of suppression of visible wavelengths other than the laser wavelength may be selected to balance the benefit of increasing visibility of the laser spot on the target with the need to view the target itself. As an illustration, the filter 4032 may selectively pass wavelengths associated with the laser beam 3104 of the boresight device 3100 with a first transmissivity range and selectively pass visible light with a second transmissivity range. This second transmissivity may be lower than the first transmissivity, but may be greater than zero such that the user may still view the target and other objects.

In another embodiment, the filter 4032 is a polarization filter. For example, the filter 4032 may be adjusted to reject polarizations of light commonly found in an environment of interest that may be considered background or noise. For instance, it is recognized herein that the polarization of light reflected from many surfaces is horizontally polarized. Accordingly, in some embodiments, the filter 4032 is oriented to suppress horizontally-polarized light and pass vertically polarized light. In this regard, the visibility of the laser spot may be increased.

It is contemplated herein that the boresighting system 4000 may include any combination of a boresight device 3100, a parallax mitigation device 100, a windage and elevation tool 3900, a laser visibility enhancing material 4028, a shadowbox 4030, or a filter 4032. Similarly, the method 3800 and/or the method 4002 may be performed with any combination of a windage and elevation tool 3900, a laser visibility enhancing material 4028, a shadowbox 4030, or a filter 4032. In a general sense, the range at which boresighting may be achieved may depend on the visibility of the laser spot of the boresight device 3100, which may be impacted by a wide range of conditions including, but not limited to, weather, lighting conditions, the color of the target, the material forming the target, or divergence of the laser with distance. Accordingly, the various components of the boresighting system 4000 may enhance the visibility of at least the laser spot of the boresight device 3100 such that boresighting may be achieved at distances greater than possible otherwise.

Additional embodiments of the present disclosure are directed to methods for performing range operations. In some embodiments, the users are soldiers. It is to be understood that not all steps are required and that the order of the steps presented below is not mandatory and is merely a non-limiting illustration. Further, although the method below describes operations of the boresight device 3100 and the parallax mitigation device 100 by multiple users, it is to be understood that the method may be adapted for a single user.

First, users arrive and set up equipment.

Second, users receive a safety brief and guidelines for range conduct from range officials.

Third, users are placed in firing orders and have a Bore Obstruction Check completed prior to entering the actual firing line. In particular, the following steps may be performed.

User clears rifle.

User removes the rear take down pin allowing the rifle to be "shot gunned" by pivoting the upper receiver on the front take down pin.

User removes the bolt carrier group allowing a visual inspection of the rifle bore.

Fourth, a bore-sight station is set up based on some or all of the following:

Parallax mitigation devices 100 are distributed to users and installed in place of an anti-reflective device Users remove the windage and adjustment caps in preparation for the bore-sighting process Users identify suitable backgrounds at the same distance as the group and zero range (e.g., 25 meters)

Boresight devices 3100 are issued to one or more users. These boresight devices 3100 may be rotated to the remaining users as they proceed through the station.

Fifth, the boresighting process may be carried out using any combination of components of the boresighting system 4000 in accordance with the method 3800 and/or method 4002 at the desired distance.

Throughout this process the lasers may be rotated from user to user as described below. Initially the first two users in line for bore obstruction check may be issued boresight devices 3100 which are inserted in place of the bolt carrier group of the firearm. The first user places their rifle on a tripod or other platform (e.g., the firearm mount 4026) and begins the bore-sighting process. When the first user completes the bore-sighting process, they remove their rifle from the platform and the second user in line mounts their rifle on the bore-sighting platform and begins this process. While the second user is completing the bore-sighting process, the first user removes the boresight device 3100 from their rifle handing it to the next user in line who prepares their rifle for bore-sighting as previously described and waits for the second user to complete the task. The first user then replaces the bolt carrier in their rifle and takes their place in the firing order. When the second user completes the bore-sighting process they take the same steps that the first user did thus continuing the rotation in an efficient manner.

Referring now to FIGS. 42A-44, a universal connector for attaching one or more accessories to a firearm sight or other optic attached to a firearm is described in accordance with one or more embodiments of the present disclosure.

It is recognized herein that it is often desirable to attach one or more accessories to firearm optics (e.g., firearm sights and the like). These accessories may include, but are not limited to, a cover for protecting the optics, a spectral filter, an anti-reflection device (ARD), or a parallax mitigation device 100. Such accessories may typically be attached to the optic using threads present on the optic casing or through the use of elastic bands. However, repeated attachment and detachment of the assemblies can result in wear that may limit the lifetime of the optic and/or the accessory. For example, threads on the optic casing may be stripped or otherwise damaged in a way that prevents further use of the accessories. By way of another example, elastic bands used to secure optics may deteriorate or loosen over time such that the connection between the optic and the accessories may become less stable. Additionally, in the case that a cover is used for protection of the optic, this cover must typically be removed or worked around when attaching accessories. Depending on the method of attachment, this may not only be a nuisance, but may also reduce the lifespan of the cover and/or the optic.

Figure 42A:
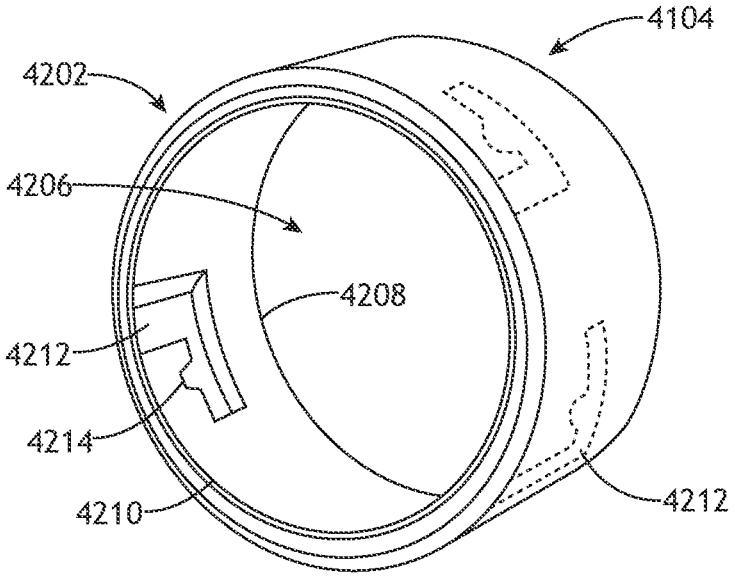
FIG. 42A is a perspective view of a connector suitable for attachment to a firearm sight and providing for the attachment of one or more accessories, in accordance with one or more embodiments of the present disclosure.

FIG. 42A is a perspective view of a connector 4202 suitable for attachment to a firearm sight and providing for the attachment of one or more accessories, in accordance with one or more embodiments of the present disclosure. In some embodiments, the connector 4202 is includes a casing 4204 shaped as a hollow cylinder or extended ring suitable for attaching to the sight and providing an opening 4206 (e.g., the hollow portion of the hollow cylinder) to allow for normal operation of the sight. However, it is to be understood that the connector 4202 is not limited to the hollow cylindrical shape illustrated in FIG. 42A and that the connector 4202 may generally have any suitable shape having an opening 4206 to allow light to pass to and from the sight. Further, the shape of the connector 4202 need not be uniform along its length.

In some embodiments, the connector 4202 includes a male coupler 4208 suitable for coupling to the sight. The male coupler 4208 may couple to the sight using any technique known in the art. For example, as illustrated in FIG. 42A, the male coupler 4208 may be shaped to slip over or within a casing of the sight. By way of another example, the male coupler 4208 may include threads suitable for coupling with corresponding threads on the sight.

In some embodiments, the connector includes a female coupler 4210 suitable for coupling to an accessory such as, but not limited to, a cover for protecting the optics, a spectral filter, an anti-reflection device (ARD), or a parallax mitigation device 100. The female coupler 4210 may couple to an accessory using any technique known in the art.

For example, as illustrated in FIG. 42A, the female coupler 4208 may include one or more female keyed features 4212 (e.g., grooves, protrusions, or the like) suitable for coupling with corresponding keyed features on an accessory. In the particular non-limiting example illustrated in FIG. 42A, the female keyed features 4212 include one or more L-shaped or cornered grooves in the casing. In this regard, an accessory having one or more protrusions sized to fit within the grooves may be coupled to the connector 4202 by inserting the accessory with the keyed features lined up and rotating the accessory to secure the accessory. Further, in some embodiments, the female keyed features 4212 may include a recession 4214 in a cornered groove to further secure and stabilize the accessory while coupled to the connector 4202.

By way of another example, the female coupler 4208 may include threads to connect to an accessory. By way of a further example, the female coupler 4208 may be designed to couple with accessories through a friction-fit, snap-fit, or any other coupling technique known in the art.

It is contemplated herein that the connector 4202 may be permanently or semi-permanently attached to the sight during use and/or storage. For example, the male coupler 4208 may remain secured to the sight for any length of time during storage or operation of the firearm. Further, accessories may be attached or detached from the female coupler any number of times without placing any strain or wear on the sight itself. In this regard, the sight may not be damaged by repeated attachment and detachment of any accessories. Rather, any wear may be limited to the accessories themselves and/or the connector 4202, which may be easily replaced if damaged.

Figure 42B:
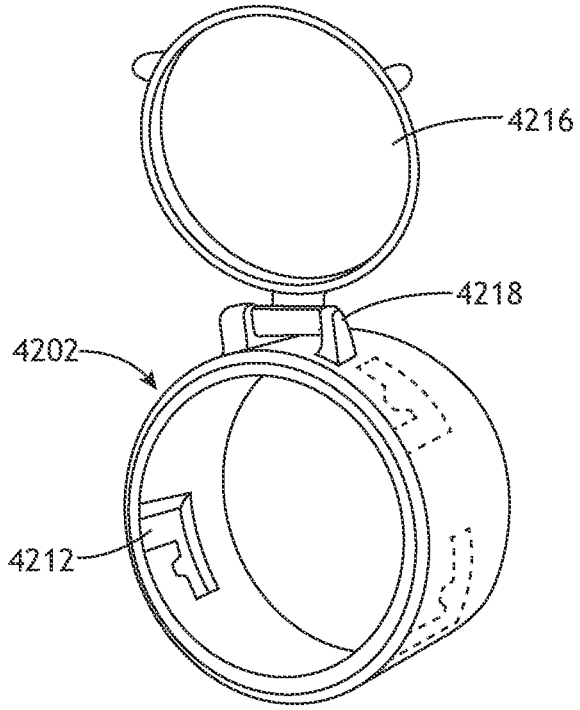
FIG. 42B is a perspective view of a connector including a flip cover in accordance with one or more embodiments of the present disclosure.

In some embodiments, the connector 4202 includes a flip cover that may protect the sight when in a closed position and may allow for the attachment of accessories when in an open position. FIG. 42B is a perspective view of a connector 4202 including a flip cover 4216 in accordance with one or more embodiments of the present disclosure. In one embodiment, as illustrated in FIG. 42B, the flip cover 4216 is connected to the connector 4202 using a hinge 4218 that allows the flip cover 4216 to be moved between the open and closed positions. In some embodiments, though not shown, a flip cover may be provided as an accessory instead of being directly attached to the connector.

Figure 43:
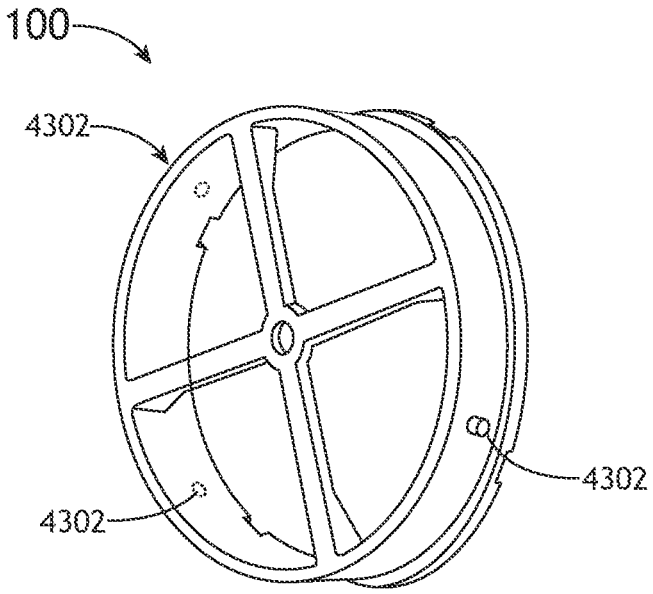
FIG. 43 is a perspective view of a parallax mitigation device suitable for coupling with the connector in accordance with one or more embodiments of the present disclosure.

Referring now to FIG. 43, a perspective view of a parallax mitigation device 100 suitable for coupling with the connector 4202 is shown in accordance with one or more embodiments of the present disclosure. It is to be understood that the parallax mitigation device 100 in FIG. 43 is provided solely for illustrative purposes as an example of an accessory designed to couple with the connector 4202. Rather, as described previously herein, the connector 4212 may couple with any type of accessory.

In one embodiment, the parallax mitigation device 100 includes male keyed features 4302 suitable for coupling with the female keyed features 4212. However, as described previously herein, the parallax mitigation may couple to the female coupler 4208 of the connector 4202 using any technique known in the art. Further, coupling the parallax mitigation device 100 to the connector 4202 rather than directly to the sight may enable repeated attachment and detachment of the parallax mitigation device 100 without risk of damage to the sight. For instance, a shooter may remove the ARD configured as an accessory, which is normally used on Military optics, and replaced with the parallax mitigation device 100 for boresighting and zeroing of the firearm. The shooter may then easily remove the parallax mitigation device 100 and reinstall the ARD without any strain or wear on the sight itself.

Figure 44:
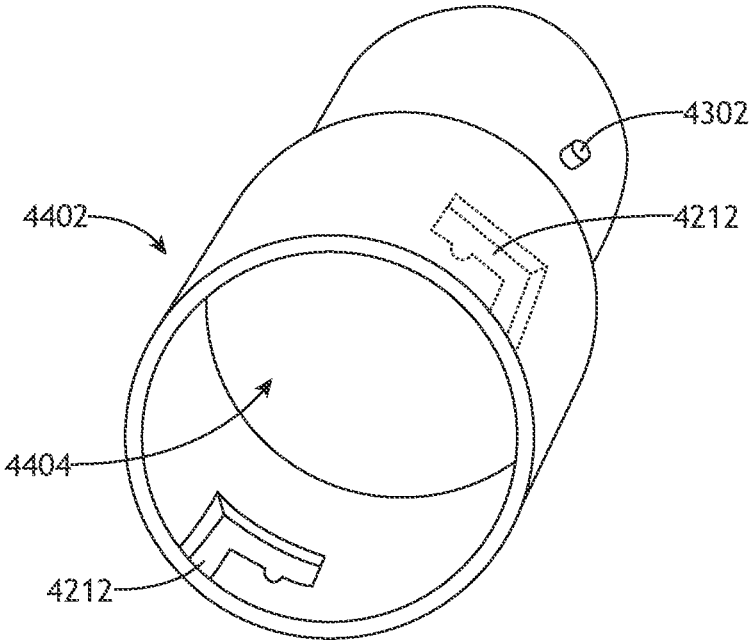
FIG. 44 is a perspective view of a stackable accessory suitable for coupling with the connector and/or another accessory in a stacked configuration, in accordance with one or more embodiments of the present disclosure.

In some embodiments, an accessory suitable for coupling with the connector 4202 may be designed to be stacked to provide for simultaneously mounting two or more accessories to the sight. FIG. 44 is a perspective view of a stackable accessory 4402 suitable for coupling with the connector 4202 and/or another accessory in a stacked configuration, in accordance with one or more embodiments of the present disclosure. In one embodiment, the stackable accessory 4402 includes a male coupler 4208 to couple to the sight or to any other stackable accessory 4402, and further includes a female coupler 4210 to receive an additional stackable accessory. Further, the stackable accessory 4402 may include a central portion 4404 including the operation portion of the accessory (e.g., a filter, or the like). In this regard, multiple stackable accessories 4402 may be attached to the connector 4202. For instance, the stackable accessories 4402 may include one or more spectral filters, one or more ARDs, a parallax mitigation device 100, or any other desired accessory. Further, a flip cover may be configured as either a stackable accessory 4402 or as an unstackable accessory (e.g., with a male coupler 4208 but not a female coupler 4210 for receiving further accessories).

It is contemplated herein that the connector 4202 and any associated stackable or unstackable accessories may provide numerous benefits for a wide range of applications.

For example, a shooter may remove the ARD configured as an accessory, which is normally used on Military optics, and replace it with a parallax mitigation device 100 for boresighting and zeroing of the firearm. The shooter may then easily remove the parallax mitigation device 100 and reinstall the ARD without any strain or wear on the sight itself.

By way of another example in the context of hunting, the same optic may be utilized in a variety of situations and environments. In some cases, an ARD may be necessary to stop reflection from a sight or other optic which may frighten or alert the game animal. In other conditions, a hunter may expect to have to engage with a less than optimal position and would benefit from using a parallax mitigation device 100. The systems and methods disclosed herein would quickly allow the hunter to make such changes or even to combine these devices as necessary or desired.

By way of another example in the context of target shooting, it is recognized herein that filters may often change the contrast of targets when viewed through a sight or other optic. It may thus be desirable to change filters in response to changing environmental conditions. Additionally, it may be desirable to utilize a parallax mitigation device 100 with certain types of optics to ensure accuracy. The systems and methods disclosed herein would quickly allow the shooter to make such changes or even to combine these devices as necessary or desired.

By way of another example in the context of photography, it is recognized herein that there may be a myriad of filters available to a user ranging from laser protective filters to filters designed for providing special effects. In typical systems, such filters are typically stacked using fine machine threads that are susceptible to wear and stripping. The systems and methods disclosed herein would offer a much more robust mounting method and will allow for faster changes as well as extending the life of such accessories.

The herein described subject matter sometimes illustrates different components contained within, or connected with, other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "connected" or "coupled" to each other to achieve the desired functionality, and any two components capable of being so associated can also be viewed as being "couplable" to each other to achieve the desired functionality. Specific examples of couplable include but are not limited to physically interactable and/or physically interacting components and/or wirelessly interactable and/or wirelessly interacting components and/or logically interactable and/or logically interacting components.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages. The form described is merely explanatory, and it is the intention of the following claims to encompass and include such changes.

What is claimed:

1. A boresighting system comprising:

a laser boresight device comprising a casing configured to be loaded into a chamber of a firearm in place of a bolt carrier group, wherein the casing is configured to accept a laser device for generating a laser beam within an interior cavity of the casing, wherein the casing includes at least one keyed feature to engage with boundaries of the chamber to align an exit port in the casing to a barrel of the firearm when the casing is loaded into the chamber such that the laser beam propagates through the exit port and along the barrel; and a parallax mitigation device comprising:

a housing for securing to at least one of a front or a rear portion of an optical sight on the firearm;

a central position indicator connected to the housing providing a visual indication of a central position of the optical sight when viewed through the optical sight;

wherein boresighting of the firearm is provided by adjusting an eye position of a user to view a laser spot on a target associated with the laser beam from the laser boresight device at a selected boresighting distance at the central position of the optical sight based on the central position indicator and adjusting the optical sight to overlap an alignment reference provided by the optical sight with the laser spot at the central position of the optical sight.

2. The boresighting system of claim 1, wherein the selected boresighting distance is at least 100 meters.

3. The boresighting system of claim 1, wherein the selected boresighting distance is in a range from 100 meters to 1000 meters.

4. The boresighting system of claim 1, wherein the optical sight comprises:

a red dot sight, wherein the alignment reference provided by the optical sight includes a projected aiming point.

5. The boresighting system of claim 1, wherein the optical sight comprises:

a magnified optical sight, wherein the alignment reference provided by the optical sight includes a reticle pattern.

6. The boresighting system of claim 1, further comprising:

a laser visibility enhancing material comprising at least one of a retroreflective, a luminescent, a fluorescent, or a phosphorescent material, wherein the laser visibility enhancer is configured for placement at the target at the selected boresight target distance and provides a reflected intensity of the laser beam from the laser boresight device above a selected threshold.

7. The boresighting system of claim 1, further comprising:

a shadowbox for at least partially surrounding the target at the selected boresight target distance.

8. The boresighting system of claim 1, further comprising:

a bandpass optical filter configured to be mounted to the optical sight, wherein the bandpass optical filter selectively passes a wavelength associated with the laser beam from the laser boresight device and partially suppresses remaining visible wavelengths.

9. The boresighting system of claim 1, further comprising:

an adjustment tool including a screwdriver bit centered in a cylindrical outer sleeve, wherein a diameter of the cylindrical outer sleeve is larger than a threaded portion of an adjustment turret on the optical sight, wherein the screwdriver bit is configured to engage with an adjustment screw of the optical sight for the adjusting of the optical sight to view the alignment reference provided by the optical sight to overlap the alignment reference provided by the optical sight with the laser spot at the central position of the parallax mitigation device.

10. The boresighting system of claim 1, further comprising:

a firearm mount configured to secure the firearm.

11. The boresighting system of claim 1, wherein the laser boresight device is secured with a recoil buffer when in the chamber.

12. The boresighting system of claim 1, wherein the laser device is powered by at least one battery housed within the interior cavity of the casing, wherein the laser boresight device further comprises:

a removable cap, wherein removal of the removable cap provides access for removal and insertion of at least one of the laser device or the at least one battery for powering the laser device.

13. The boresighting system of claim 1, wherein the selected boresighting distance is at least 25 meters.

* * * * *